US010850159B2

(12) United States Patent
Goldberg

(10) Patent No.: US 10,850,159 B2
(45) Date of Patent: Dec. 1, 2020

(54) EXERCISE DEVICES

(71) Applicant: Serge Goldberg, Ambler, PA (US)

(72) Inventor: Serge Goldberg, Ambler, PA (US)

( * ) Notice: Subject to any disclaimer, the term of this patent is extended or adjusted under 35 U.S.C. 154(b) by 0 days.

(21) Appl. No.: 16/426,821

(22) Filed: May 30, 2019

(65) Prior Publication Data

US 2019/0275367 A1 Sep. 12, 2019

Related U.S. Application Data

(60) Division of application No. 15/206,503, filed on Jul. 11, 2016, now Pat. No. 10,343,014, which is a (Continued)

(51) Int. Cl.
*A63B 22/20* (2006.01)
*A63B 21/008* (2006.01)
(Continued)

(52) U.S. Cl.
CPC ..... *A63B 22/201* (2013.01); *A63B 21/0087* (2013.01); *A63B 21/068* (2013.01);
(Continued)

(58) Field of Classification Search
CPC ..... A63B 21/00058; A63B 21/00069; A63B 21/00072; A63B 21/00076; A63B 21/00178; A63B 21/00181; A63B 21/00185; A63B 21/002; A63B 21/0023; A63B 21/008; A63B 21/0083; A63B 21/0084; A63B 21/0085; A63B 21/0087; A63B 21/0088; A63B 21/02; A63B 21/021; A63B 21/022; A63B 21/023; A63B 21/025; A63B 21/026; A63B 21/028; A63B 21/04; A63B 21/0407; A63B 21/0414; A63B 21/0421; A63B 21/0428; A63B 21/0435; A63B 21/0442; A63B 21/045;
(Continued)

(56) References Cited

U.S. PATENT DOCUMENTS 1,982,843 A * 12/1934 Traver ..... A63B 22/001 482/70
2,274,081 A * 2/1942 Francois ..... A63B 69/18 482/71
(Continued)

FOREIGN PATENT DOCUMENTS

WO 2005011818 A1 2/2005
WO 2005107889 A1 11/2005

OTHER PUBLICATIONS

International Search Report from corresponding PCT/US2015/011069 dated May 6, 2015.

*Primary Examiner* — Gary D Urbiel Goldner
(74) *Attorney, Agent, or Firm* — Caesar Rivise, PC

(57) ABSTRACT

An exercise device includes spaced-apart exercise members engageable by appendages of an exerciser and moveable in opposed directions, a body support member for supporting an exerciser and a platform below the body support member. A synchronizing drive system connects the exercise members with the body support member for moving the body support member in opposite directions relative to the platform by movement of the exercise members in opposite directions, respectively.

19 Claims, 42 Drawing Sheets

Related U.S. Application Data continuation-in-part of application No. PCT/US2015/011069, filed on Jan. 12, 2015.

(60) Provisional application No. 61/925,706, filed on Jan. 10, 2014.

(51) Int. Cl.

| | |
|---|---|
| ***A63B 22/16*** | (2006.01) |
| ***A63B 26/00*** | (2006.01) |
| ***A63B 22/00*** | (2006.01) |
| ***A63B 21/068*** | (2006.01) |
| ***A63B 22/14*** | (2006.01) |
| ***A63B 23/035*** | (2006.01) |
| ***A63B 23/12*** | (2006.01) |
| ***A63B 71/00*** | (2006.01) |
| ***A63B 69/00*** | (2006.01) |
| ***A63B 21/02*** | (2006.01) |
| ***A63B 21/062*** | (2006.01) |
| ***A63B 21/00*** | (2006.01) |

(52) U.S. Cl.

CPC ..... *A63B 22/0005* (2015.10); *A63B 22/0012* (2013.01); *A63B 22/0089* (2013.01); *A63B 22/14* (2013.01); *A63B 22/16* (2013.01); *A63B 22/203* (2013.01); *A63B 22/205* (2013.01); *A63B 22/208* (2013.01); *A63B 23/03516* (2013.01); *A63B 23/12* (2013.01); *A63B 26/003* (2013.01); *A63B 21/023* (2013.01); *A63B 21/0622* (2015.10); *A63B 21/4034* (2015.10); *A63B 21/4035* (2015.10); *A63B 22/0007* (2013.01); *A63B 69/0059* (2013.01); *A63B 2022/0035* (2013.01); *A63B 2022/0038* (2013.01); *A63B 2071/0063* (2013.01); *A63B 2071/0072* (2013.01); *A63B 2208/0204* (2013.01); *A63B 2208/0233* (2013.01); *A63B 2220/10* (2013.01); *A63B 2220/803* (2013.01); *A63B 2220/805* (2013.01); *A63B 2220/833* (2013.01); *A63B 2225/09* (2013.01); *A63B 2225/093* (2013.01); *A63B 2225/50* (2013.01)

(58) Field of Classification Search

CPC . A63B 21/0455; A63B 21/05; A63B 21/0615; A63B 21/0616; A63B 21/0617; A63B 21/0618; A63B 21/062; A63B 21/0622; A63B 21/0624; A63B 21/065; A63B 21/068; A63B 21/15; A63B 21/151; A63B 21/154; A63B 21/156; A63B 21/157; A63B 21/158; A63B 21/159; A63B 21/16; A63B 21/22; A63B 21/227; A63B 21/4011; A63B 21/4015; A63B 21/4017; A63B 21/4019; A63B 21/4027; A63B 21/4029; A63B 21/4031; A63B 21/4033; A63B 21/4034; A63B 21/4035; A63B 21/4041; A63B 21/4045; A63B 21/4047; A63B 21/4049; A63B 22/0002; A63B 22/0005; A63B 22/0007; A63B 22/001; A63B 22/0012; A63B 22/0015; A63B 22/0017; A63B 22/0023; A63B 22/0046; A63B 22/0076; A63B 22/0087; A63B 22/0089; A63B 22/14; A63B 22/16; A63B 22/18; A63B 22/20; A63B 22/203; A63B 22/205; A63B 22/208; A63B 2022/0035; A63B 2022/0038; A63B 23/035; A63B 23/03516; A63B 23/0355; A63B 23/03558; A63B 23/03566; A63B 23/03575; A63B 23/04; A63B 23/0405; A63B 23/0482; A63B 23/0488; A63B 23/0494; A63B 23/08; A63B 23/12; A63B 23/1209; A63B 23/1218; A63B 23/1227; A63B 23/1236; A63B 23/1245; A63B 23/1254; A63B 23/1281; A63B 26/00; A63B 26/003; A63B 69/0022; A63B 69/0057; A63B 69/0059; A63B 69/18; A63B 2069/0062; A63B 71/0054; A63B 2071/0063; A63B 2071/0072; A63B 2071/0081; A63B 2208/0228; A63B 2208/0233; A63B 2225/09; A63B 2225/093; A63B 2225/10; A63B 2225/102

See application file for complete search history.

(56) References Cited

U.S. PATENT DOCUMENTS

| | | | | |
|---|---|---|---|---|
| 3,475,021 | A * | 10/1969 | Ruegsegger | A63B 69/18 482/71 |
| 3,559,986 | A | 2/1971 | Ehrmantraut | |
| 3,791,645 | A | 2/1974 | Stelma | |
| 3,912,260 | A | 10/1975 | Rice | |
| 4,340,214 | A | 7/1982 | Schuetzer | |
| 4,607,839 | A | 8/1986 | Knudson | |
| 5,749,811 | A | 5/1998 | Wilson | |
| 5,792,031 | A * | 8/1998 | Alton | A63B 69/0059 482/78 |
| 6,042,510 | A * | 3/2000 | Miller | A63B 22/001 482/51 |
| 6,220,990 | B1 | 4/2001 | Crivello | |
| 6,514,180 | B1 * | 2/2003 | Rawls | A63B 21/005 482/51 |
| 8,128,540 | B2 | 3/2012 | Savsek et al. | |
| 8,961,373 | B2 * | 2/2015 | Halver | A63B 69/0022 482/51 |
| 10,343,014 | B2 * | 7/2019 | Goldberg | A63B 23/03516 |
| 2003/0216230 | A1 | 11/2003 | Wang | |
| 2004/0241631 | A1 * | 12/2004 | Nizamuddin | A63B 22/0061 434/253 |
| 2007/0072745 | A1 | 3/2007 | Nicholas | |
| 2008/0167166 | A1 * | 7/2008 | Soletski | A63B 22/16 482/79 |
| 2009/0298655 | A1 * | 12/2009 | Lacher | A63B 23/0488 482/134 |
| 2012/0277063 | A1 | 11/2012 | Zhang et al. | |
| 2013/0102442 | A1 | 4/2013 | Liang | |
| 2016/0324713 | A1 * | 11/2016 | Halperin | A61H 1/0281 |

* cited by examiner

EXERCISE DEVICES

RELATED APPLICATION

This application is a divisional application of application Ser. No. 15/206,503, which in turn is a continuation-in-part application of US International application No. PCT/US2015/011069 filed on Jan. 12, 2015, which, in turn claims the benefit of the filing date of provisional application Ser. No. 61/925,706, filed on Jan. 10, 2014, the subject matter of which is all incorporated by reference herein.

BACKGROUND OF THE INVENTION

A variety of exercise devices are known for exercising both the lower and upper torso of an individual. In addition, some of these devices provide excellent endurance training.

One prior art device for providing training of the lower torso of an individual in the frontal plane is made by Reebok and is referred to as the "Reebok slide." This device includes a generally planer, low friction surface with bolsters at opposed transverse ends to limit the sliding movement of a person as the person traverses the slide from side-to-side. The person desiring to exercise on this device is required to put on a pair of slippers to provide low friction engagement with the slide surface.

In use a individuals shifts his/her weight and pushes off of his/her trailing leg to provide translational back and forth movement in the frontal plane. This system does not provide optimized strength and endurance training of the lower torso in a frontal plane.

Moreover, an individual using this system is not supported and needs to rely upon his/her balance to maintain in an upright position during sliding movement. This can provide a dangerous exercise for individuals that either lack balance, coordination or simply cannot maintain control of their body during such sliding movement.

Numerous other devices are known in the prior art for providing lower torso exercises, and in some cases upper body exercises.

Zhang et al. U.S. Publication No. 2012/0277063 discloses an apparatus and method for controlling lower-limb joint movements in the form of a generally elliptical device including foot supports on a reciprocating platform attached to a rotary support member. This device is not designed to provide lower body exercises in a frontal plane or any type of sliding body movement.

Saysek et al. U.S. Pat. No. 8,128,540 discloses a multi-purpose exercise system in which a person can exercise by sliding along an elongate platform and also engaging in upper body exercises by using an additional connection device. In particular, the system is disclosed for use in carrying out skiing exercises, rowing exercises and weight training/resistance exercises. While this device is designed to provide both lower body and upper body training, it is believed to have limited applicability, and does not provide the most desired endurance and strength training for the lower torso and/or upper torso of an exerciser.

Nicholas U.S. Publication 2007/0072745 discloses an alpine ski training apparatus employing spaced-apart foot platforms that are mounted on a linkage assembly for rocking movement. The device further includes a back support to be used by a person simulating the compound motion encountered in alpine skiing. This device does not deal with the problem of providing rigorous strength and endurance training of the lower torso in a frontal plane, let alone achieving this strength and endurance training in a device including an upper body exercise system.

Crivello U.S. Pat. No. 6,220,990 provides a jumping jack exercise machine that includes frame members and foot supports for supporting or retaining a person's arms and feet as the person is engaged in a jumping jack exercise. This device is not designed for sliding exercise movement in a frontal plane to achieve high strength and endurance training.

Skatestrider Inc. International Publication No. WO2005/107889 discloses an apparatus including foot supports mounted on non-linear tracks to permit the simulation of skating or roller blading movement.

Lipscomb, et al. International Publication No. WO2005/011818 discloses a pushup device employing a reciprocating platform with hand engaging sections slidably attached thereto. This device does not provide lower torso training in a frontal plane or a combination of lower and upper torso training/exercising.

Schützer U.S. Pat. No. 4,340,214 discloses a training apparatus for skaters including foot supports mounted for sliding movement along a rail.

Ehrmantraut U.S. Pat. No. 3,559,986 discloses a system employing rollably mounted dollies for engagement by an individual's feet to provide frontal exercise for the individual.

Wang U.S. Publication No. 2003/0216230 discloses a multi-purpose exercise device providing synchronized sliding on a stationary support and also capable of providing upper body exercises.

Stelma U.S. Pat. No. 3,791,645 discloses a ski-simulator training device wherein foot supports are slidably movable in a frontal plane through a stationary mounting system.

Wilson U.S. Pat. No. 5,749,811 discloses a ski-training device employing an elongate, reciprocating platform with slidable foot support members thereon.

Liang U.S. publication No. 2013/0102442 discloses an exercise device employing a spaced-apart exercise members engageable by the hands of an exerciser and being pivotally connected to a lower platform that can be reciprocated from side to side. The platform includes feet support members pivotally mounted on a support fixed against movement to the platform.

Based upon the state of the art a need is believed to exist for an improved exercise devices for providing enhanced exercise in a frontal plane for the lower torso.

In addition, a need is believed to exist for an exercise device capable of coordinating lower torso and upper torso exercising by synchronizing movement of the upper body with movement of the lower torso during an exercise operation.

Moreover, a need is believed to exist for an exercise device including both upper and lower exercise systems and wherein the movement of these two systems either can be connected for synchronized movement or disconnected to permit lower body sliding movement independent of the upper body exercise system.

SUMMARY OF THE INVENTION

An exercise device in accordance with this invention includes an elongate platform having a longitudinal dimension provided between spaced apart ends thereof. A pair of foot support members is slidably mounted on and relative to the platform for movement along the longitudinal dimension. A mount for the elongate platform permits reciprocating or rocking movement of the platform for alternately permitting each of the spaced apart ends to move upwardly and downwardly relative to a horizontal support surface for the exercise device. A guide member adjacent a side edge of the elongate platform retains a body support member vertically above the platform. The body support member is engageable by the exerciser, and preferably is in the form of a back support or a seating piece having a back support and seat. The guide member guides the body support member for movement in a longitudinal direction as an exerciser in the foot support members engages the body support member and slides along the longitudinal dimension of the platform in opposite directions.

Most preferably the an adjustment device is employed to permit vertical adjustment of the guide member relative to the platform to thereby change the vertical spacing between the body support member and the platform.

In one embodiment of the invention the guide member includes a longitudinally extending support that is vertically above the elongate platform for slidably retaining the body support member for movement along the longitudinal direction.

In a more preferred embodiment of the invention the guide member includes a longitudinally extending support that is arcuate in the longitudinal direction for guiding the body support member for movement both in a longitudinal direction aligned with the elongate dimension of the platform and in a direction normal to the longitudinal direction as the body support member moves longitudinally along the longitudinally extending support.

In a preferred embodiment of this invention the mount for the elongate platform includes at least one arcuate member connected to the elongate platform and extending downwardly therefrom. The arcuate member(s) include an arcuate, lower surface for engaging and rocking on a support surface, whereby the rocking results in reciprocating movement of the elongate platform.

In an alternative embodiment of this invention the mount for permitting reciprocating movement of the elongate platform is in the form of a pivot joined to the elongate platform substantially in the middle of said elongate dimension. Preferably, when a pivot connection is employed a pair of force transmitting devices is attached to a lower surface of the platform for providing a force on the platform opposing the downward force imposed on each end of the platform as each end is alternately moved downwardly by the sliding exercise of the exerciser.

In another alternative embodiment, the mount for permitting reciprocating movement of the elongate platform includes a pair of rotatable members located adjacent the longitudinal ends of the platform; each rotatable member being rotatably connected to a respective end of the platform, whereby sliding movement of an exerciser in opposed longitudinal directions along the platform converts reciprocating movement of the platform into rotary movement of the rotatable members.

In an embodiment of this invention in which the body support member is in the form of a seating piece having a seat and back engaging member, the seat is pivotally attached to the back engaging member to permit movement of the seat between a horizontal position to support an exerciser thereon and a retracted position in which only the back engaging member is adapted to engage an exerciser.

In an embodiment of this invention the guide member for the body support member includes a vertical rail, and the body support member is mounted for vertical movement on the rail.

In preferred embodiments of this invention, the guide member for retaining the body support member and the elongate platform are mounted for transverse movement relative to each other in a direction substantially perpendicular to the direction of elongation of the platform to permit adjusting the transverse location of an exerciser relative to the elongate platform.

In an embodiment of this invention in which a body support member includes a back engaging member for engaging an exerciser's back, arm supports also are provided on opposed sides of the back engaging member and preferably the arm supports are moveable from a position for supporting the arms of an exerciser to an inactive position in which said arm supports cannot support the arms of an exerciser.

In a preferred embodiment of this invention the body support member includes an upper body exercise system including spaced-apart exercise members engageable by and moveable with appendages of an exerciser against a resistive force opposing the movement of the spaced-apart exercise members as the exerciser is sliding along the elongate platform.

In a preferred embodiment of this invention in which spaced-apart exercise members of an upper-body exercise system are employed in conjunction with a body support member, a synchronizing drive system connects the exercise members with the body support member for moving the body support member in opposite longitudinal directions relative to the longitudinal direction in which an elongate platform extends by movement of the exercise members in opposite directions, respectively. In this embodiment the elongate platform may not be mounted for reciprocating motion but most preferably is mounted for such motion.

Preferably, when spaced-apart exercise members are employed they are engageable by the hands of the exerciser, and are adjustable to accommodate exercisers of different sizes.

Preferably, when a synchronizing drive system is employed it includes a gear box for transmitting rotational movement of a pulley moveable with the body support member to rotational movement transferred to at least one of the spaced-apart exercise members Preferably, the gear box transmits rotational movement of a pulley in a single rotational direction to a pair of output shafts from the gear box that are simultaneously rotated in opposite directions, or the same directions depending upon the type of upper body exercise that is desired.

In preferred embodiments employing a gear box for transmitting rotational movement from or to a pulley to or from exercise members a disengagement means is provided for disengaging the transmission means whereby rotational movement of the pulley is not transmitted to move any of the spaced-apart exercise members and movement of any of the spaced-apart exercise members is not transmitted to rotational movement of a pulley moveable with the body support member.

In one preferred form of this invention the guide member includes a rear platform extending above the elongate platform that includes the foot support members slidable therein, and a chair is attached to a seating piece mounting section that is movable on the rear platform.

BRIEF DESCRIPTION OF THE DRAWINGS

The invention will be described in conjunction with the following drawings wherein like reference numerals designate like elements therein.

DESCRIPTION OF THE PREFERRED EMBODIMENTS OF THE INVENTION

Figure 1A:
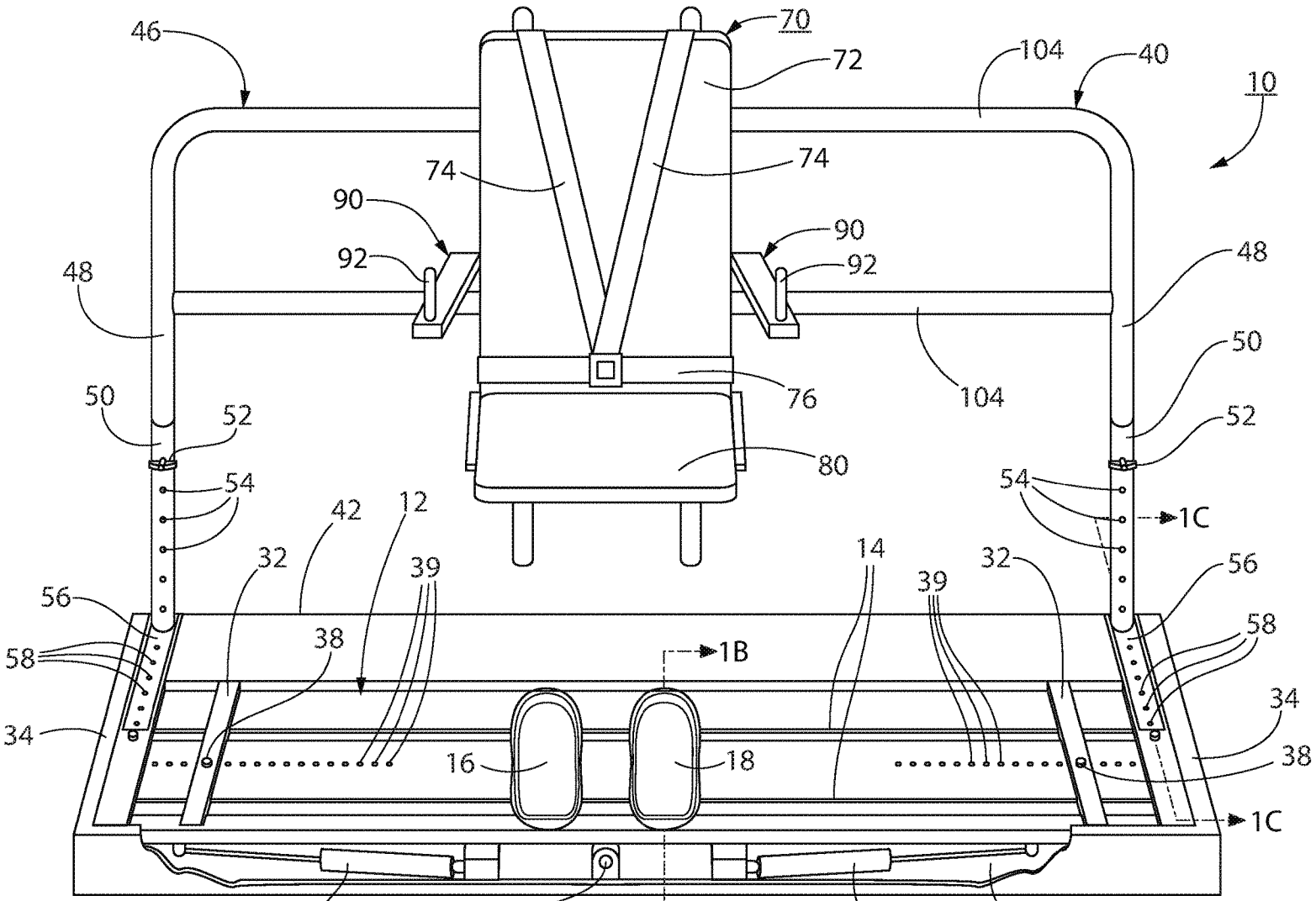
FIG. 1A is a isometric view of an exercise device in accordance with this invention.
Figure 1B:
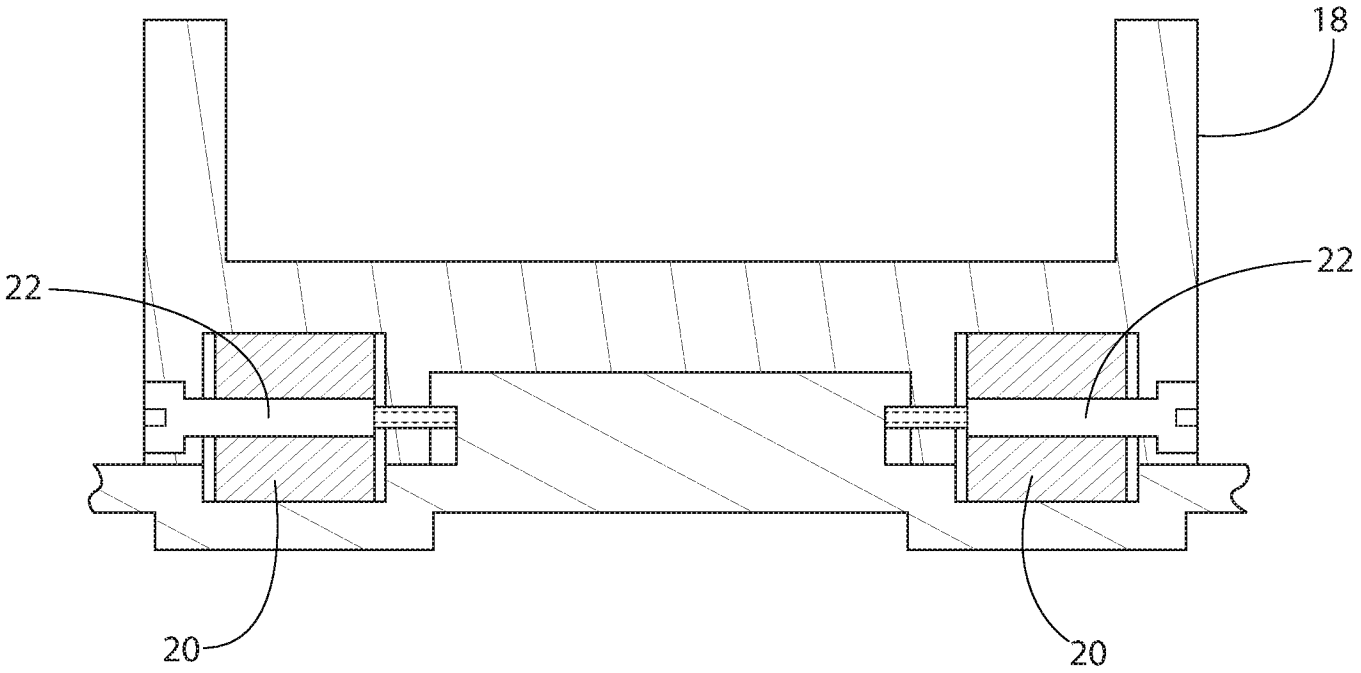
FIG. 1B is a sectional view along line 1B-1B of FIG. 1A illustrating the mounting of foot supports to the elongate platform of the exercise device.
Figure 2:
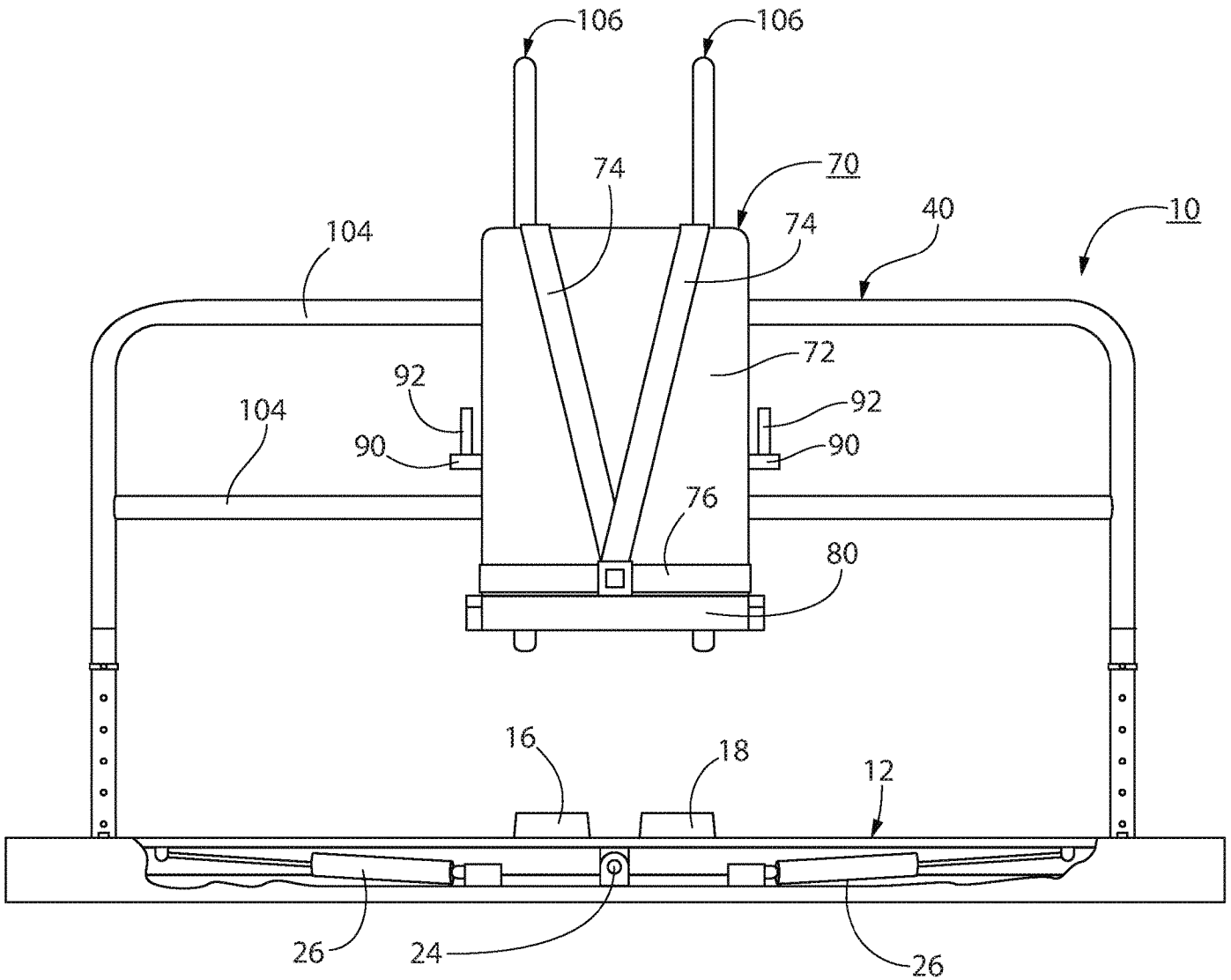
FIG. 2 is a front elevational view of the exercise device illustrated in FIG. 1.

Referring to FIGS. 1A, 1B and 2 an exercise device in accordance with one embodiment of this invention is illustrated at 10. The exercise device includes an elongate platform 12 including elongate slots 14 therein to support a pair of foot support members 16, 18 for sliding movement. Specifically the elongate platform 12 has a longitudinal dimension and the pair of foot support members 16, 18 are slidably mounted on the platform for movement along the longitudinal dimension through rotatable wheels 20 (FIG. 1B) attached to the foot support members through connecting axles 22.

As can be seen best in FIGS. 1A and 2 the elongate platform 12 is mounted for reciprocating movement about a central pivot axle 24 for alternatively permitting each of the spaced apart ends of the platform to move upwardly and downwardly relative to a horizontal support surface (e.g., floor, platform, etc). Most preferably the pivot axle is mounted for vertical movement by a conventional jack-type mechanism to permit adjustment of the degree of reciprocation of the platform 12. For example, if the pivot axle 24 is moved upwardly that angle of reciprocation will be increased and the force exerted by an exerciser sliding in an uphill direction from one side of the platform will be increased.

Still referring to FIGS. 1A and 2 a pair of force transmitting devices 26 preferably in the form of air cylinders are attached to a lower surface of the elongate platform 12 adjacent the ends of the platform. These devices 26 provide a retarding force acting on the platform in a direction opposed to the downward force imposed thereon by an exerciser engaging the foot supports 16, 18 and sliding in opposite directions along the longitudinal dimension of the platform 12 from one side to the opposite side of the pivot axle.

Specifically, the force transmitting devices 26 provide a counteracting force to the downward force imposed upon each end of the platform 12 by an exerciser to thereby permit a smooth rocking or reciprocating movement of the elongate platform as an exerciser slides along the platform from one side of the pivot axis to the opposite side thereof.

The particular force transmitting devices employed to counteract the downward force imposed upon the elongate platform by an exerciser can be of a variety of different configurations, e.g., compression spring members, etc. The particular form of the force transmitting devices does not constitute a limitation on the broadest aspects of this invention and in some embodiments may even be omitted.

Figure 14:
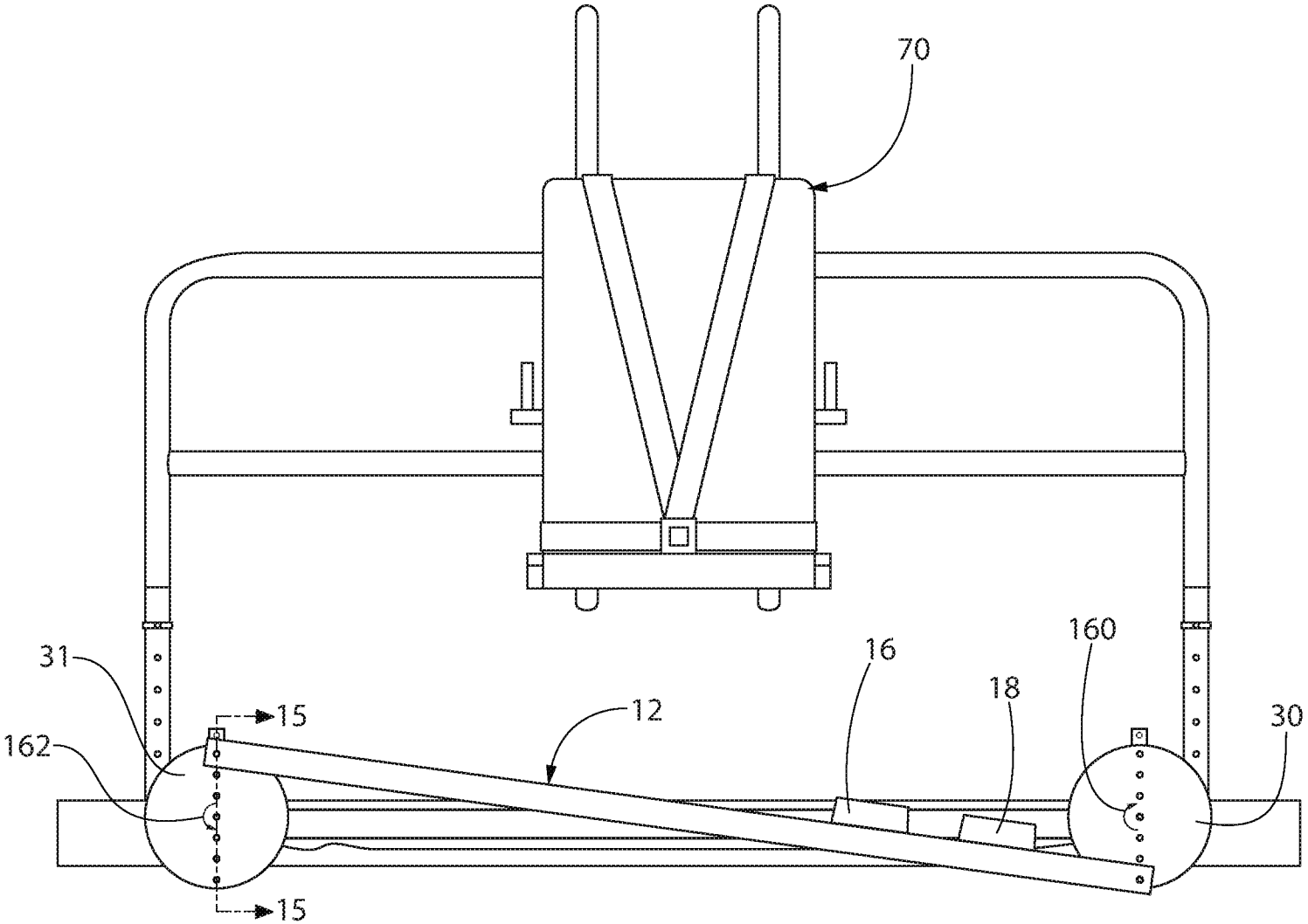
FIG. 14 is an elevational view showing an alternate arrangement for mounting a platform for reciprocating movement.

Referring to FIG. 14, an alternate arrangement for providing reciprocating movement of the elongate platform is illustrated, wherein force transmitting devices of the type illustrated in FIG. 1A are not employed.

In the FIG. 14 embodiment opposed ends of the elongate platform 12 are rotatably secured to spaced apart rotatable members 31 such that an exerciser moving from one end of the platform to an opposed end of the platform will cause the platform to reciprocate or rock by permitting or causing rotational movement of the rotatable members. In this embodiment, separate force transmitting members 26 of the type employed in the embodiment illustrated in FIGS. 1A and 2 are not employed.

Referring to FIG. 1A, transversely extending limit members 32 are provided between upstanding, transversely spaced apart wall sections 34 of compartment 36 in which the elongate platform 12 is mounted, and these limit members can be moved into various positions along the longitudinal extend of the platform by the cooperation of locking pins 38 with any one of a plurality of spaced apart passages 39 provided in the platform. These limit members 32 constitute position-limiting members for limiting the longitudinal extent of travel of the foot support members 16, 18 on the elongate platform 12. The provision of these limit members 32 is a desirable feature of this invention, but is not required in accordance with the broadest aspect thereof.

Still referring to FIGS. 1A and 2, in accordance with the preferred embodiment of this invention, an upwardly directed support 40 is provided adjacent to one of the elongate side edges 42 of the compartment 36. This support 40 includes a body support member 70 thereon for engaging and supporting the body of an exerciser as the exerciser slides in opposite directions along the elongate platform 12, as will be described in greater detail hereinafter.

Referring specifically to FIGS. 1A and C-E, the upwardly directed support 40 includes an upper, substantially U-shaped frame member 46 having longitudinally spaced-apart legs 48 that are telescopically received within spaced-apart lower leg sections 50 of the support. The vertical position of the upper frame member 46 can be adjusted relative to the lower leg sections 50 by removable locking pins 52 that are inserted into an opening 54 in the lower leg sections that is aligned with an opening (not shown) in the longitudinally spaced apart legs 48 of the upper frame member 46.

It should be understood that a number of different arrangements can be employed to provide vertical adjustability of the frame member 46. For example, the lower leg sections 50 can be solid members and downwardly extending legs 48 of the frame member 46 can be telescoped over respective lower leg sections 50. A manually actuated handle can be attached to a rotatable positioning gear extending through one of the legs 48 of the frame member 46 and rotatably mounted within the upper end of the internally telescoping lower leg section 50. The rotatable positioning gear can cooperate with a suitable stationary gear on the frame member 46, whereby rotation of the positioning gear by the handle will cause the frame member 46 to move upwardly or downwardly relative to the lower leg sections 50 depending upon the direction of rotation of the handle. To provide balanced movement of the frame member 46 relative to the lower leg sections 50 a second rotatable positioning gear can extend through the opposed downwardly extending leg 48 and be rotatably mounted in the opposed internally telescoping lower leg section 50. This second rotatable positioning gear can cooperate with a suitable stationary gear on the frame member 46 in substantially the same manner as described above in connection with the first rotatable positioning gear. Any suitable drive or transmission device can be employed to cause the second rotatable positioning gear to rotate in synchronism with the first rotatable positioning gear as the manually actuated handle is rotated. This arrangement permits either upward or downward movement of the frame member 46 depending upon the direction of rotation of the handle and has the benefit of permitting the vertical adjustment without having to align openings in opposed, downwardly extending legs 48 with openings in either internally or externally telescoping lower leg sections 50. In yet another, more preferred embodiment a scissors-actuated jack mechanism can be used to provide the vertical adjustment, as will be discussed in greater detail with respect to the most preferred embodiment of this invention illustrated in FIGS. 30A-30C.

Referring to FIGS. 1A and 1C-1E, the lower leg sections 50 are mounted for transverse movement relative to the elongate platform 12 to thereby permit transverse adjustment of the upwardly directed support 40 relative to the platform. Each of the lower leg sections 50 of the support are mounted for transverse adjustment in the same manner, and therefore the structure for permitting this adjustment will be described only with respect to one of the lower leg sections.

Still referring to FIGS. 1A and 1C-1E, lower leg section 50 is integrally formed with a transversely extending, horizontal leg section 56 having transversely spaced-apart passages 58 therethrough. The horizontal leg section 56 is telescopically mounted within an internal compartment 60 of an outer support section 62, and the outer support section includes a passage 64 therethrough for cooperating with a desired passage 58 extending through the inner, horizontal leg section 56.

Figure 1C:
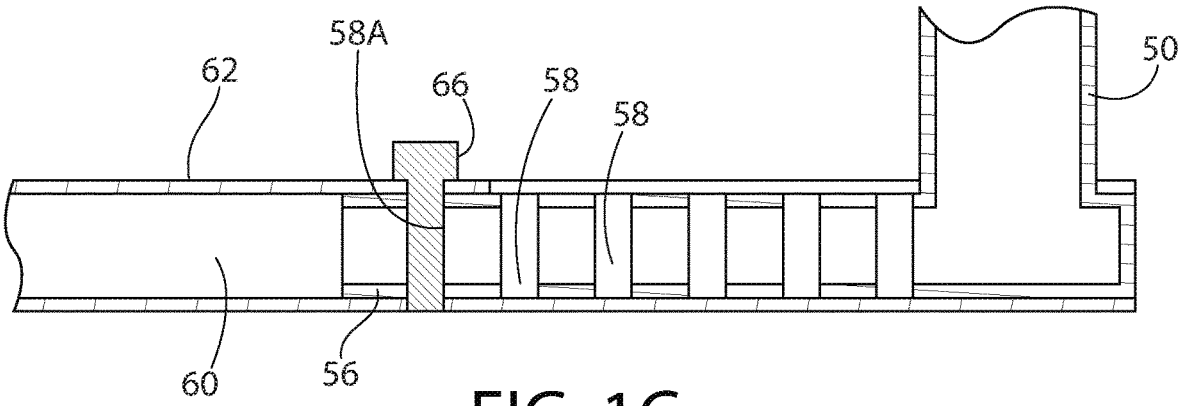
FIGS. 1C, D and E disclose sequential steps in adjusting the transverse position of a vertical frame relative to an elongate platform of the exercise device.

As illustrated in FIG. 1C adjusting pin 66 is inserted into cooperative locking engagement with the outermost, or distal passage 58A in the leg section 56 to provide the maximum transverse spacing between the upwardly directed support 40 and the elongate platform 12.

Figure 1D:
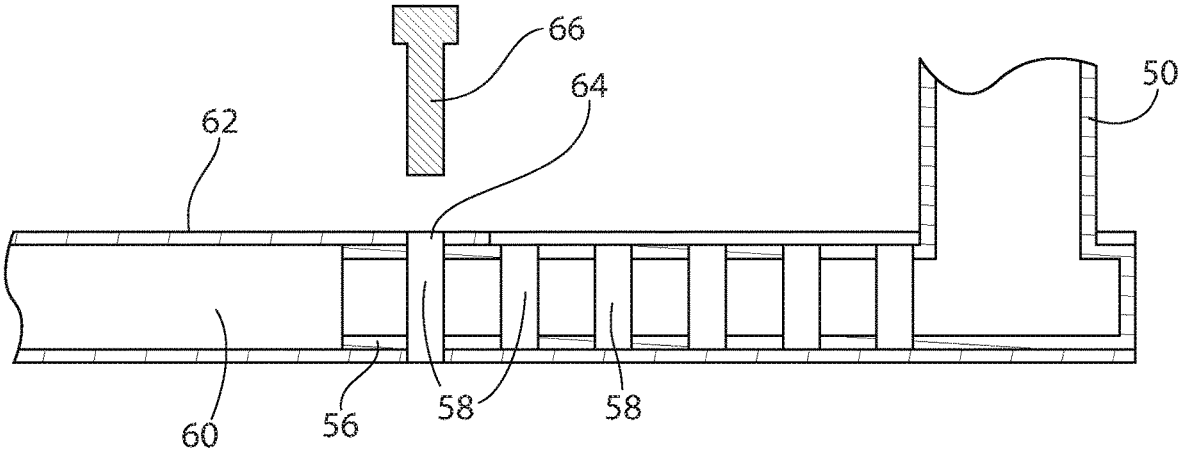

FIG. 1D illustrates an intermediate adjustment position wherein the pin 66 is removed to permit the horizontal leg section 56 to be slid transversely inwardly to move the upwardly directed support 40 into a position closer to the elongate platform 12.

Figure 1E:
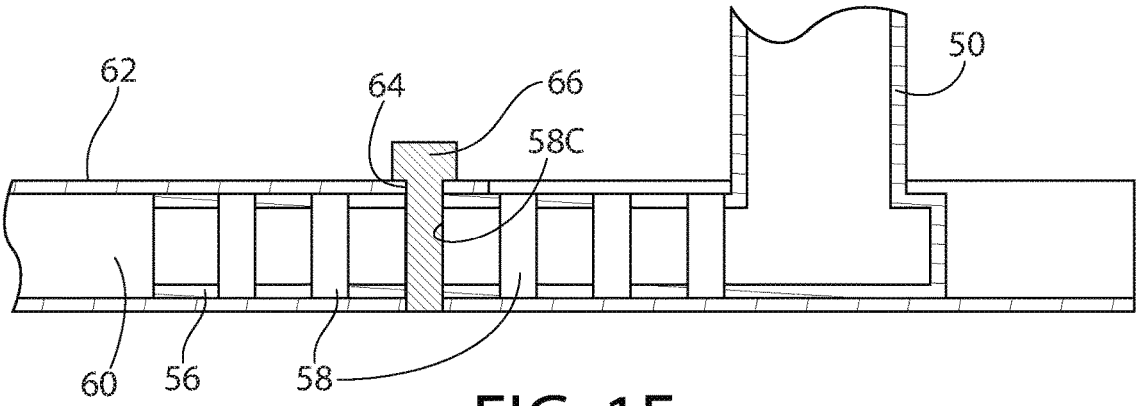

As is illustrated in FIG. 1E when the horizontal leg section 56 of the frame is in the desired location, the locking pin 66 is inserted through the passage 64 of the outer support section 62 and an aligned passage 58C through the horizontal leg section of the frame.

It should be understood that other arrangements can be employed to provide relative transverse adjustment of the upwardly directed support 40 relative to the platform 12. For example, the upwardly directed support can be mounted in a fixed position against transverse movement and the elongate platform 12 can be mounted on suitable adjustment members to permit transverse movement of the platform 12 relative to the support 40. This may be a more preferred arrangement since it may be a simpler arrangement to provide a connection permitting transverse movement of the platform 12 relative to the support 40 than employing the adjustment features required to permit transverse adjustment, or movement, of the support relative to the platform.

Referring to FIGS. 1A, 2, 3A and 3B, the body support member 70 includes a back support 72 having shoulder harnesses 74 and a waistband 76 for retaining a person in engagement with the back support. In addition the body support member 70 includes a pivotally mounted seat 80 movable from an active position to support an exerciser thereon, as is illustrated in FIGS. 1A, 2, 3A and 3B, to an inactive position shown in phantom in FIGS. 3A and 3B.

Figure 3A:
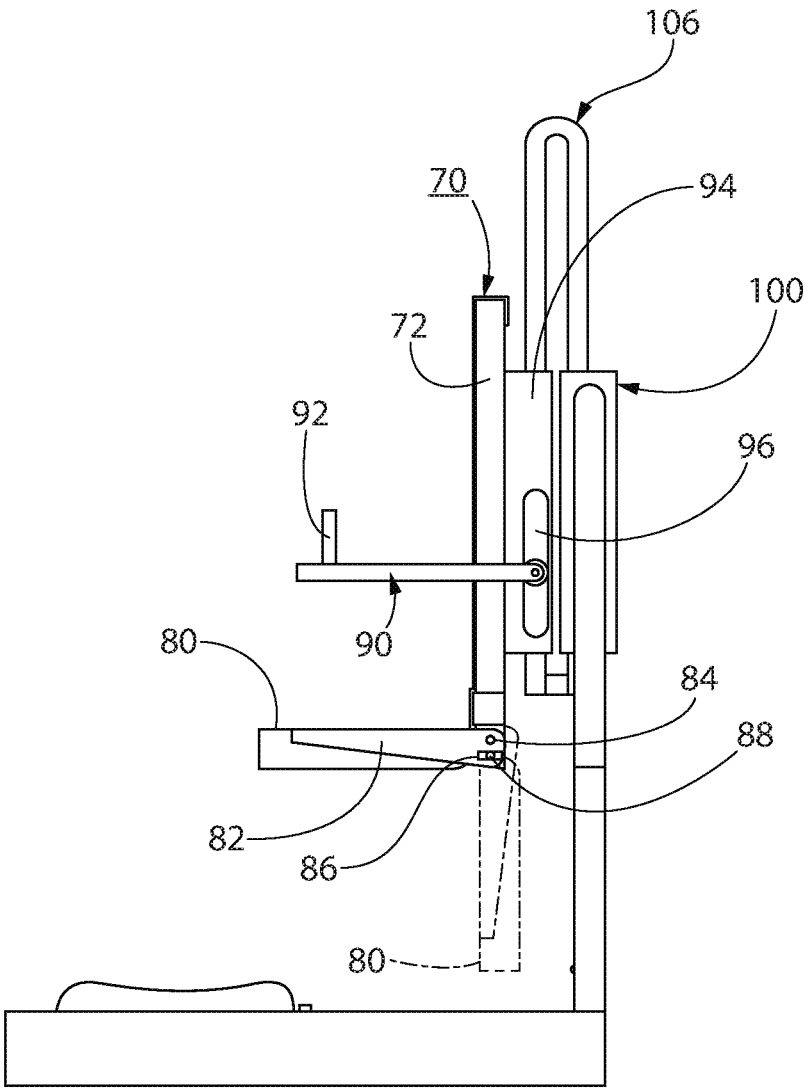
FIG. 3A is a side elevational view of the exercise device shown in FIG. 2.
Figure 3B:
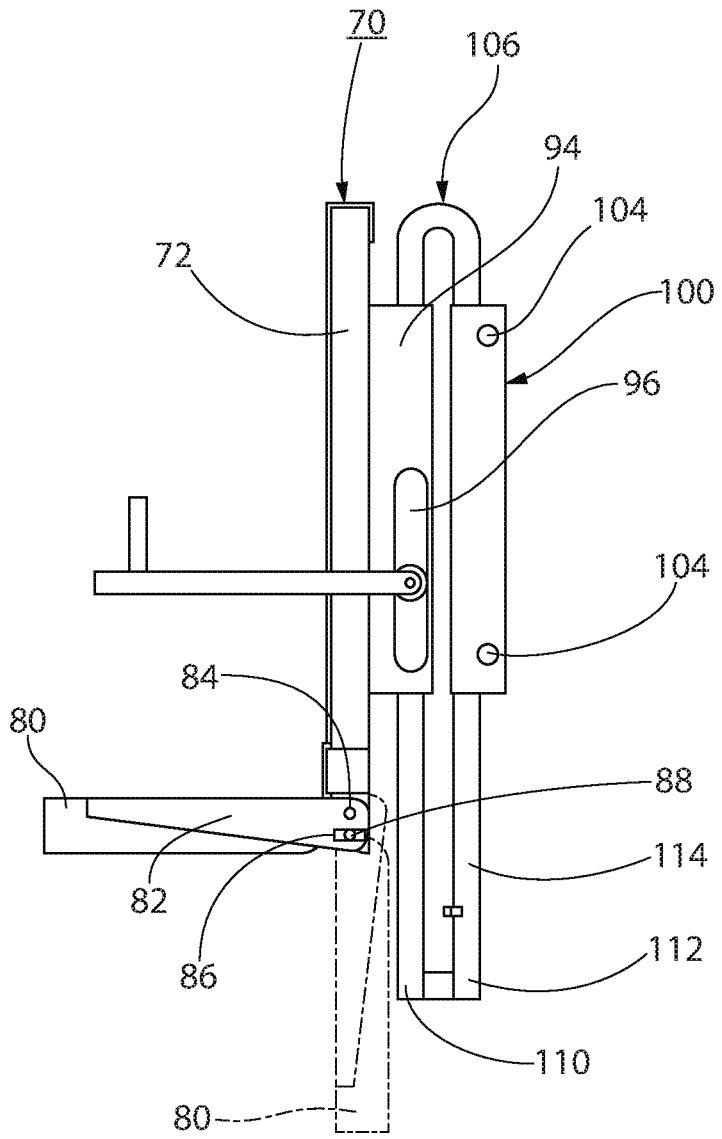
FIG. 3B is an elevational view similar to the view in FIG. 3A, but showing a body support member in a different vertical position from that illustrated in FIG. 3A.

Referring to FIGS. 3A and 3B the seat 80 is pivotally attached to the back support 72 through spaced-apart frame members 42 pivotally attached to the back support through pivot pins 84. The seat is maintained in its active position, substantially perpendicular to the back support 72 by aligning an elongate slot 86 in each of the frame members 42 with an opening (not shown) in an adjacent side of the back support and then inserting a locking pin 88 into the opening in the side of the back support with a portion of said locking pin extending into the region of the elongate slot 86 to maintain the seat 80 in its operative, or active position.

The seat is moved into an inactive position as is shown in phantom in FIGS. 3A and 3B by removal of the locking pins 88 to thereby permit the seat, through the transverse frame members thereof, to rotate about pivot pins 84 into a generally vertical, inactive position as shown in phantom in FIGS. 3A and 3B.

Still referring to FIGS. 1A, 2, 3A and 3B, the body support member 70 further includes transversely spaced apart arm supports 90 having optional upstanding hand engaging pegs or rods 92 thereon. As can be seen best in FIGS. 3A and 3B, the arm supports are pivotally mounted to a frame member 94 forming or attached to the rear of the back support 72. The arm supports are pivotally mounted about pivot axle 96 in a clockwise direction only, from an active position extending substantially horizontally from the back support 72, as shown in the Figures, to a substantially vertical, inactive position behind the back support 72. The vertical height of the arm supports can be adjusted relative to the back support 72 by virtue of mounting the pivot axle of the arm supports in vertically elongate slots 98.

Referring to FIGS. 3A through 3D, a mounting arrangement is shown by which the body support member 70 is retained for both longitudinal movement, generally parallel to the longitudinal dimension of the platform 12, and also vertical movement relative to the platform. Specifically, a mounting block 100 is provided with a pair of vertically spaced apart, elongate passages 102 for receiving vertically spaced-apart, longitudinally extending frame sections 104 of the upwardly directed support 40 (see FIGS. 1A and 2). In fact, one of the longitudinally extending frame sections 104 is the upper, longitudinally extending frame of the support 40.

Attached to the mounting block 100 is a pair of longitudinally spaced-apart, substantially U-shaped members 106 providing vertical guides 108 for permitting vertical movement of the body support member 70 through the attachment of the back member 72 thereof to the frame member 94 that is slideable along the vertical guides 108 in the direction of arrow of the body support member 70 in the direction indicated by arrow 109.

Figure 3C:
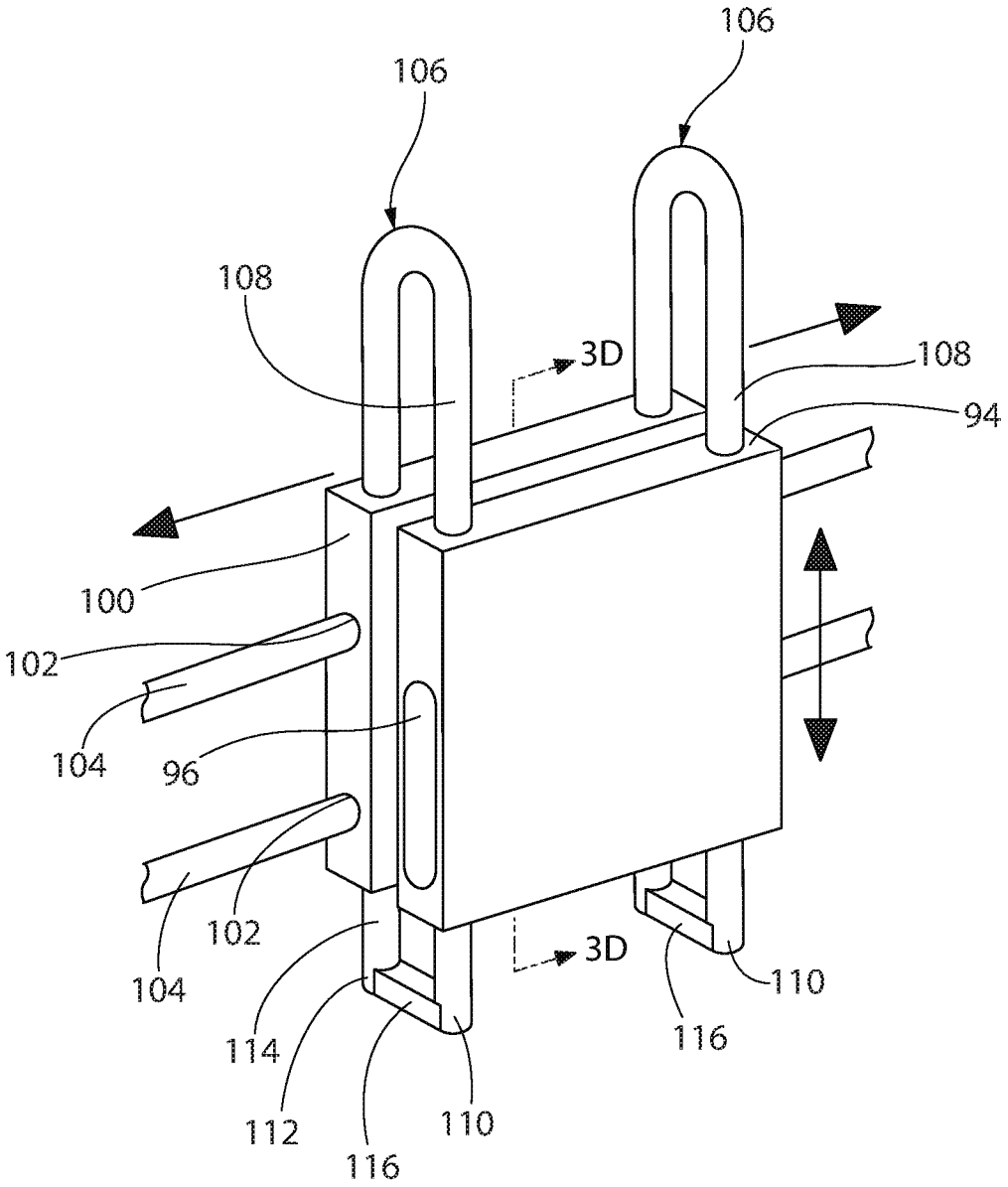
FIG. 3C is an isometric view illustrating the arrangement for mounting cooperating carriages to permit a body support member to move both longitudinally in the direction of an elongate platform of an exercise device and vertically relative to the elongate platform.
Figure 3D:
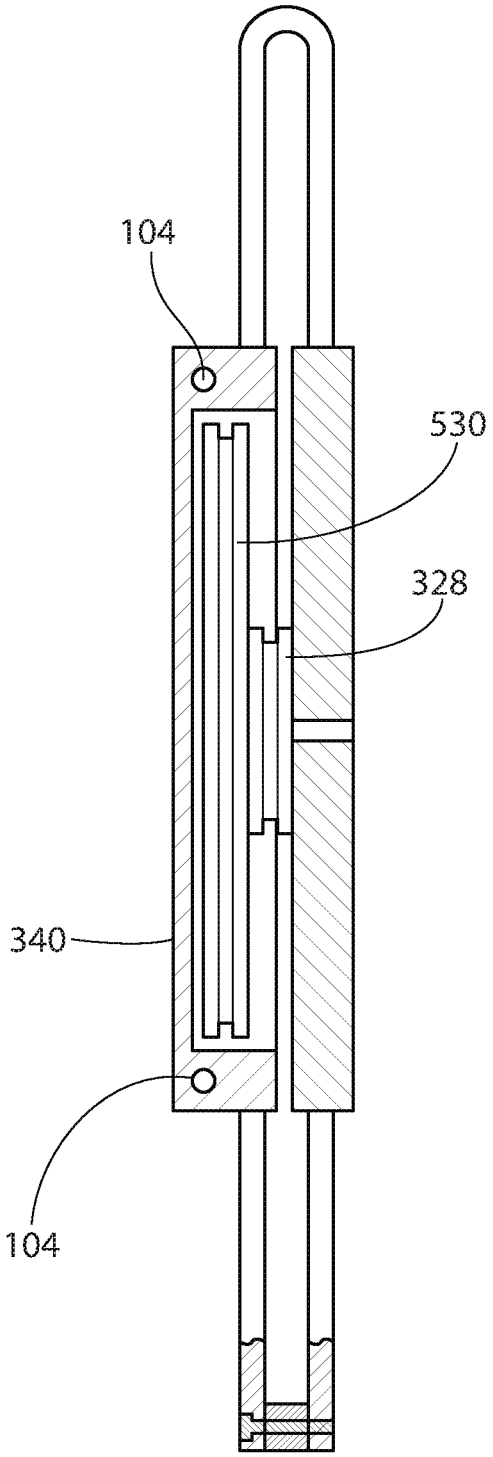
FIG. 3D is a sectional view showing cooperating pulleys attached to a carriage to which a body support member is attached in accordance with the embodiment disclosed in FIG. 20, including a housing for the pulleys.

As can be seen best in FIGS. 3B and 3C, a transversely extending stop member 116 connects the lower end 110 of each of the vertical guides 108 of a U-shaped member 106 with a lower end 112 of a respective member 114 extending vertically downward from the mounting block 110. These transversely extending stop members 116 limit the downward vertical movement of the frame member 94 and the seat forming a part thereof when an individual is exercising on the device 10.

Thus, from the above description, it should be apparent that the body support member 70 is capable of moving in a longitudinal direction substantially parallel to the longitudinal dimension of the platform 12, through its attachment to the mounting of block 100, and also in a vertical direction through the connection of the back support member 72 to vertical guides 108 through the frame member 94. A more preferred arrangement for establishing both longitudinal and vertical movement of the body support member will be discussed later in connection with the most preferred embodiment of the invention shown in FIGS. 30A-C and in FIG. 31.

It should be understood that an individual desiring to carry out and exercise on device 10 will place his/her feet in the foot support members 16, 18 with his/her back contiguous to the back support 72 of the body support member 70. In this position, the harnesses 74 and waistband 76 can be positioned about the exerciser to maintain a firm and positive connection between the body support member 70 and the exerciser.

As explained earlier, the seat 80 of the body support member 70 as illustrated in FIGS. 1A, 2 3A and 3B can either be in an active position to support the exerciser in a seated position, or in an inactive position wherein the exerciser remains in a fully upright position.

Figure 4:
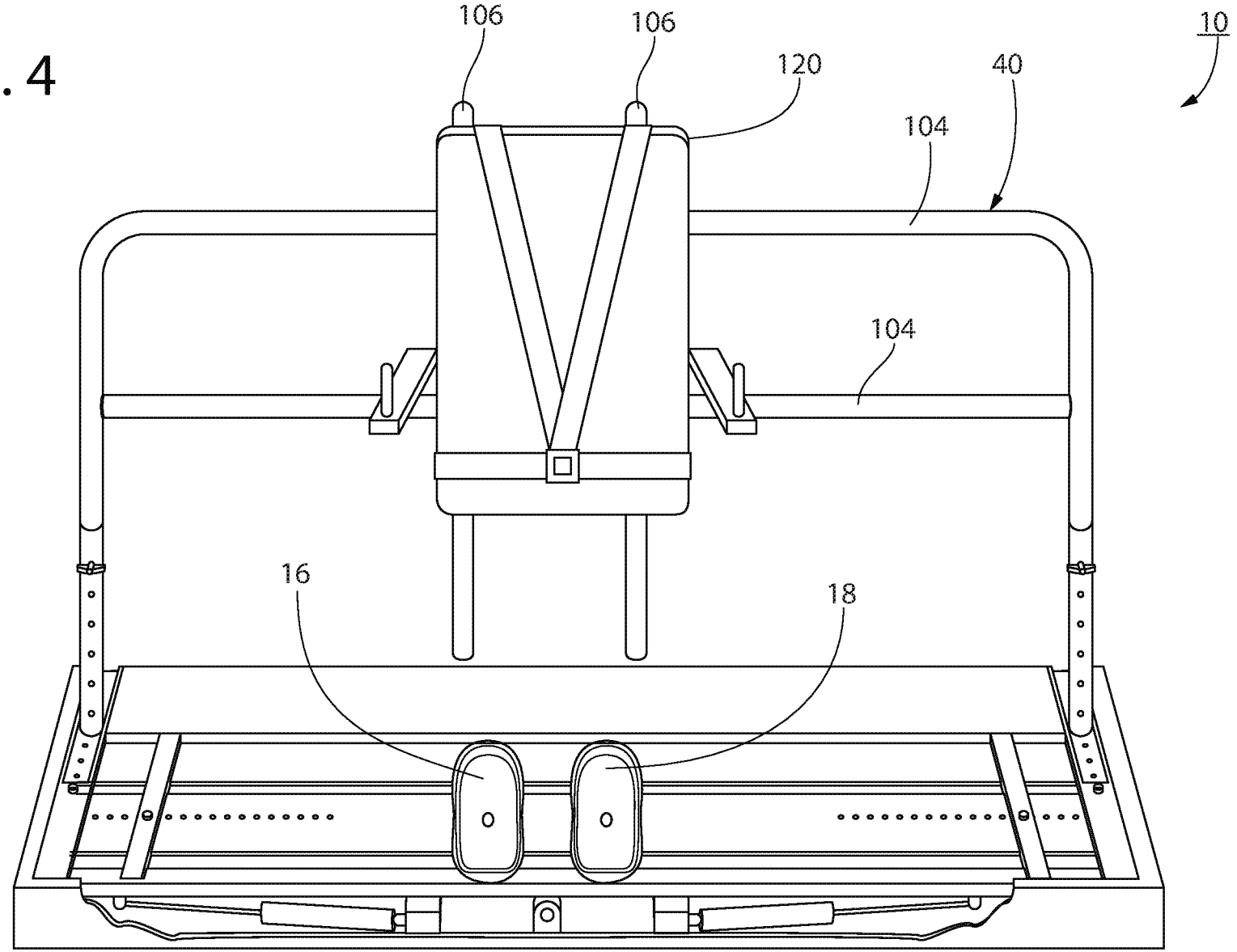
FIG. 4 is an isometric view similar to FIG. 1, but illustrating the exercise device with a body support member devoid of a seating section.

Also, as is illustrated in FIG. 4, a body support member 120 can be solely in the form of backrest, without the inclusion of a seat. In all other respects, the backrest 120 illustrated in FIG. 4 can be identical to the earlier disclosed embodiment shown in FIGS. 1 through 3, and connected for both longitudinal and vertical movement relative to the platform 12 in exactly the same way as the body support member 70, as illustrated in FIGS. 3B and 3C.

Referring to FIGS. 5 through 9, a preferred method of using exercise device 10 will now be described. It should be understood that in this discussion the exerciser is in a fully upright position facing outwardly with his/her left leg 150 in foot support member 18 and his/her right leg 152 in foot support member 16.

Figure 5:
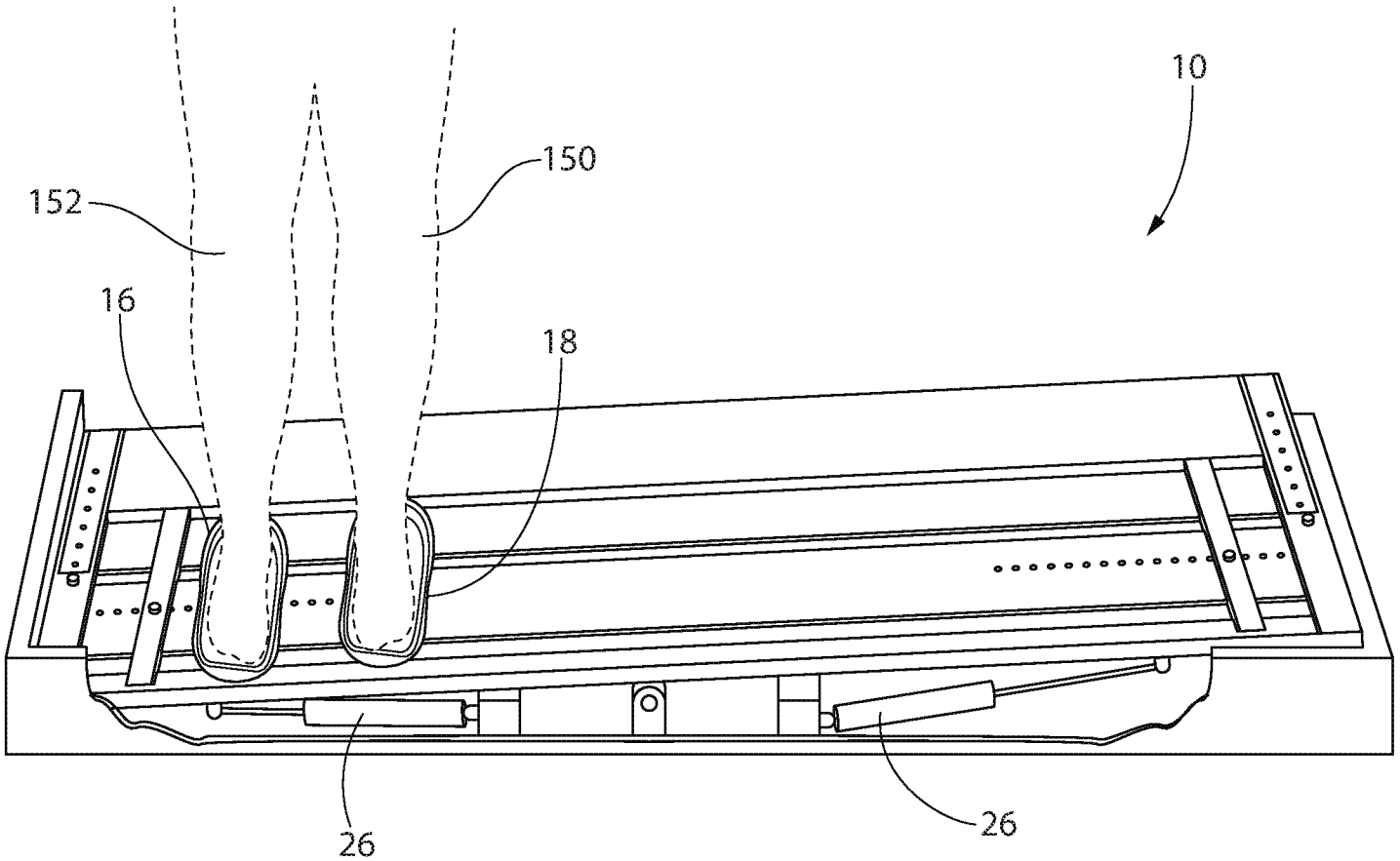
FIG. 5-9 illustrate various position of an individual carrying out a sliding exercise from one end of an elongate platform to the opposed end thereof.

Referring to FIG. 5, an individual exerciser is shown with both foot supports at a left end of the elongate platform as viewed from a position facing the front of the exerciser, with the left end of the platform in a downward position resulting from the imposition of the weight of the exerciser on the platform. All references herein to the left and right side or end of the platform refers to the location of the platform as viewed from a position facing the front of the exerciser.

Figure 6:
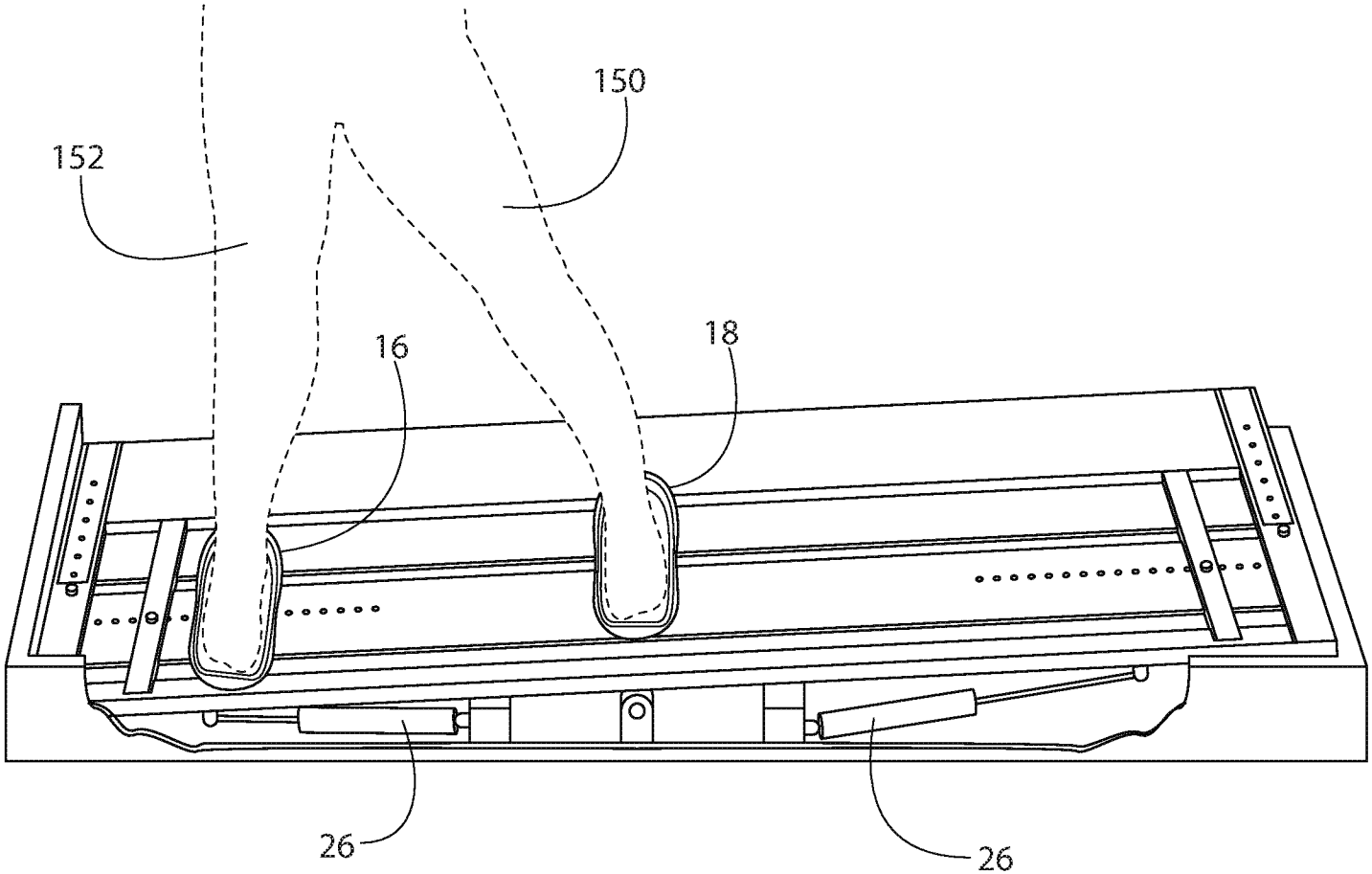

In order to begin the exercise, the exerciser pushes with the trailing leg 152 (i.e., right leg as illustrated) to thereby start the movement of the exerciser "uphill" along the elongate platform, to an intermediate position illustrated in FIG. 6. This uphill movement requires significant energy to enhance exercising the lower torso muscles, in addition to providing excellent endurance training.

Figure 7:
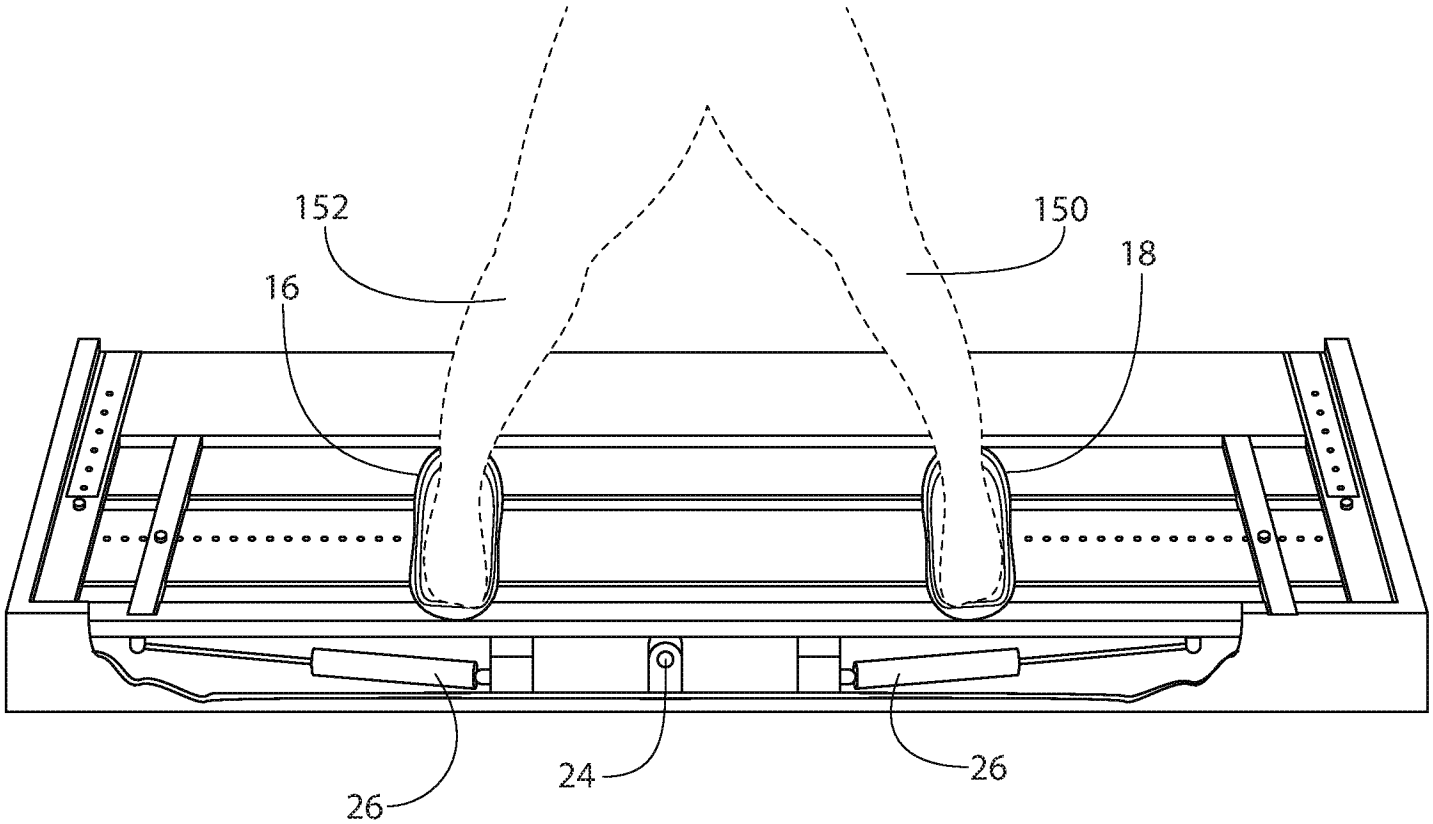
Figure 8:
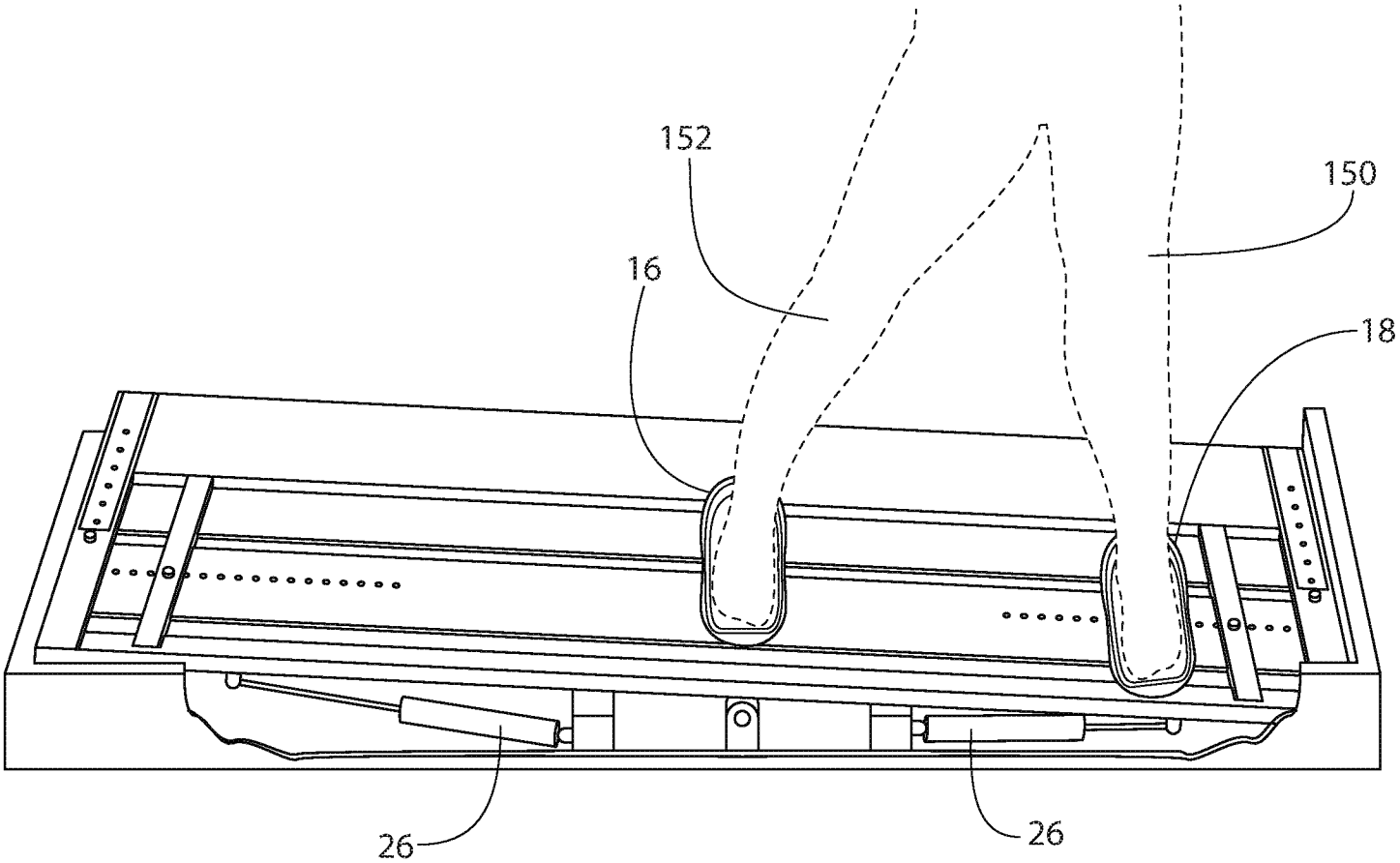

Referring to FIGS. 7 and 8, as the left leg 150 of the exerciser traverses the pivot axle 24, the exerciser's weight begins to transfer to the section of the elongate platform to the right of the pivot axle, as shown in FIGS. 7 and 8, and as the trailing leg 152 moves to a location at or close to the pivot axle the right side of the elongate platform will be forced in a downward direction against the counteracting force of the force transmitting device 26, to thereby provide a smooth downward movement of the right side of the platform.

Figure 9:
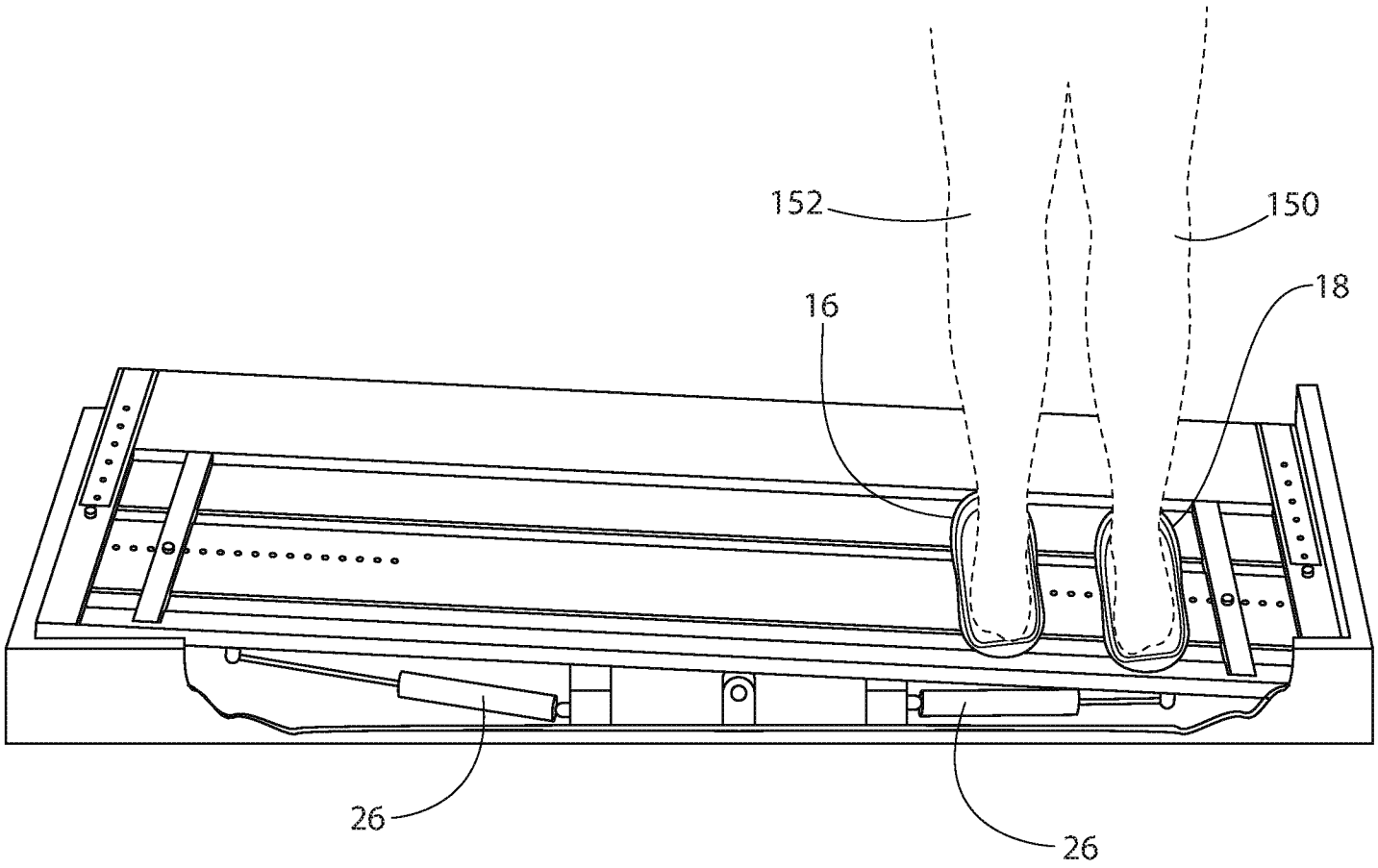

As seen in FIG. 9, the right leg 152 of the user is brought closely adjacent to the left leg of the user at the end of the longitudinal traverse from the left end of the platform to the right end of the platform, as viewed from a position facing the front of the exerciser. The exercise then is repeated, but with the exerciser moving in the opposite transverse direction, and with the left leg 150 of the user constituting the trailing leg required to provide the uphill pushing force to permit the user to slide to the left of the elongate platform to thereby complete one cycle of the sliding exercise.

It should be understood that a unique feature in accordance with one aspect of this invention is the provision of an elongate platform 12 having a longitudinal dimension and a pair of foot support members 16, 18 slidably mounted to the platform to permit these members to reciprocate between the opposed ends of the platform and thereby cause the platform to reciprocate in alternating up and down movements about a reciprocating mount for the platform.

The present invention, as described above, provides unique frontal exercise of the lower torso of an exerciser along with substantial endurance training. This combination of muscle and endurance training is believed to be far superior to other frontal exercise devices, such as reciprocating abductor/adductor machines in which the upper body remains stationary as the user's legs are moved about his/her hip joints, and the low friction, stationary horizontal slide provided by Reebok as described earlier in this application.

Figure 12:
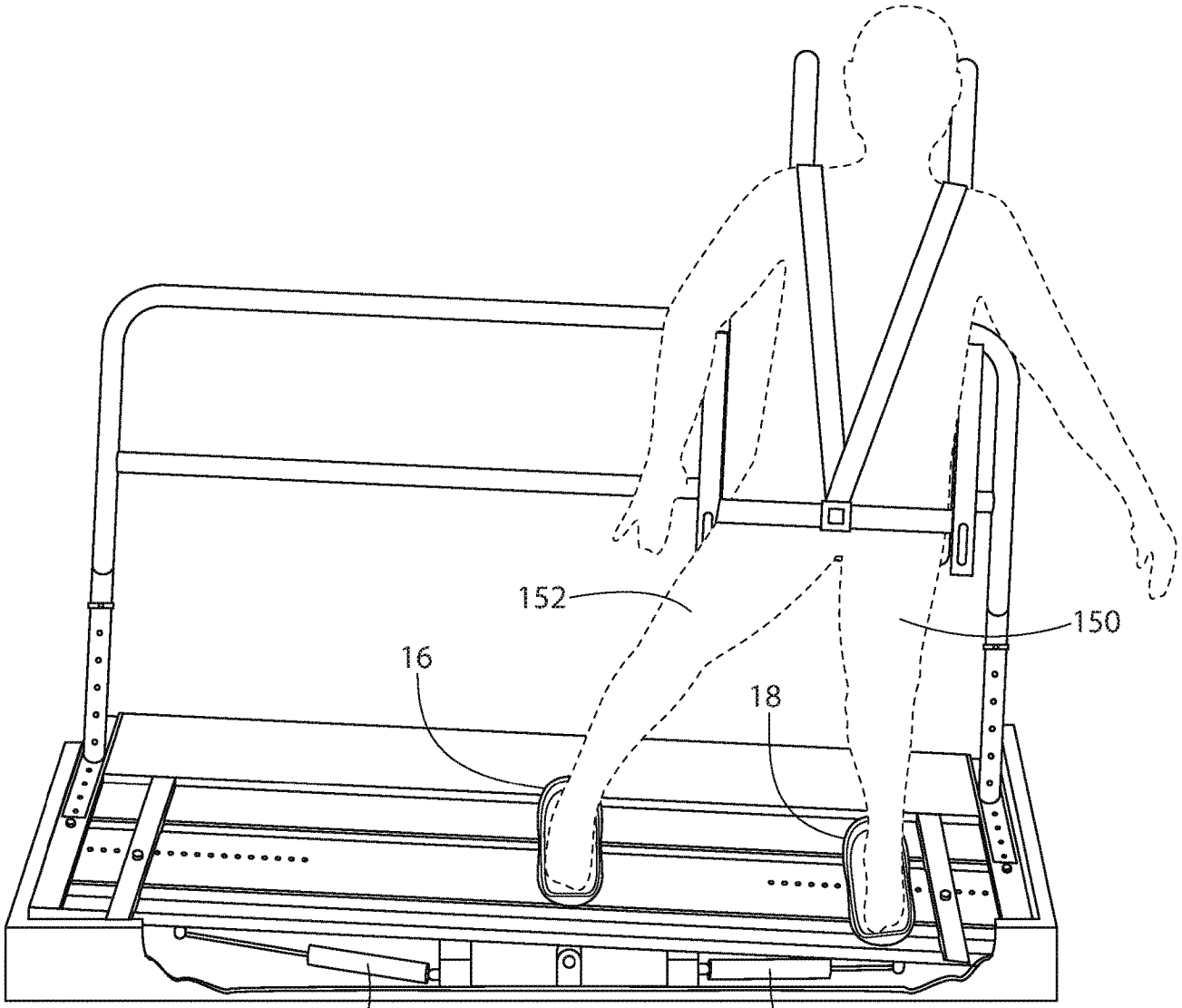
FIG. 12 is an isometric view of an individual supported in an upright position by a back support member and with the individual's lower torso generally in the same position as illustrated in FIG. 8.

Referring to FIG. 12, a schematic front elevational view of the exercise device 10 is shown to depict the entire torso of the exerciser when in a position as illustrated as FIG. 8. As can be seen in FIG. 12 the exerciser is strapped to the back support, which is slid all the way to the right as the exerciser completes one longitudinal traverse of the elongate platform, as is shown in FIGS. 8 and 9.

Figure 10:
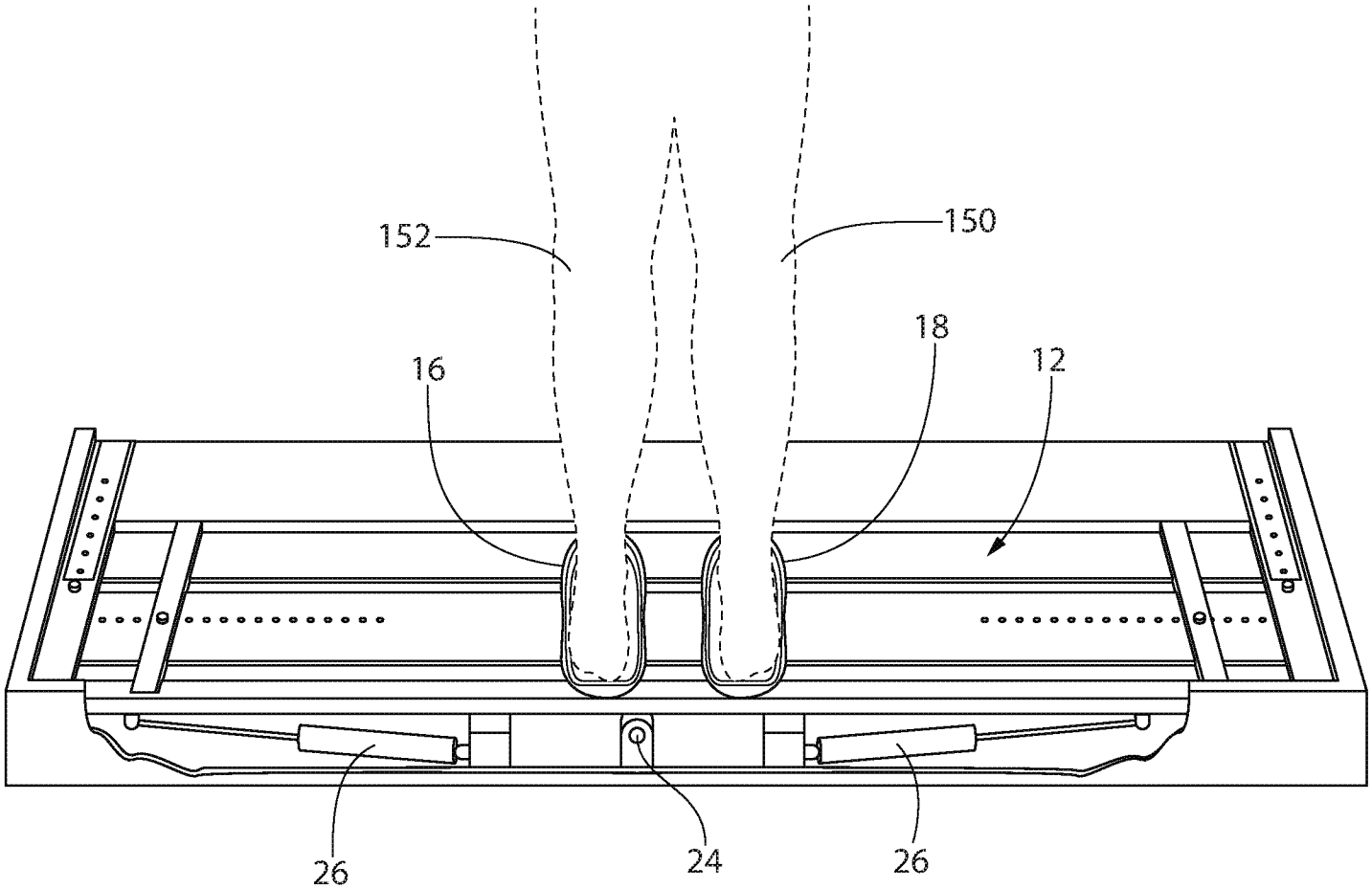
FIGS. 10 and 11 are isometric views illustrating the movement of an exerciser's legs in accordance with a different exercise mode.
Figure 11:
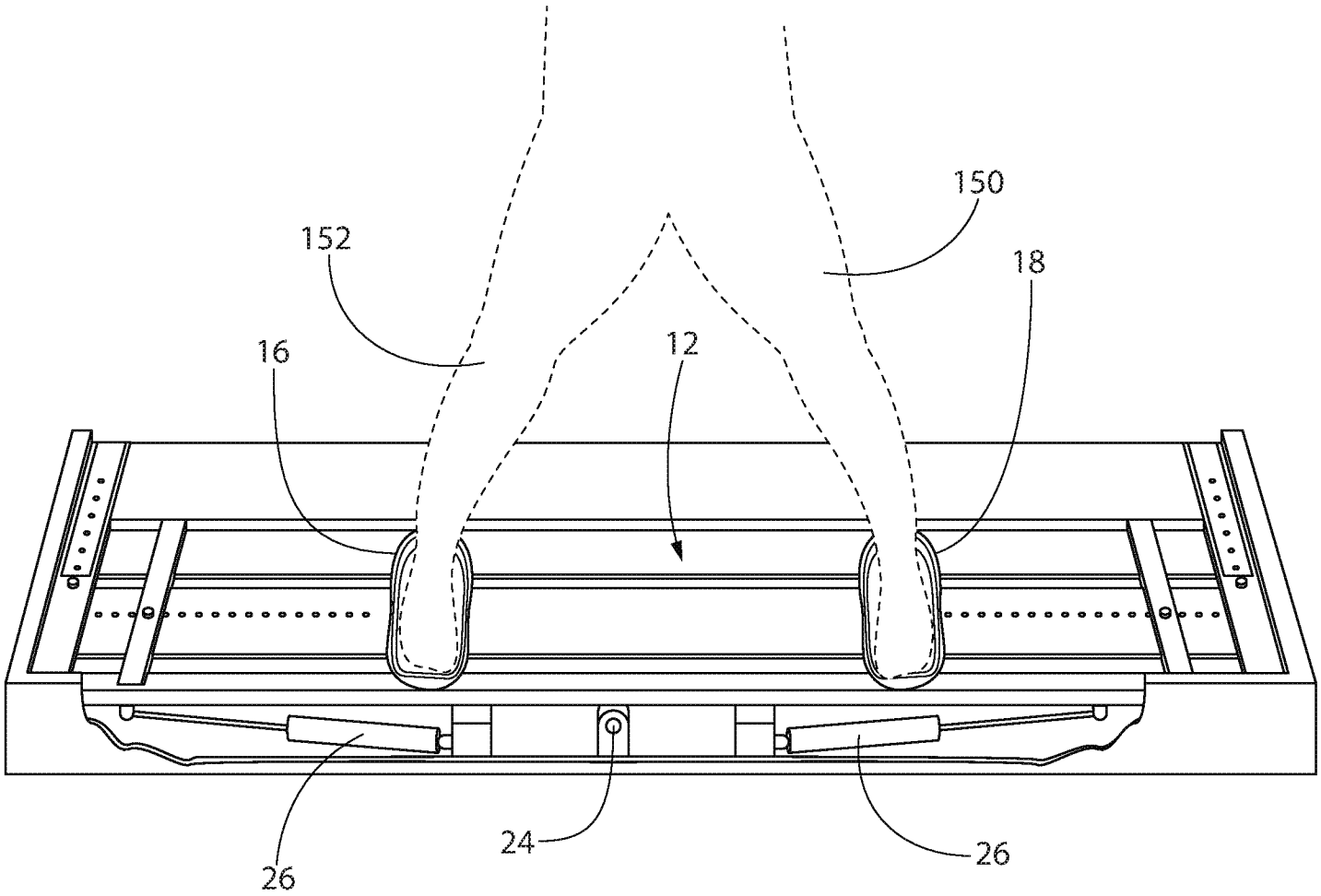

Referring to FIGS. 10 and 11, an alternate exercise is illustrated wherein the exerciser places his/her left and right legs 150, 152 in cooperating foot support members 18, 16, respectively, that are positioned substantially over the pivot axle 24. Starting from this position the exerciser can then spread both legs 150, 152 to cause each of the foot support members 16 and 18 to move outwardly from the pivot axle as shown in FIG. 11. Thereafter the legs can be brought back together to thereby provide a frontal exercise for the lower torso of the exerciser. The fact that the elongate platform 12 is pivotally mounted requires the exerciser to employ his/her core muscles to provide a stabilizing function during the exercise.

Figure 13:
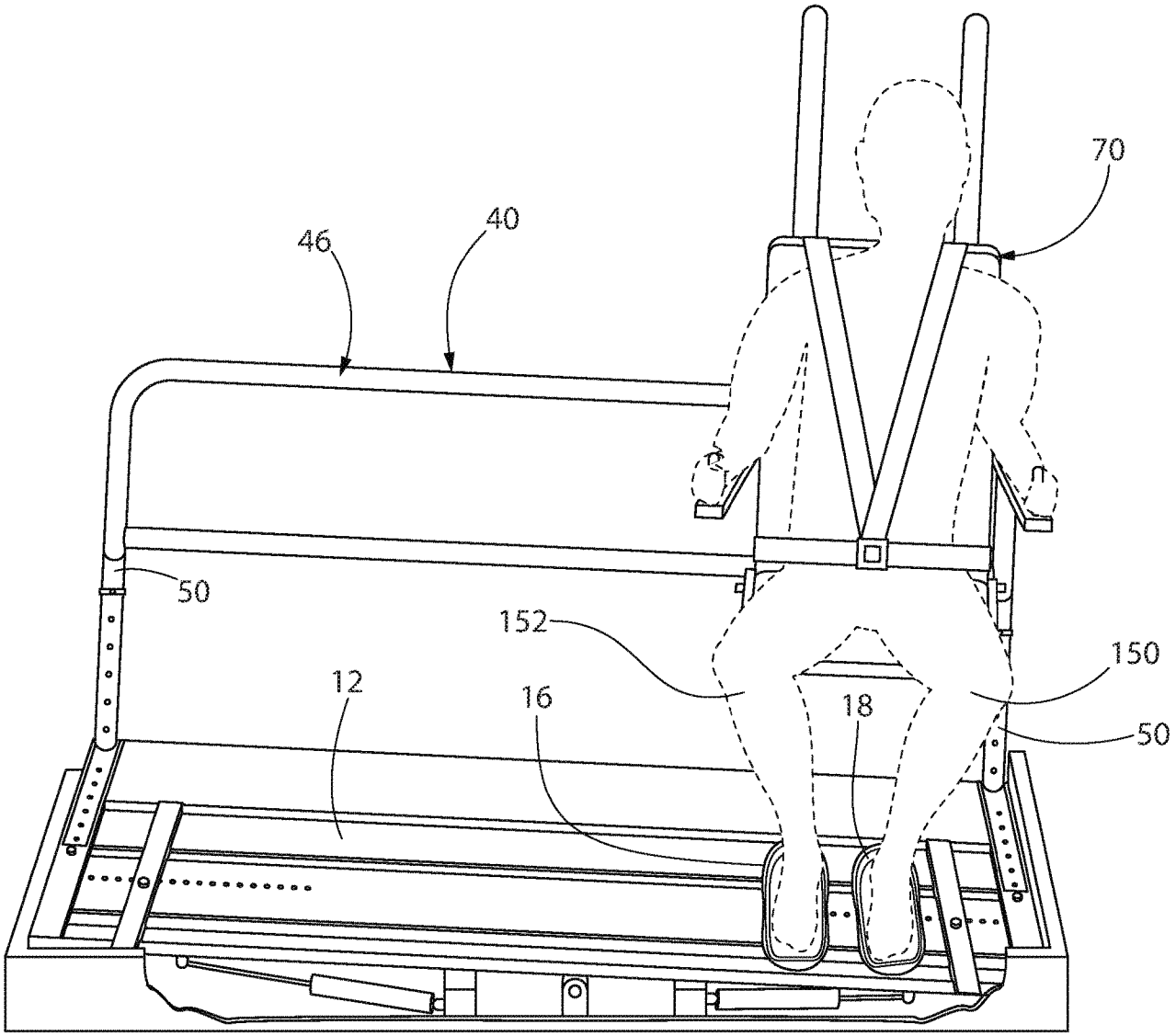
FIG. 13 is an isometric view illustrating an exercise arrangement wherein an individual is in a seated position while pushing himself/herself along the elongate extent of the platform.

Referring to FIG. 13, a fragmentary front elevational view is shown with an exerciser seated on the body support member 70 and with the body support member in the lowest vertical position on its supporting guides. If it is necessary and/or desired to locate the exerciser at a higher elevation, the inverted U-shape upper frame section 46 of the upwardly directed support 40 can be extended out of the lower leg sections 50, 52 a desired distance to thereby raise the body support member relative to the pivotal elongate platform 12.

As briefly discussed earlier, an alternative arrangement for providing a reciprocating movement of the elongate platform 12 is by mounting opposed ends thereof to rotary members 30, 31, which permits the rotational movement of the rotary members to control reciprocating movement of the elongate platform 12. In this manner, when the exerciser traverses the platform to the left, as illustrated in FIGS. 5-9, the upper end of the platform will be caused to move to a downward position illustrated in FIG. 14 as the rotating member 30 rotates in the direction of arrow 160, and the opposed end of the platform will move to an upward position as the rotary member 31 moves in the direction indicated by arrow 162. Opposite sliding movement will cause rotation of rotary members 30 and 31 in the opposite directions, and a corresponding downward movement of the end of the platform that previously was in a raised position and upward movement of the opposite end of the platform that previously was in a downward position. This completes one exercise cycle.

In a more preferred and simpler arrangement, reciprocating movement of the platform is achieved by employing an arcuate rocking support for the platform, as will be discussed in greater detail with respect to the embodiment of the invention shown in FIGS. 30A-C and FIG. 31.

In accordance with this invention, the reciprocating platform 12 can be designed so that it maintains a desired upward inclination until an exerciser, with his/her feet attached to the foot support members 16, 18 actually completes sliding movement to each of the upward distal ends of the platform. At that location a release mechanism can be triggered to then permit the reciprocation of the platform 12 to a position where the end of the platform occupied by the exerciser moves from its upper position to a downward position and the opposed end of the platform moves from its downward position to an upward position. At that point the exercise can be repeated with the exerciser sliding from the lower distal end of the platform to the opposed upper distal end, and, at the end of that traverse, triggering a release mechanism to permit the upper distal end of the platform to again move in a downward direction.

Figure 15:
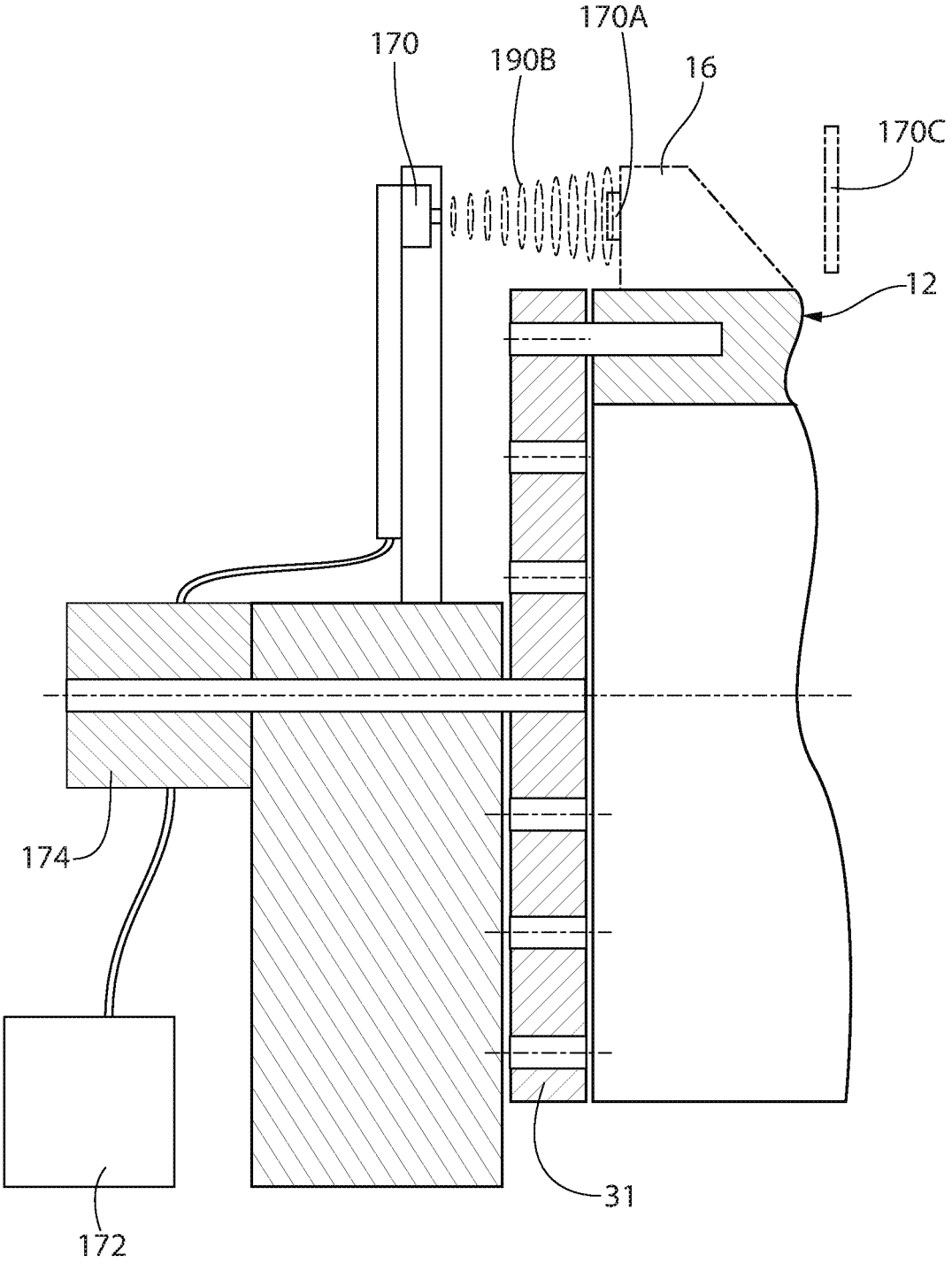
FIG. 15 is a sectional view along line 15-15 of FIG. 14, showing a system for controlling reciprocating movement of the elongate platform.

Any suitable arrangement can be provided to prevent the elongate platform 12 from reciprocating from one position to another until an exerciser reaches a desired position at the upper distal end of the platform. However, by way of illustration only, a representative mechanism is shown in FIG. 15 for maintaining, respectively, each end of the elongate platform 12 in an upwardly inclined position until an exerciser moves to a desired, upwardly inclined position on the platform, and then permitting the release of the platform to permit the upward end of the platform to move to a downward position and the downward end of the platform to move to an upward position. Although any number of detection mechanisms (both wired and wireless) can be used to detect the presence of the foot support member 16 at the desired, upwardly inclined position, the most preferred detection is via a non-contact sensor. For example, a proximity sensor (e.g., the E2E-2DC series proximity sensor) or a capacitive sensor (e.g., E2K-C series capacitive proximity sensor) can be used to detect the presence of the foot support member 16 when it is opposite a sensor 170. A corresponding reflective surface 170A can be secured to a portion of the foot support member 16 to enhance a return signal or disturb an electromagnetic field 170B emanating from the sensor 170. Alternatively, the sensor 170 may be an optical sensor (e.g. Avago APD S-9130 optical sensor) that is configured to receive a return optical signal 170B when the surface 170A is positioned accordingly. Alternatively, the optical sensor can be configured to emit a signal that is obstructed from reaching a detector or reflector 170C when the foot support member 16 arrives at the desired, upwardly inclined position. In any of these configurations, once the sensor 170 detects the presence of the foot support member 16, the sensor 170 generates a signal that is sent to a program logic controller (PLC) 172 for operating a magnetic clutch 174 in a well-known manner to release rotatable member 31 to permit its rotational movement causing the upper distal end of the elongate platform to move to a down position, and the corresponding downward distal end to move to an up position. This same control system is employed at the opposite distal end of the platform 12 to cause the opposed upwardly directed distal end of the platform to reciprocate to a downward position when one of the foot support members 18 is detected by a sensor (not shown) at the opposed end. The control system at each end of the platform 12 can be of an identical construction.

In accordance with this invention other arrangements, both mechanical and electrical, can be employed to control the reciprocating movement of the elongate platform 12 when an exerciser reaches predetermined locations or positions on the platform.

Figure 18A:
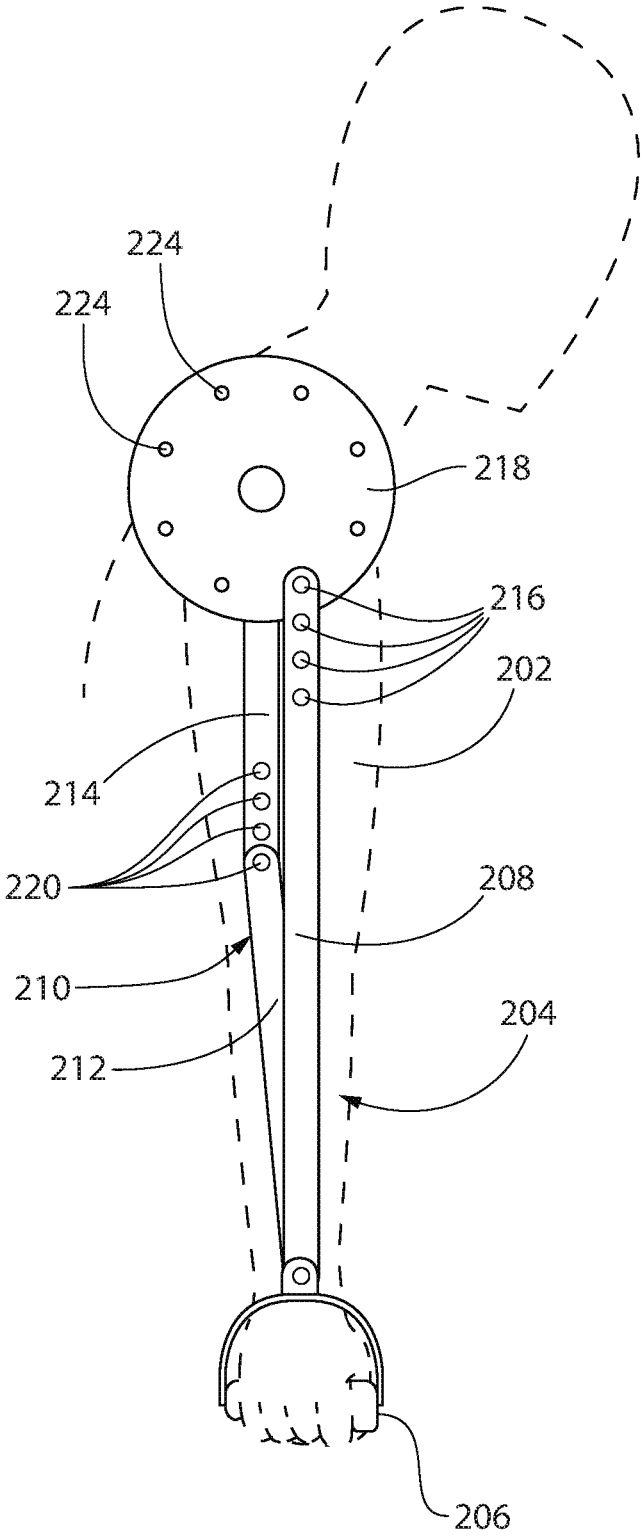
FIGS. 18A-18B illustrates the upper body exercise device of FIGS. 14 and 15, but oriented in a further alternate position for carrying out an upper body exercise.
Figure 18B:
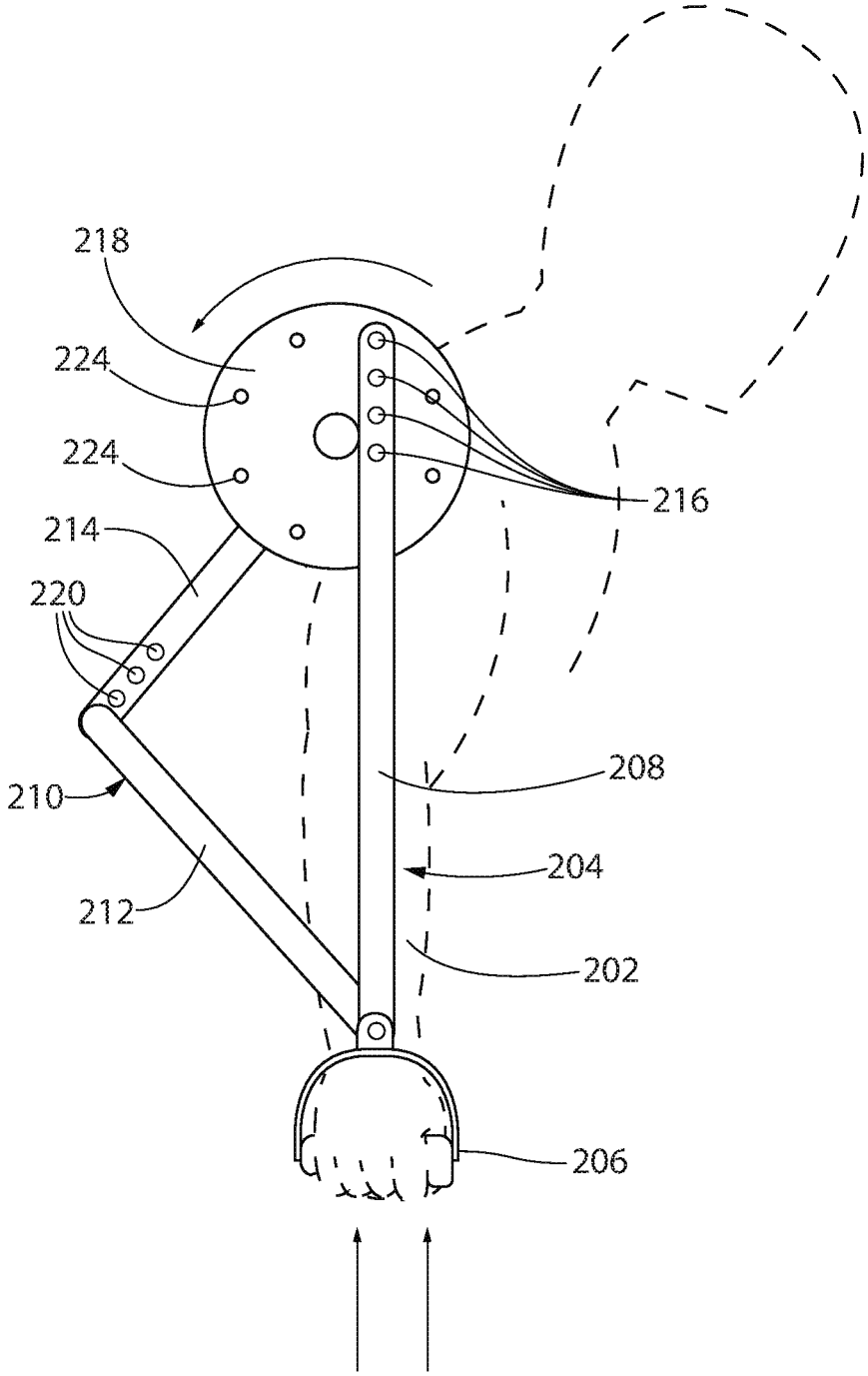
Figure 19:
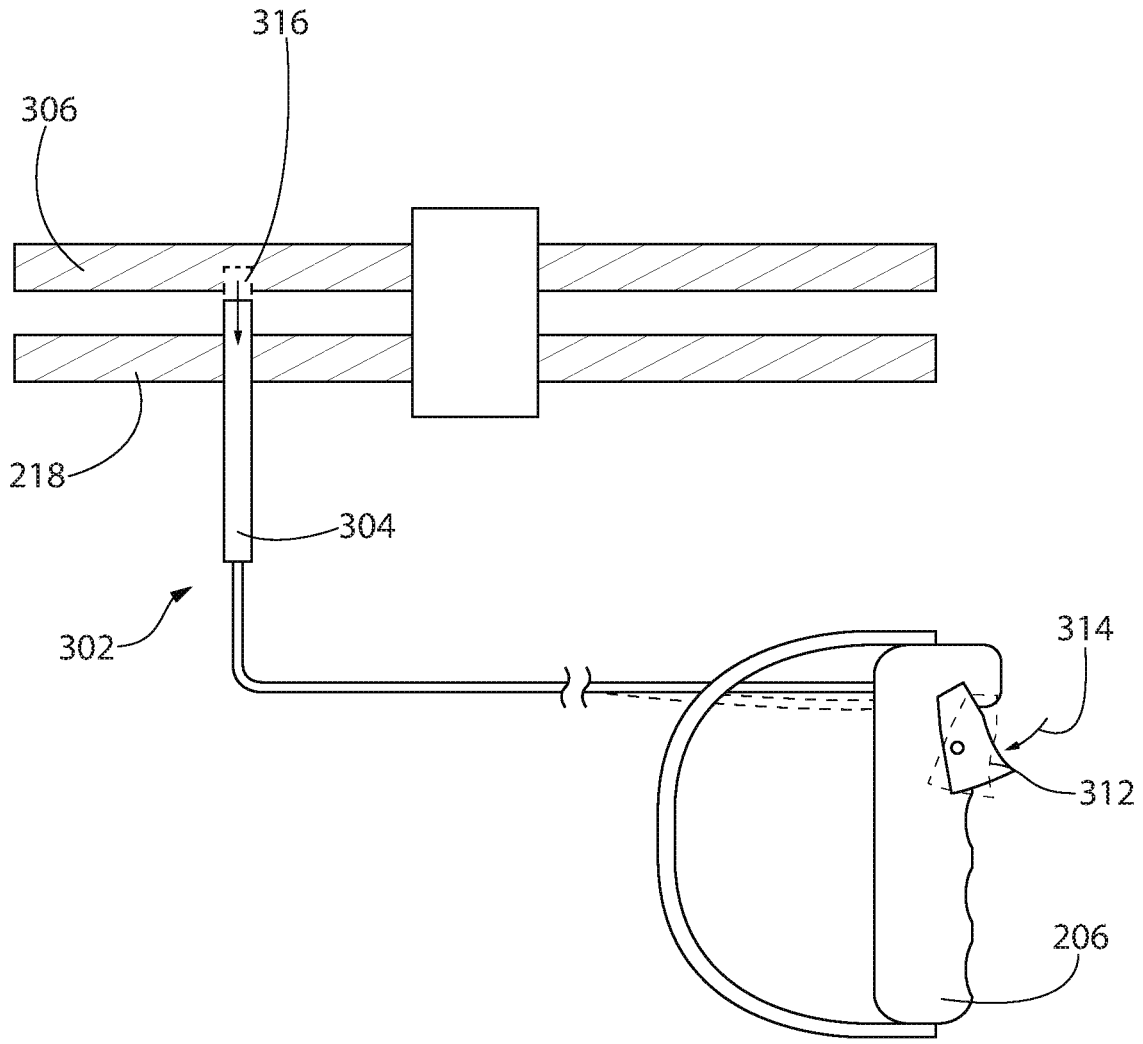
FIG. 19 is a schematic view illustrating the operation of a clutch mechanism for disengaging the upper body exercise device from the drive mechanism that transmits reciprocating movement of the arm supports to sliding movement of the upper body support member.
Figure 20:
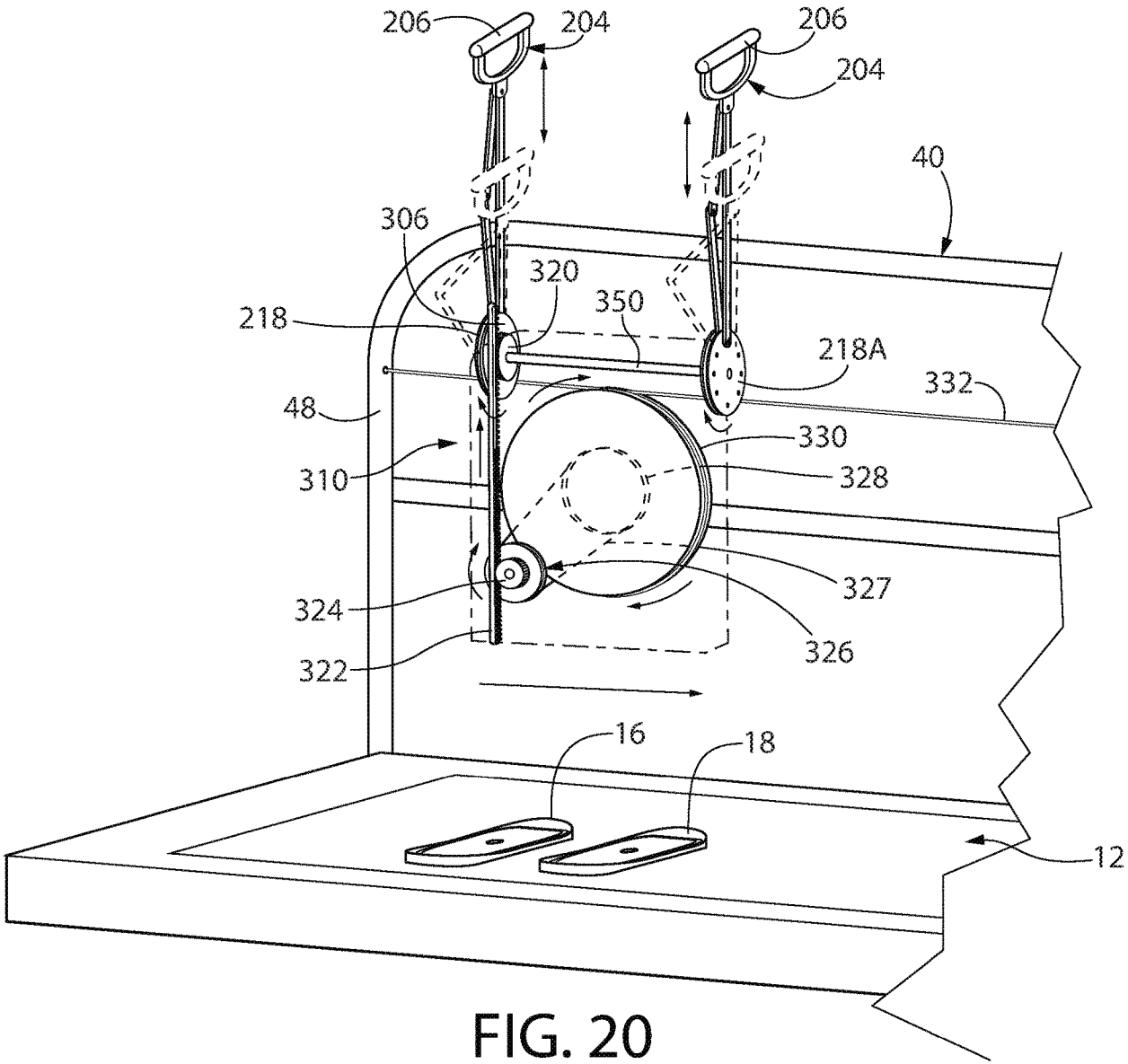
FIG. 20 is a schematic isometric view showing the drive arrangement for transmitting alternating, reciprocating movement of the hand supports of an upper body exercise system to linear, reciprocating movement of an upper body support in a direction parallel to the elongate dimension of the slide platform.

Referring to FIGS. 16-20, a further unique embodiment of this invention employs an upper body exercise device 200 for exercising the upper body at the same time that an exerciser is exercising his/her lower torso through sliding movement on the reciprocating platform 12, as described earlier herein. In accordance with this aspect of the invention, movement of the body support member 70, 120 is synchronized with movement of upper body exercise device 200 so that carrying out an upper body exercise functions to move the body support member to which the exerciser is retained. Specifically, in a preferred embodiment, to be described in detail hereinafter, movement of the arms in opposite directions during an upper body exercise moves the body support member in opposite longitudinal directions, respectively, with the movement of the arms in each of the directions being opposed by a force acting in a direction opposed to that of the arm movement. For ease of reference details of only one of the hand engaging exercise members 204 is illustrated in FIGS. 16-18. However, general features of both of the hand engaging exercise members 204 are shown in FIG. 20.

The opposing force, that is the force in a direction opposite to that of arm movement, is created in part by the sliding movement of an exerciser in an uphill direction along the elongate platform 12 during movement of the arms in each of the opposed directions during an exercise, as will be explained in greater detail hereinafter. In other words, the uphill, longitudinal movement of the exerciser during linear reciprocating movement in each direction provides a force in a direction opposed to the direction of movement of hand engaging members 204 of the upper body exercise device 200.

Referring to FIGS. 16 (A and B) through 18 (A and B) the upper body exercise devices are in the form of arm exercise devices of identical construction, Therefore, details of construction of only one of the arm exercise devices will be described herein, it being understood that the opposed exercise device is of the same construction.

Figure 16A:
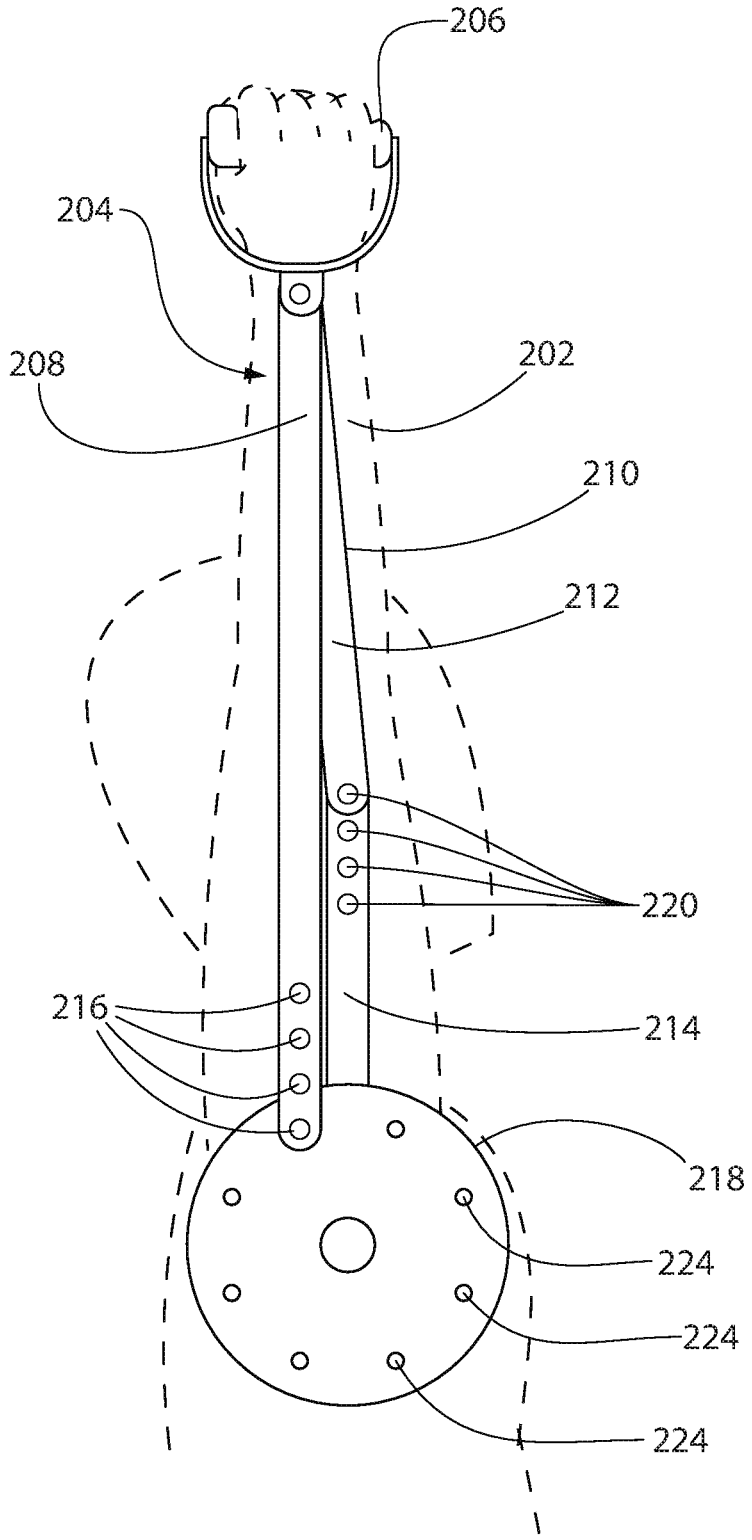
FIGS. 16A and 16B illustrates an upper body exercise device for engagement by a user's hands to provide a reciprocating exercise; said reciprocating motions providing for synchronized sliding movement in opposed directions along an elongate platform.
Figure 16B:
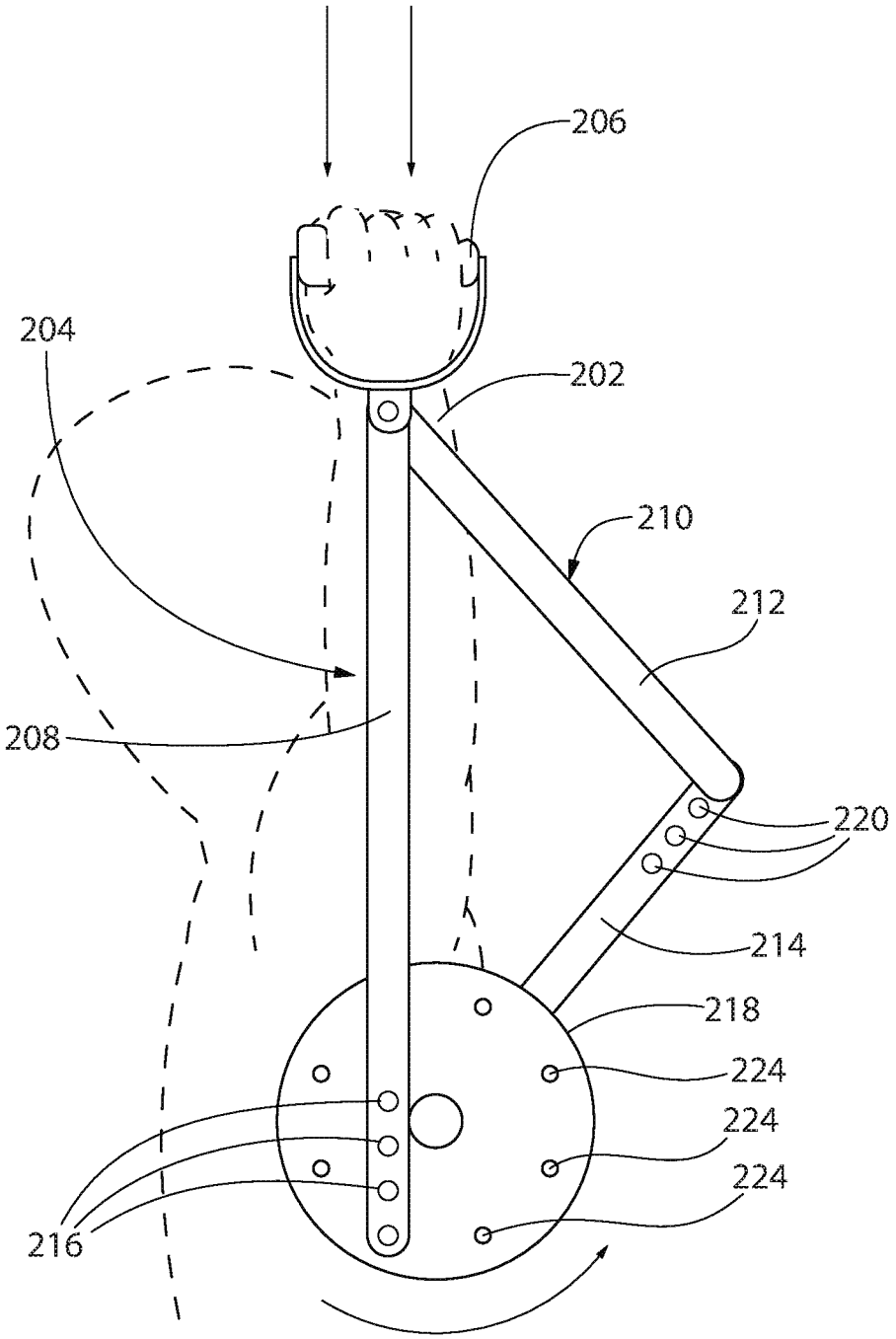

Referring to FIGS. 16A and 16B, the upper body exercise device includes a pair of hand engaging members 204 (only one being illustrated—however both are illustrated in FIG. 20). The hand engaging members 204 include a hand grip 206 attached to both a rigid link 208 and an articulating linkage system 210. The articulating linkage system 210 includes a first link member 212 attached at one end to the hand engaging member 206 and pivotally connected at the opposite end to one end of a second link member 214. The opposite end of the second link member 214 is freely mounted about rotational axle of drive disk 218 so that movement of the rotational axle does not affect movement of the second link member 214, as will be discussed in greater detail hereinafter.

As can be seen if FIGS. 16A and 16B the rigid link 208 has a plurality of spaced-apart passages 216 to permit the link to be connected to rotatable disk 218 through a desired passage in the link; depending upon the desire or required length of the hand engaging members 204 to be used by an exerciser. The first and second link members 212, 214 of the articulating linkage system 210 likewise include a provision for adjusting its length in the form of a plurality of adjustment passages 220 in the second link member 214. This permits adjustment of the articulating linkage system 210 to match the adjustment of the rigid link 208. In this manner the length of the hand engaging members 204 can be adjusted to accommodate differences in arm length among different exercisers.

FIGS. 16A and 16B illustrate the position of the hand engaging members 204 at the end of an upward movement and in an intermediate or lower position resulting from a downward movement of the hand engaging members, respectively. As will be explained in detail hereinafter with respect to FIG. 20, the upward and downward movement of the hand engaging members 24 each are opposed by a force in the opposite direction that is created in part by the exerciser moving in an uphill direction on the reciprocating, elongate platform 12 during each of the reciprocating strokes of the hand engaging members 204.

Figure 17A:
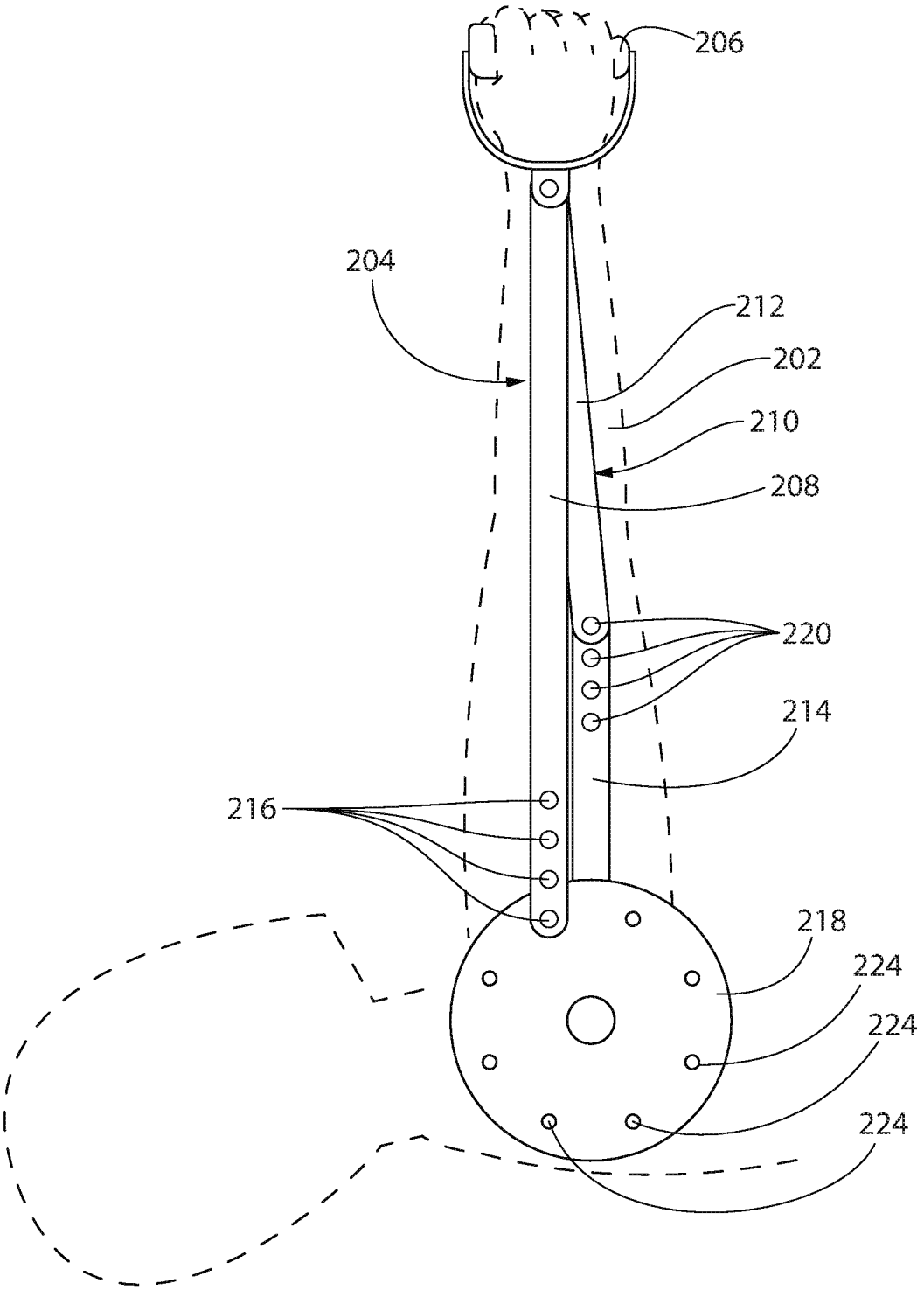
FIGS. 17A-17B illustrates the upper body exercise device of FIGS. 14A-14B, but oriented in an alternate position for carrying out an upper body exercise.
Figure 17B:
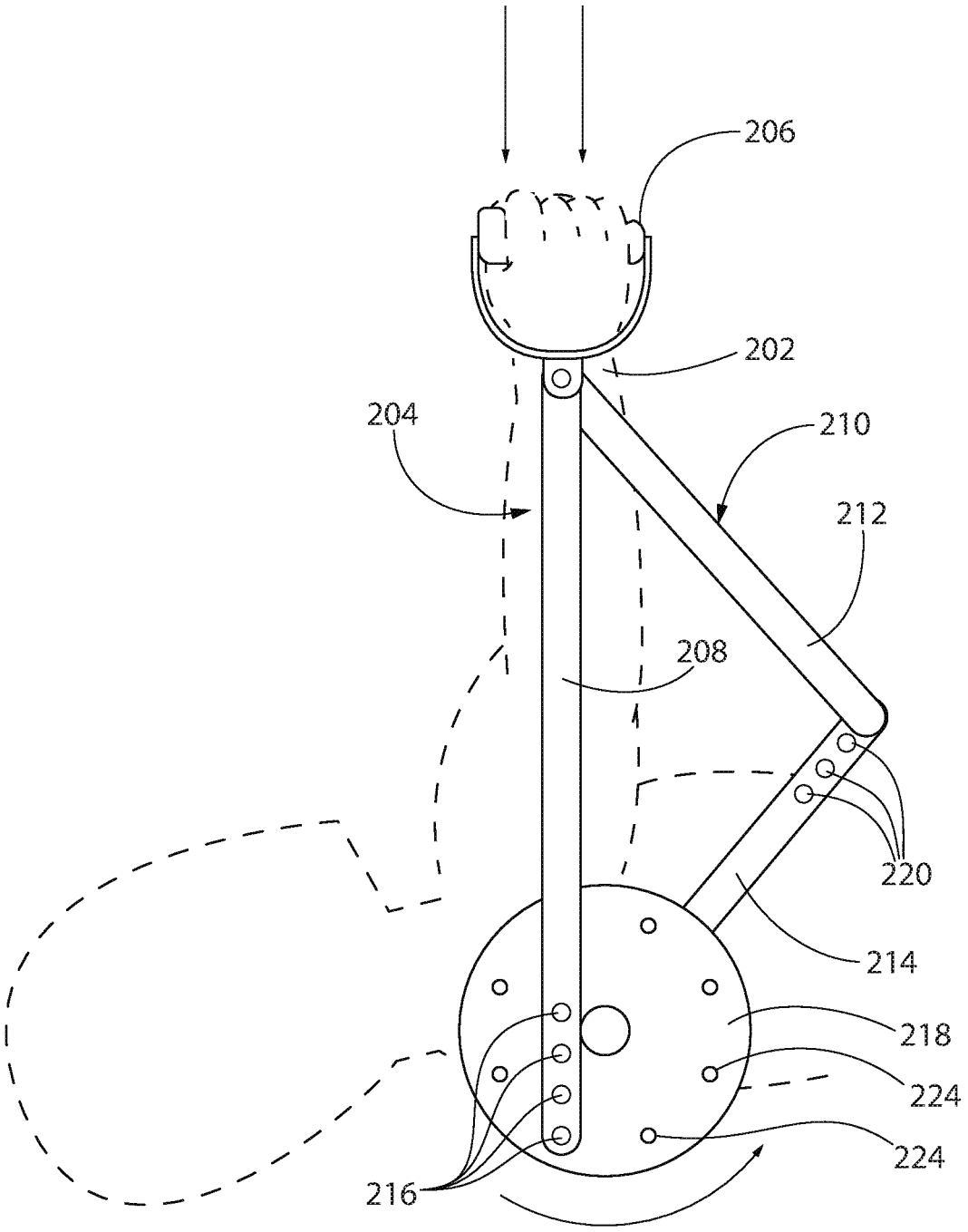

FIGS. 17A and 17B illustrate the hand engaging members 204 being attached in a position on the rotatable disk to permit a pushing and pulling exercise with the hands in a different position than that shown in FIGS. 16A and 16B.

FIGS. 18A and 18B illustrate the hand engaging members 204 being attached in still another position on the rotatable disk 218 to permit a pushing and pulling exercise with the hands in a different position than that shown in FIGS. 16A and B and 17A and B, respectively.

It should be apparent that the ability to position the hand engaging members 204 in a number of different positions is made possible by providing a number of different circumferentially spaced-apart passages 224 in the rotatable disk 218.

A significant feature in the most preferred embodiments of this invention is that in all positions of the hand engaging members 204 movement in each of the opposed directions is resisted, or opposed by a force in the opposite direction created in part by the uphill movement of an exerciser on the platform 12 during each of the opposed movements of the hand engaging members 204.

Although the preferred construction of the hand engaging members 204 includes an articulating linkage system for stability and control, in accordance with the broadest aspects of this invention such an articulating linkage system may not be required.

Moreover, it is within the scope of this invention to employ a ball and socket connection system to permit universal movement of the hand engaging members relative to the user's body as opposed to the linear movement permitted by the connection illustrated in the drawings. For example a socket member may be connected to each disk 218 in a desired circumferential position on the disk, and a ball forming a proximal end of each of the hand engaging members 204 may be secured for universal movement within a corresponding socket member.

Referring to FIGS. 19 and 20, a drive system for synchronizing movement of the hand engaging members 204 with the sliding movement of an exerciser on an elongate, pivotally mounted platform 12 will be described. In addition, the manner of disengaging the hand engaging members 204 from the system also will be described. By being able to disengage the hand engaging members 204 form the system an exerciser can engage solely in a sliding exercise on the pivotally mounted platform 12 without the use of the upper body exercise system, in the same manner as described earlier in connection with the exercise devices that did not include an upper body exercise system as part of their construction. However, this can be achieved while the upper body is being supported on the exercise device.

Referring to FIG. 19, a clutch mechanism 302 includes a drive-engaging pin 304 moveable within a passage of the rotatable disk 218 to either engage or disengage from a gear 306 of a driven gear system 310 (FIG. 20). The driven gear system 310 controls movement of the body support member 70, 120 in opposite longitudinal directions along the upwardly directed support 40 during opposed movement of the hand exercise devices 204.

As can be seen in FIG. 19 a trigger 312 connected to hand grip 206 of one of the hand engaging members 204 can be moved in the direction indicated by arrow 314 to disengage the drive-engagement pin 304 from gear 306 of the driven gear system 310. In the preferred embodiment, the drive-engaging pin 304 normally is maintained, or biased into engagement with a pin receiving slot 316 in driven gear 306 of the driven gear system 310. Thus, unless the trigger 312 is actuated, as described above, movement of the upper body exercise system will be synchronized with the movement of the body support system 70, 120 longitudinally along the upwardly directed support 40.

Referring to FIG. 20, driven gear 306 of driven gear system 310 includes a pinion gear 320 connected to the driven gear for rotatable movement with the driven gear. The pinion gear 320 is in driving engagement with a rack 322, whereby rotational movement of the pinion gear in one direction during movement of the hand engaging members 204 in one direction moves the rack in one linear direction, and movement of the pinion gear in the opposite rotational direction during movement of the hand engaging members in a direction opposed to said one direction moves the rack in the opposite linear direction.

Rack 322 is further connected to a driven pinion 324 forming part of a pulley 326, whereby movement of the rack in opposite linear directions rotates the driven pinion and its connected pulley in opposed rotational directions, respective. Pulley 326 is connected through a belt drive 327 to a driven pulley 328 that in turn is connected to, and rotationally drives a larger pulley 300 in opposite directions corresponding to changes in rotational direction of the pulley 326 and driven pulley 328. The driven pulley 328 and larger pulley 330 are retained within a housing 340 that is connected to the body support member 70, 120 and the housing 340 is mounted for linear movement on rails 104 forming part of the upwardly extending frame 40, as described earlier. (FIGS. 3C and 20). As noted above the larger pulley 330 is connected to body support member 70, 120 through housing 340 and includes a drive belt 332 about the periphery thereof. Opposed ends of the drive belt 332 are attached to spaced-apart leg sections 48 (only one being shown in FIG. 20). Thus, rotation of the larger pulley 330 in each rotational direction moves the body support member 70, 120 in one linear direction as a result of the connection of the pulley to the vertical leg sections of the upper frame by the drive belt 332.

The relationship of the diameter of the driven pulley 328 to the larger pulley 330 is selected so that rotation of the driven pulley in each rotational direction will cause the body support member 70, 120 to which the larger pulley is attached through housing 340 to traverse the desired longitudinal distance along the pivotal platform 12 to provide the desired sliding exercise.

Still referring to FIG. 20, a rotational force transmitting axle, schematically shown at 350, is connected to rotate with gear 306 to transmit that rotational movement to disk 218A to which the second hand exercise device 204 is connected. The connecting axle 350 for transmitting rotational movement to disk 218A preferably is rearwardly offset from the central axis of the disks 218, 218A to permit an exerciser to position his/her shoulders between the disks without interference from the axle. It is well known to those skilled in the art to mount the axle 350 rearwardly of the central axis of the disks 218, 218A while still being capable of transmitting a rotational driving force between those disks.

The structural arrangement of both exercise devices 204 can be identical and can be mounted and adjusted on the disks 218, 218A in the same manner. Moreover the disks 218, 218A can be of an identical construction. Preferably the force transmitting axle 350 is longitudinally adjustable along its elongate extent to permit adjustment of the span between the disks 218, 218A, and a corresponding adjustment of the span between the hand exercise devices 204. This is desirable to permit adjustment of the span based upon the size of the exerciser.

It should be understood that the driven system 310 can be varied. The important feature is that the system be capable of transmitting movement of hand actuating members to movement of a body support member. Other pulley and gear arrangements can be employed to provide such motion.

For example, pulley 326, the pinion 324 connected thereto, and the driven belt 327 can be replaced with a different pulley and belt arrangement for transmitting movement of hand actuating members 204 to the enlarged pulley 330, and accordingly to the body support member to which the enlarged pulley 330 is attached. Specifically, a pulley similar to pulley 326 can be directly mounted on rotational axle 350 substantially midway between the hand actuating members 204 to rotate with said axle when the clutch is engaged. A driven belt similar to belt 327 can be in driving engagement with the pulley on the axle 350 to be driven by rotation of the axle. The driven belt can be twisted in substantially the configuration of a FIG. 8 to provide a lower circular portion for engaging the periphery of driven pulley 328 to thereby transmit rotational movement of the pulley attached to the axle 350 to rotational movement of the driven pulley 328 and the large pulley 330 connected thereto.

As can be seen in FIG. 20, the elongate, pivotal platform 12 and shoe retaining members 16, 18 are shown somewhat schematically but are of the construction disclosed in detail earlier in this application.

Referring to FIGS. 21-29 an exercise device 500 in accordance with this invention for use by an exerciser in a seated position is illustrated. Certain features employed in the exercise device 500 may be more preferred than corresponding features employed in the earlier described embodiments. For example, the construction of the arm exercise members 502 employed in the device 500 is more preferred than the construction of the exercise arms illustrated in FIGS. 16 (A and B) through FIGS. 18 (A and B). Moreover, any of the constructions of the arm exercise members, as well as other constructions, can be employed in connection with the preferred embodiment of this invention shown in FIGS. 30A-C and 31.

Figure 21A:
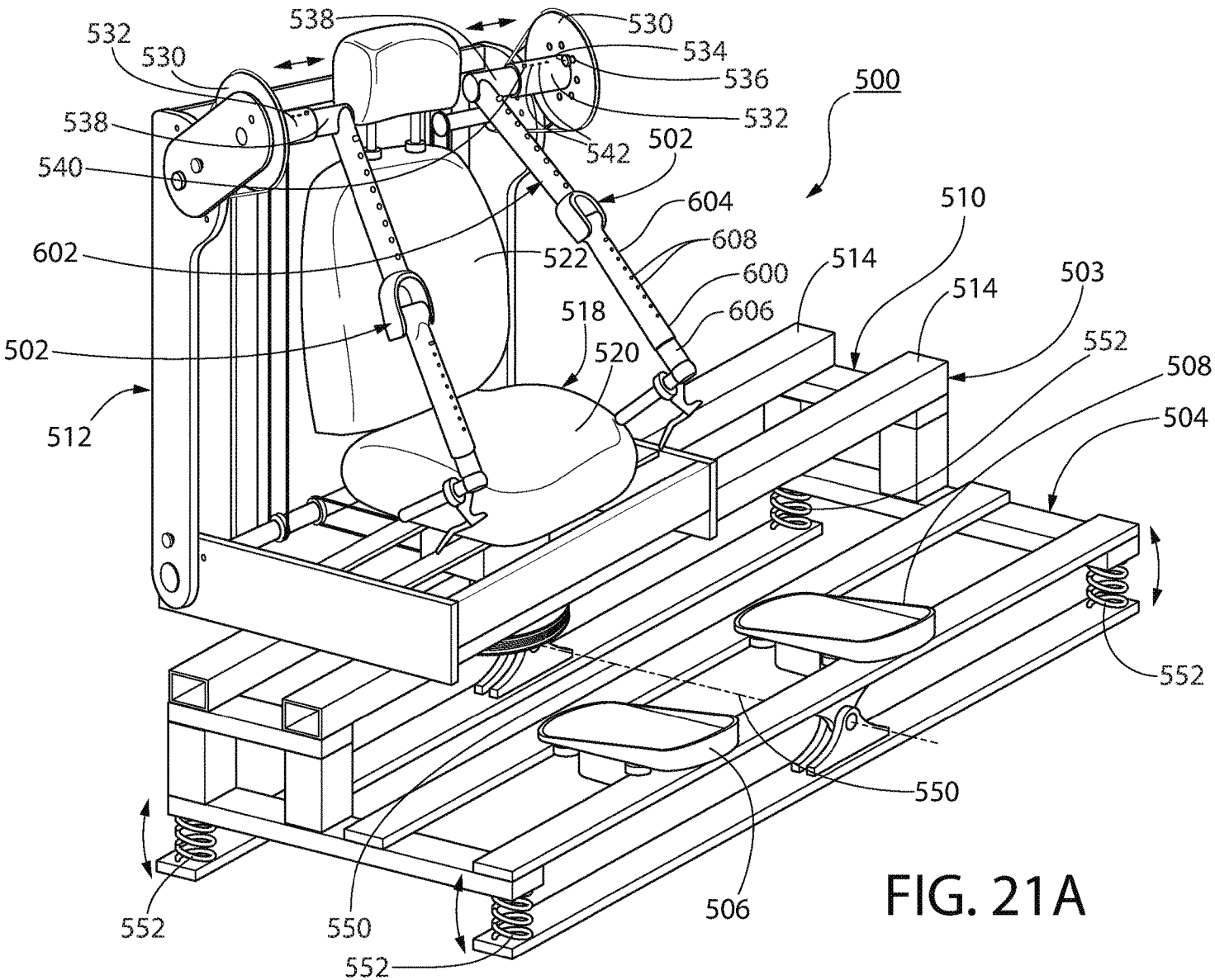
FIGS. 21A-21B show a preferred embodiment of an exercise device for supporting an an exerciser in a seated position, and showing exercise arms in different, transversely-spaced adjusted positions to accommodate exercisers' having different widths.
Figure 21B:
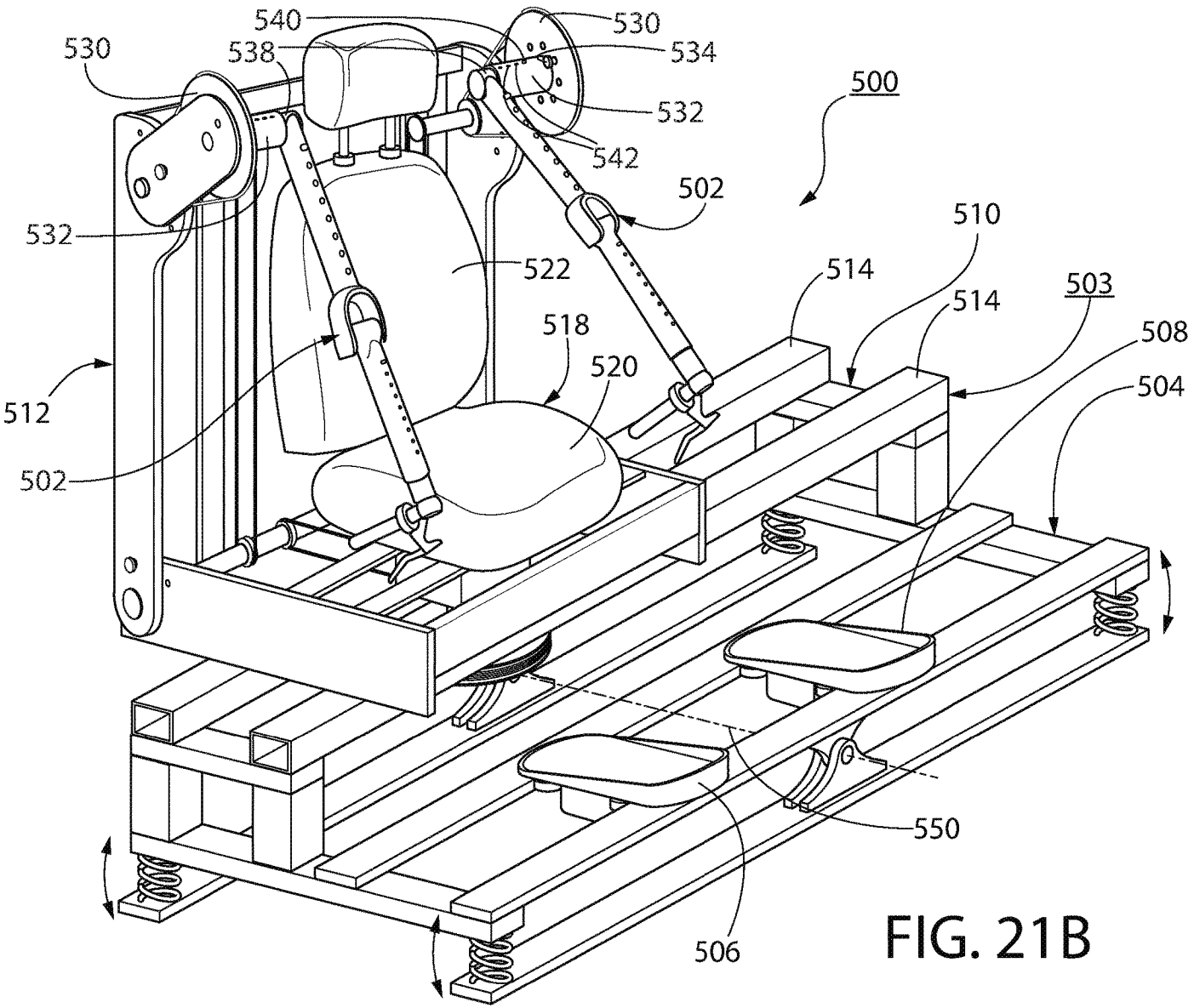

Turning to FIGS. 21A and 21B an exercise device 500 for supporting an exerciser in a seated position includes a platform 503 including an elongate, front platform section 504 and a rear platform section 510 formed as a unit. The front platform section 504 includes foot supports 506, 508 slidably supported thereon. The manner of slidably supporting the foot supports 506, 508 on the front platform section 504 does not constitute a limitation on the broadest aspects of this invention. Any conventional mounting system can be employed, including the mounting arrangement provided in the earlier described embodiments of the invention, and also provided in the preferred embodiment illustrated in FIG. 32 and discussed in detail later in this application.

Still referring to FIGS. 21A and 21B, the rear platform section 510 extends vertically above the front platform section 504 and, as noted earlier, is part of the same unit as the front platform section to move as a single unit. The rear platform section 510 supports a seat mounting section 512 slidably mounted on rails 514 of the rear platform section. The mounting section 512 mounts a seating piece 518; preferably in the form of a chair including a horizontal seat 520 and a backrest 522. The chair 518 preferably is mounted for both transverse and vertical movement/adjustment on the mounting section 512 to permit the proper adjustment of the chair relative to other components of the exercise device, e.g., the front platform section 504 and the arm exercise members 502, to accommodate exercisers of different sizes, as will be explained in greater detail hereinafter.

The chair 518 can be of a conventional design similar to a car seat and can be mounted for both linear and vertical movement by mechanisms similar to, or the same as those provided for a car seat. The specific adjustment mechanisms employed to adjust both the transverse and vertical position of the chair do not constitute a limitation on the present invention. Individuals skilled in the art clearly will be able to design and employ a variety of different seat adjustment mechanisms to permit the desired adjustment of the chair 518 on its mounting section 512. However, a further explanation of the adjustments provided in this invention will be discussed in greater detail hereinafter in conjunction with FIGS. 26 (A and B) and 28 (A and B).

A very desirable feature of this invention is to provide for transverse, linear adjustment of the arm exercise members 502 to accommodate exercisers of different upper body widths. FIGS. 21A and 21B show the spaced apart exercise members 502 in two different, transversely spaced-apart positions.

The arrangement for permitting the transverse adjustment of the arm exercise members 502 is the same for both members and therefore the description that follows sometimes will be limited to the adjustment arrangement from only one of the exercise members 502.

As can be seen in FIGS. 21A and 21B a rotary, rotationally mounted drive member or disk 530 is provided for each of the arm exercise members 502. As will be explained in greater detail hereinafter, when the rotationally mounted drive members 530 are rotationally connected to the arm exercise members 502, the rotationally mounted drive members either are rotationally driven by the sliding movement of the seat mounting section 512 on the rear platform section 510, or alternatively the arm exercise members 502 can be employed to directly rotate the drive members 530. This provides synchronized movement of the arm exercise members 502 and the seating piece 518.

Figure 27A:
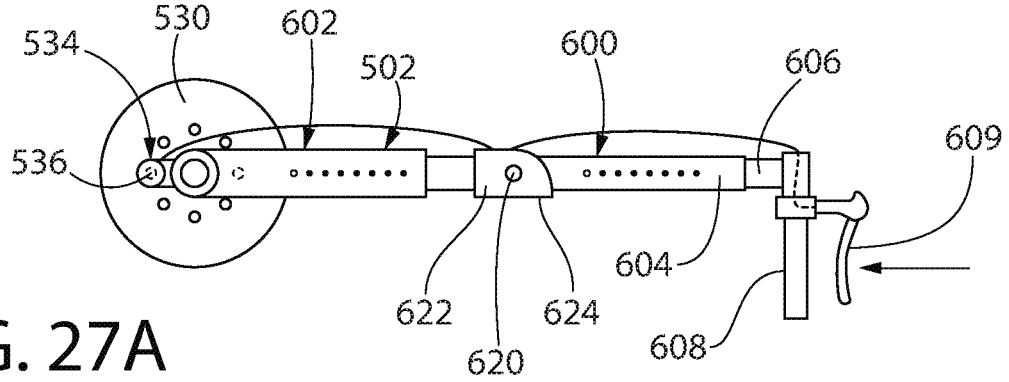
FIGS. 27A-27C schematically illustrate the ability to adjust the rotational orientation of the exercise arms relative to the rotational member supporting the arms.
Figure 27B:
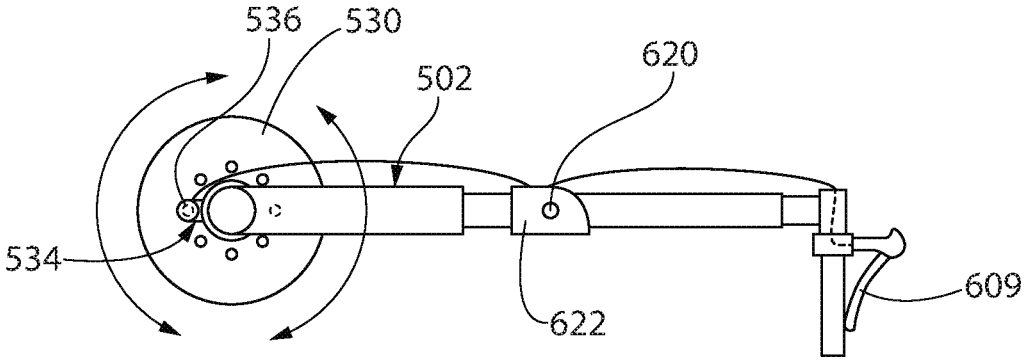
Figure 27C:
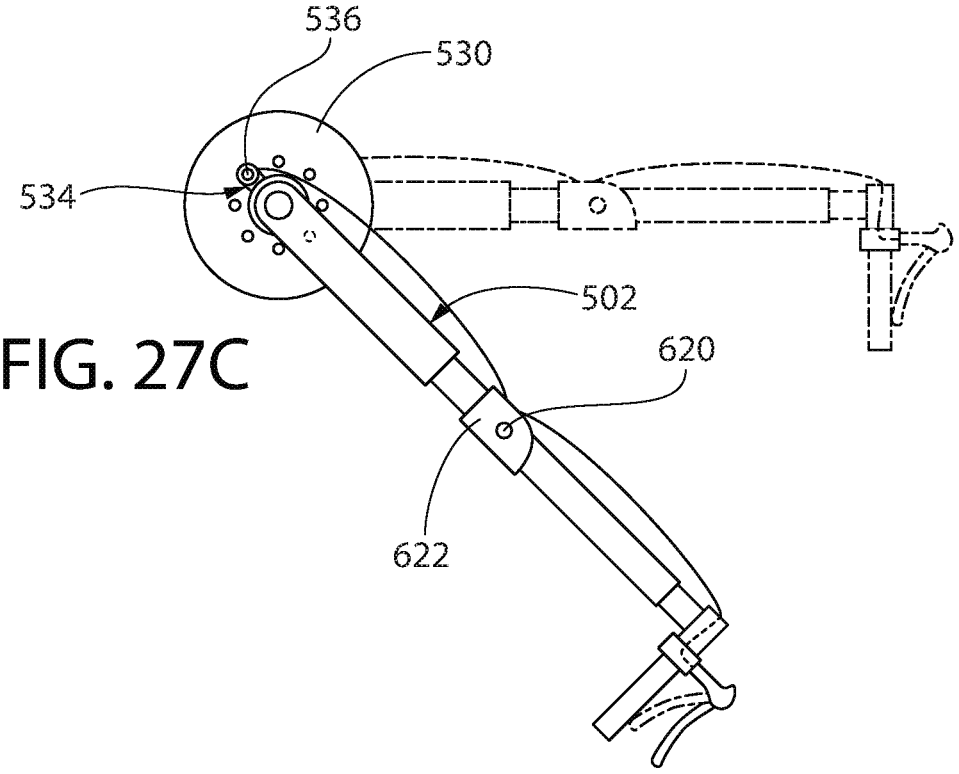

As can be seen in FIGS. 21A and B and FIGS. 27A-C, a cylindrical sleeve 532 is removable secured to each of the drive members 530 by a clutch mechanism 534, attached thereto. In a non-limiting exemplary embodiment the axial length of the cylindrical sleeve can be on the order of one foot.

Referring to FIGS. 27A-27C when the clutch mechanism 534 is operated to position a clutch pin 536 thereof in one of the circumferentially spaced apart openings in the drive member 530 the sleeve 532 is rotatably connected to the drive member 530.

Numerous arrangements can be employed to provide the rotational connection between the cylindrical sleeve 532 and the drive member 530. In the illustrated embodiment, if the pin 536 of the clutch mechanism 534 is not retained within one of the circumferentially spaced apart openings in the drive member 530 then the drive member 530 and cylindrical sleeve 532 will not rotate together since they won't be connected. This permits the cylindrical sleeve 532 to be disengaged from the drive member 530 when it is desired to de-activate, or not use the arm exercise members 502 during a desired exercise. However, in such an arrangement a mechanism would need to be provided to retain the cylindrical sleeve 532 in proper orientation with respect to the drive member 530 when said cylindrical sleeve is disconnected from the drive member.

One way of achieving this desired orientation between the cylindrical sleeve 532 and drive member 530 is to fixedly secure each of the arm exercise members 502 to a part of the frame of the device. However, numerous other ways can be provided to retain each cylindrical sleeve 532 in proper alignment with the drive member 530 when the sleeve is disconnected from rotating as a unit with the drive member 530. For example, a ball-bearing connection system might be usable to couple each of the cylindrical sleeves 532 to a cooperating drive member 530 for independent rotational movement relative to said cooperating drive member when a clutch for rotational connecting the said cylindrical sleeve to its cooperating drive member is disengaged.

If desired an arrangement similar to that shown in FIG. 19 herein can be employed for selectively establishing synchronized rotational movement of each of the arm exercise members 502 with the sliding movement of the seating piece 518, or selectively disengaging the drive elements that provide such synchronized rotational movement.

Figure 29C:
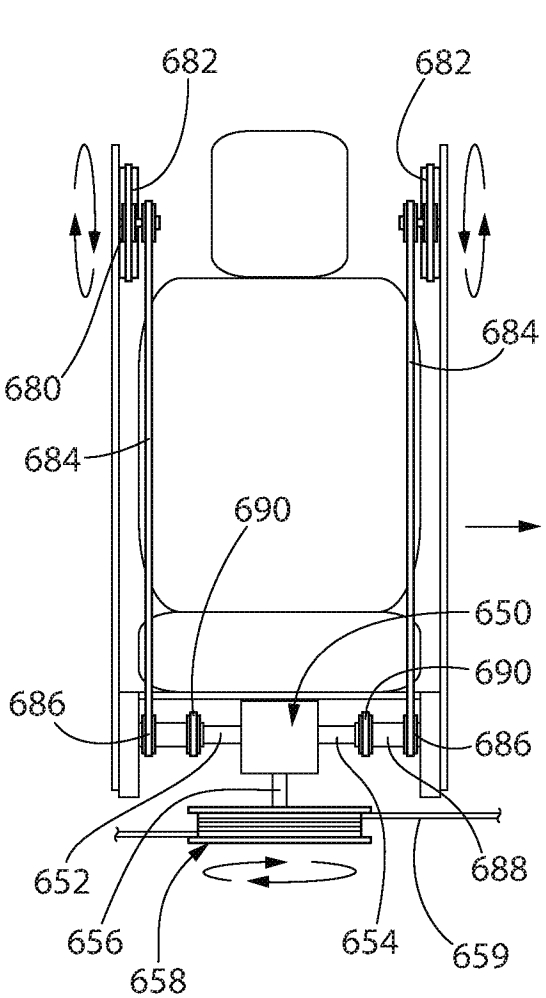
FIGS. 29B-29C are schematic rear elevational views illustrating the operation of the drive system for synchronizing movement of the exercise arms with sliding movement of the foot supports along the reciprocating platform in opposed directions, respectively, the operation of the drive system in FIG. 29B being the same as is illustrated in FIG. 28A.
Figure 29B:
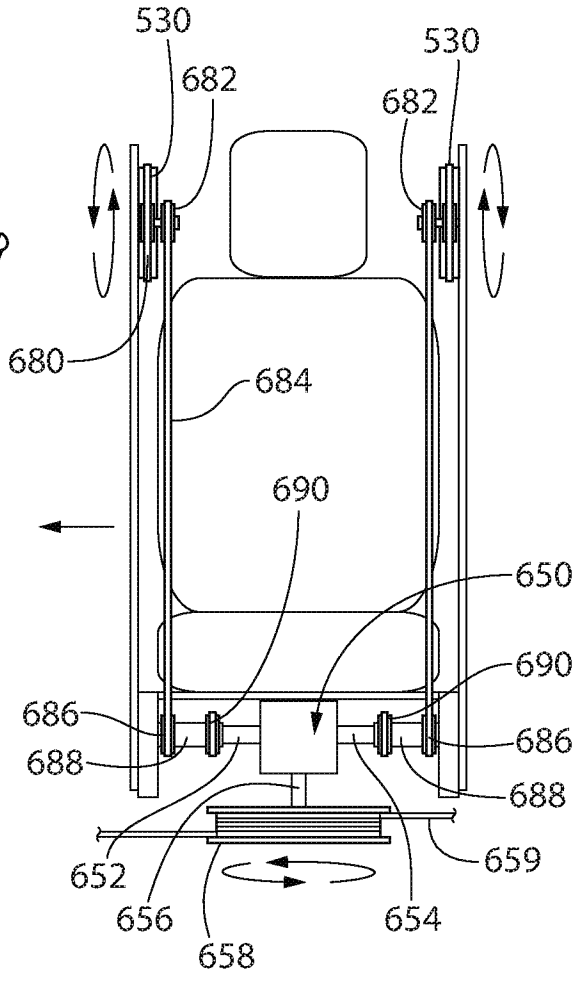
Figure 29A:
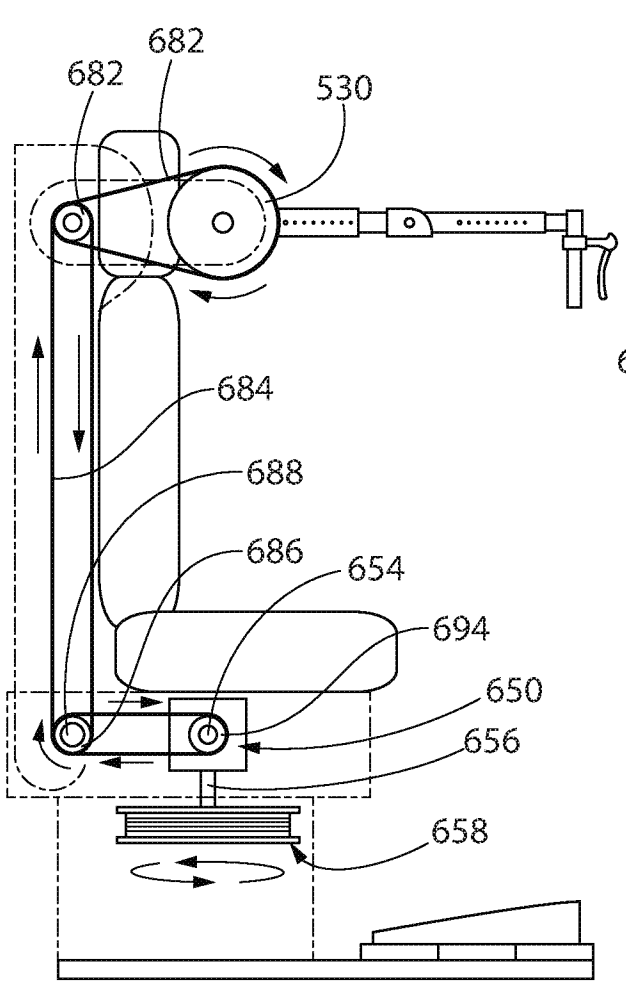
FIG. 29A is a schematic side elevational view of the exercise device of FIGS. 21A-21B illustrating the operation of the drive system for synchronizing movement of the exercise arms with sliding movement of the foot supports in one direction along the reciprocating platform.

A another arrangement for achieving independent movement of the seating piece 518 relative to the drive members 530 is to provide a setting for a gear box 650, to be described in detail with respect to FIGS. 29A-C, which prevents the transmission of rotational movement to the drive members when the seating piece is being slideably moved to provide a lower body exercise.

With this arrangement clutch pins can always be maintained in engagement with the drive members 530 to support the cylindrical sleeves 532 on the drive members even when it is desired to permit lower torso exercise without an upper body exercise, by an exerciser sliding on the seating piece 518 in a reciprocating manner.

The particular manner of providing a selective connection system for engaging and disengaging each arm exercising member 502 from an adjacent drive member 530 when desired does not constitute a limitation on the broadest aspects of this invention; it being understood that numerous ways of achieving such a selective connection can be easily determined by individuals skilled in the art and having the information provided herein.

Still referring to FIGS. 21A and 21B, the proximal end of each of the arm exercise members 502 is welded or otherwise permanently secured to a cooperating shaft 538 that is telescopically adjustable within a cooperating cylindrical sleeve 532 in desired, fixed distances within the sleeve by the automatic engagement of an outwardly biased spring loaded ball or pin member 540 provided in each shaft 538 within one of a series of linear spaced-apart openings 542 in the cooperating cylindrical sleeve 532. This is a well-known manner of providing adjustability and does not require any further explanation.

In an exemplary, non-limiting embodiment the shafts 538 to which the arm exercise members 502 are permanently attached are each on the order of one foot in length and the minimum width or distance between the opposed arm exercise members 502 on opposite sides of the seating piece 518 is established with about 4 inches of each shaft 538 within the confines of a central passage in a cooperating cylindrical sleeve 532. This arrangement is illustrated in FIG. 21A.

To increase the spacing between the opposed exercise members 502 on each side of the seating piece 518, each of the shafts 538 is moved into further telescoping engagement within the central passage of a corresponding cylindrical sleeve 532. In the exemplary embodiment discussed above, each of the arm exercise members 502 can be moved up to approximately 7-8 inches outwardly from an adjacent side of the seating piece 518 by telescoping substantially the entire one-foot length of each shaft 538 within the central passage of its cooperating cylindrical sleeve 532. This arrangement is illustrated in FIG. 21B. Thus the degree of adjustment of the spacing between the arm exercise members 502 in the exemplary embodiment is approximately in the range of 14-16 inches from the closest to the farthest separation. That is 7-8 inches of each of the shafts 538 carrying an arm exercise member 502 either can be extended outwardly from, or moved into an end of its cooperating cylindrical sleeve 532.

Figure 25B:
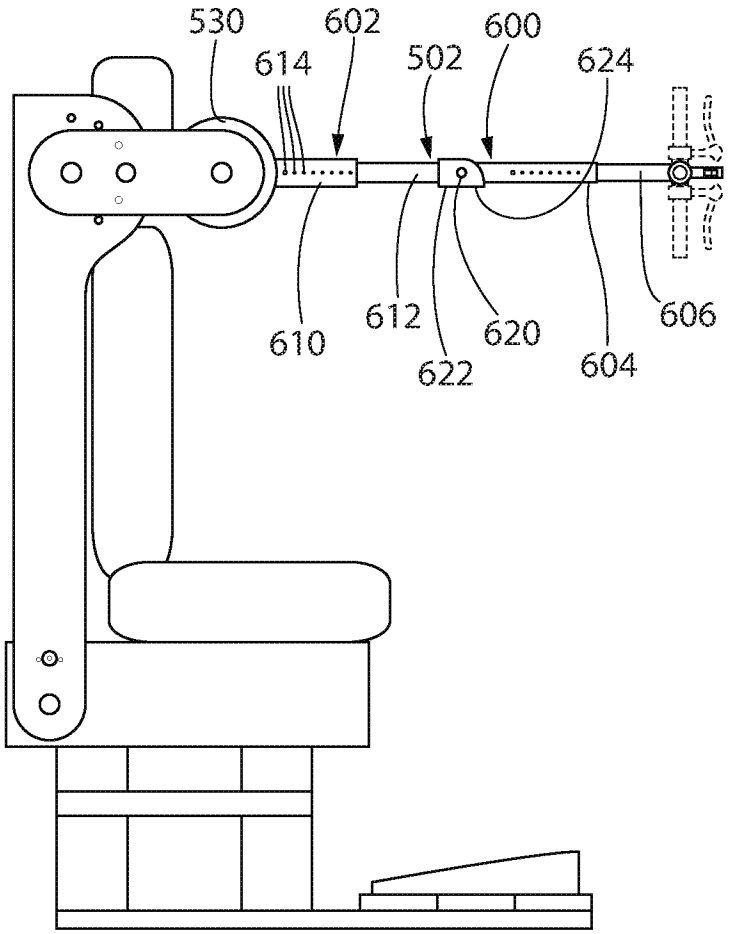
FIGS. 25A-25B are schematic side elevational views similar to FIGS. 22A and 22B showing both the linear and rotational adjustability of the exercise arms.
Figure 25A:
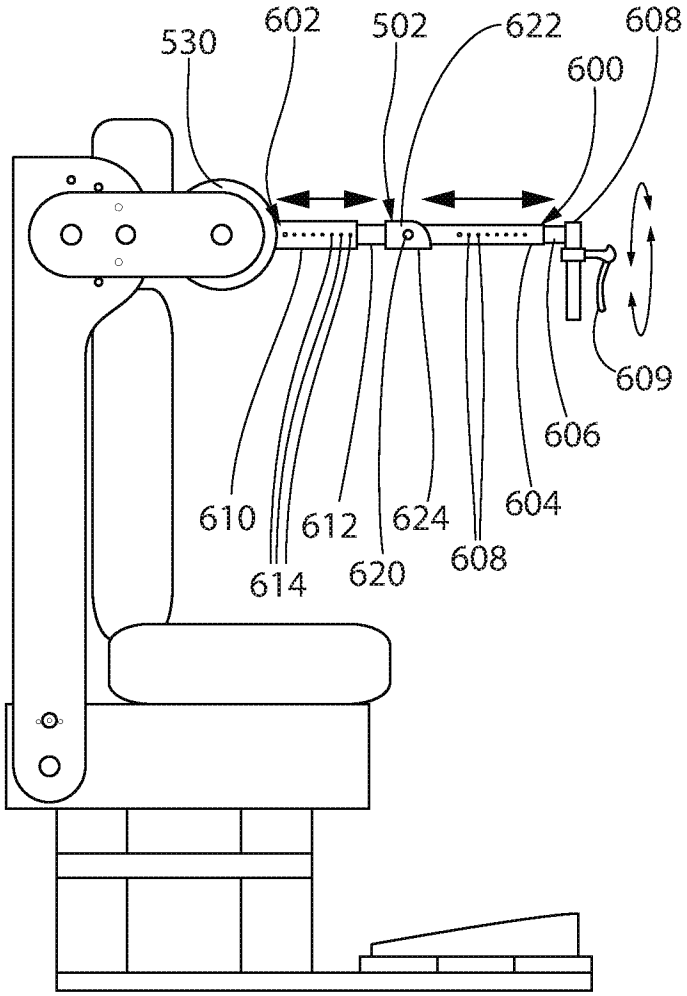

Turning now to FIGS. 21A and B and FIGS. 25A and B, a preferred construction of each of the arm exercise members 502 is shown; it being understood that a variety of different arrangements can be employed in accordance with the broadest aspects of this invention. Reference throughout this discussion to FIGS. 21 and 25 is intended to include 21A and B, and 25 A and B, respectively, unless indicated otherwise.

As can be seen in FIGS. 21A and B, the platform 503 is pivotally mounted about a pivot axle schematically indicated at 550. This pivot axle can be vertically adjusted to adjust the reciprocating angle of the platform. The manner of vertically adjusting the pivot axle does not constitute a limitation on the broadest aspects of this invention and can be of any conventional design. For example, pneumatic or manual adjustment mechanisms can be provided, e.g., a linkage design of the type included in many car jacks can be used. As can be seen, compression springs 552 are provided at the four peripheral edges of the platform 503 to aid in smoothing out the rocking action of the platform as it is being reciprocated by providing a retarding force opposing the rocking action. These springs 552 are intended to provide the same function as the force transmitting devices 26 employed in the embodiment of the invention disclosed in FIG. 1A. If desired, a similar arrangement of cylinders may be usable in the exercise device 500 or any other arrangement can be employed for accomplishing the desired action.

As can be seen in FIGS. 21, 25, and 27A-C each of the arm exercise members 502 includes a forearm section 600 and an arm section 602, each of which is adjustable in a manner to be described in detail hereinafter. The forearm section 600 includes telescoping members 604, 606. Member 604 is a hollow, cylindrical sleeve including a plurality of linearly spaced apart openings 608 through a wall thereof to permit linear adjustment of the forearm section into a number of different lengths. Telescoping member 606 is a shaft member including a spring loaded locking ball or pin, which is designed to spring into a desired opening 608 when aligned therewith. This is a conventional manner of providing for linear adjustability and does not require any further explanation. The shaft member 606 includes a handle 608 welded or otherwise attached at a distal end thereof, and an actuating lever 609 is provided on the handle to operate a clutch mechanism to either engage or release each of the arm exercise members 502 from a desired opening in its adjacent drive member 530. (FIG. 25A) Specifically, the lever 609 can be actuated to release a clutch pin 536 from one of the openings in the drive member 530 and permit the rotational adjustment of the arm exercise member 502 into a different rotational position relative to the drive member, where the clutch pin is then permitted to lock the arm exercise member 502 in place. Different, exemplary, fixed rotational orientations of an arm exercise member 502 relative to a drive member 530 are shown at 502A, B, C and D in FIGS. 23A and 23B, and the described mechanism is best shown in FIGS. 27A-27C.

Again referring to FIG. 25, the illustrated embodiment of the arm section 602 also includes telescoping members 610, 612, which are similar to the telescoping members 604, 606 providing the forearm section 600. Specifically the telescoping member 610 is a cylindrical sleeve-like member that is welded to the distal end of the adjustable shaft 538 (e.g., FIG. 21A) and receives a linearly adjustable, telescoping shaft 612 therein. This shaft 612 includes an outwardly biased ball or pin for snapping into engagement with a desired passage or opening 614 provided through the peripheral wall of the cylindrical sleeve-like member 610, in the same manner that the shaft 606 of the forearm section 600 is linearly adjusted relative to the cylindrical section 604 of said forearm section.

Still referring to FIG. 25, the shaft 612 of the arm section 602 is pivotally connected to the cylindrical sleeve-like member 604 of the forearm section 604 through the cooperation of a axle 620 mounted through a clevis 622. A bottom wall 624 of the clevis 622 supports the cylindrical member 604 of the forearm section 600 in linear orientation with the arm section 602 when the forearm section is fully rotationally extended relative to the arm section 602.

Figure 22A:
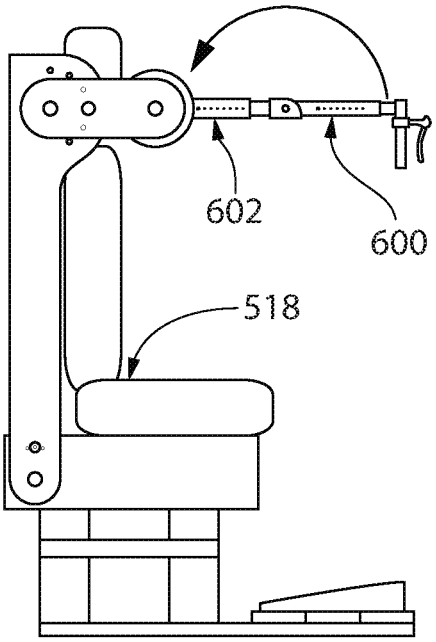
FIGS. 22A-22B are schematic side elevation views showing exercise arms of the exercise device of FIGS. 21A and 21B in an extend and rotationally retracted position.

Referring to FIG. 22A the forearm section 600 is in a fully extended position relative to the arm section 602. That is the angle between these two sections is 180 degrees.

Figure 22B:
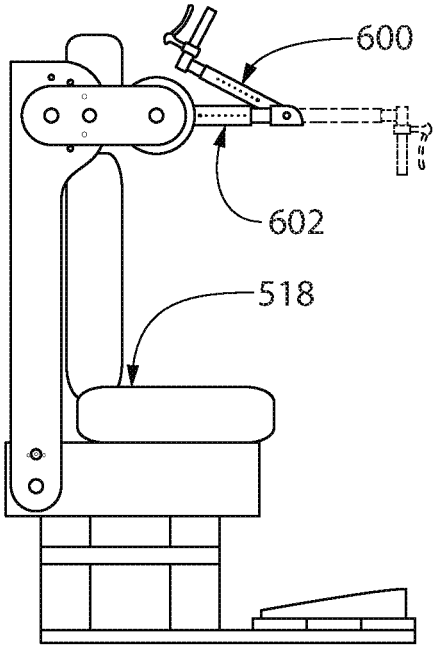

FIG. 22B shows the angular orientation of the forearm section 600 relative to the arm section 602 after the forearm section has been fully rotated in a counterclockwise direction as illustrated by the arrow in FIG. 22A. It should be apparent that arm exercises can be carried out with the arm and forearm sections 600, 602 in the fully extended position illustrated in FIG. 22A; the fully retracted position illustrated in FIG. 22B or any intermediate, angular position of such sections.

Figure 28B:
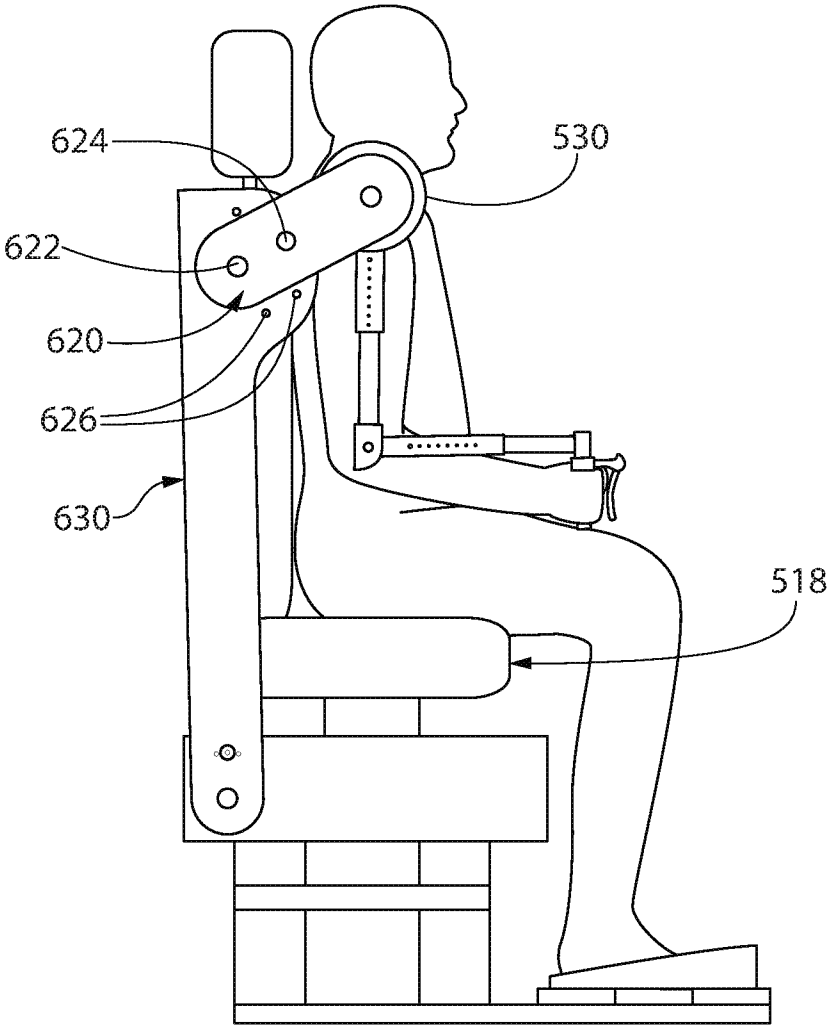
FIGS. 28A-28B are schematic side elevational views similar to FIGS. 26A and 26B showing exercisers of different sizes being accommodated on the exercise device with the seat being adjusted to properly accommodate the exercisers on the device.
Figure 28A:
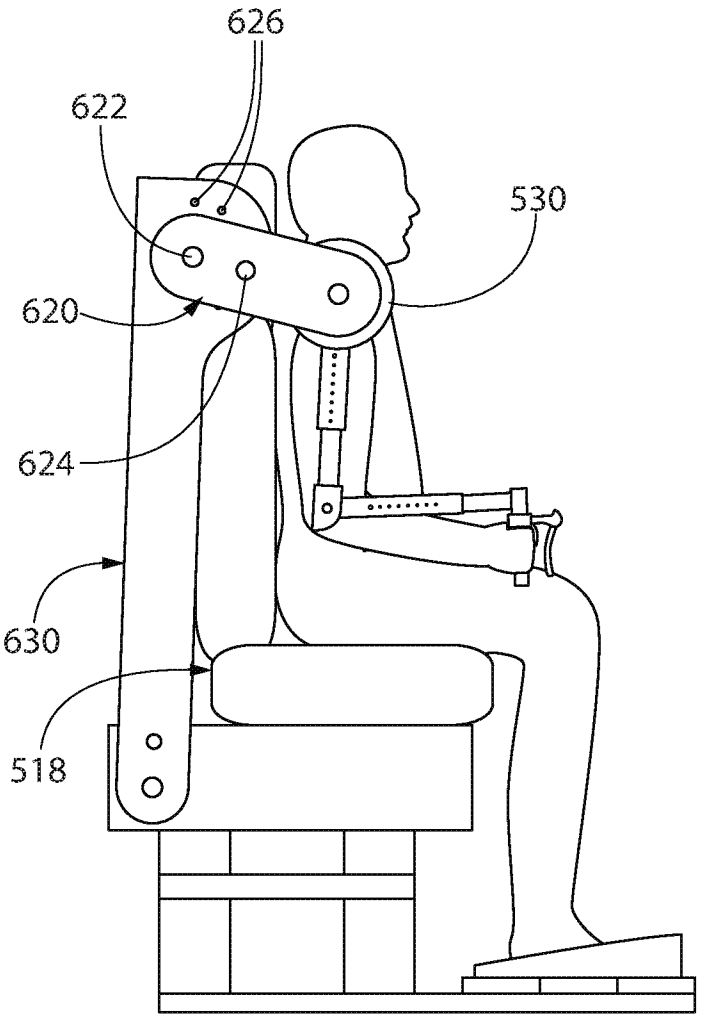

As can be seen in a number of the Figures, but described herein with respect to FIGS. 28A and 28B, each of the drive members or disks 530 is rotationally mounted on a distal end of a rotationally mounted support arm 620. This arm 620 is rotationally mounted on pivot axle 622 and can be set in a variety of different arcuate positions by engagement of a lock pin (not shown) passing through an opening 624 in the support arm 620 and through one of the arcuately-spaced openings 626 provided in an upstanding, back support member 630. The lock pin can be of any conventional design, and specifically can be the same as lock pins used in exercise devices to capture a weight stack of a predetermined weight for carrying out an exercise. These lock pins generally include an actuating button in the head thereof, which is pushed in to permit a distal end thereof to be inserted through a desired opening, and thereafter the button is released to permit the distal end to be captured within the opening.

Referring to FIGS. 28A and 28B, the rotationally mounted arm 620 is illustrated as being fixed in two different rotational positions to aid in properly aligning the rotational axle of the drive members 530 with the shoulders of the exerciser. Adjustment of the rotational position of the arm 620 often is required to accommodate exercisers of different heights.

Figure 26B:
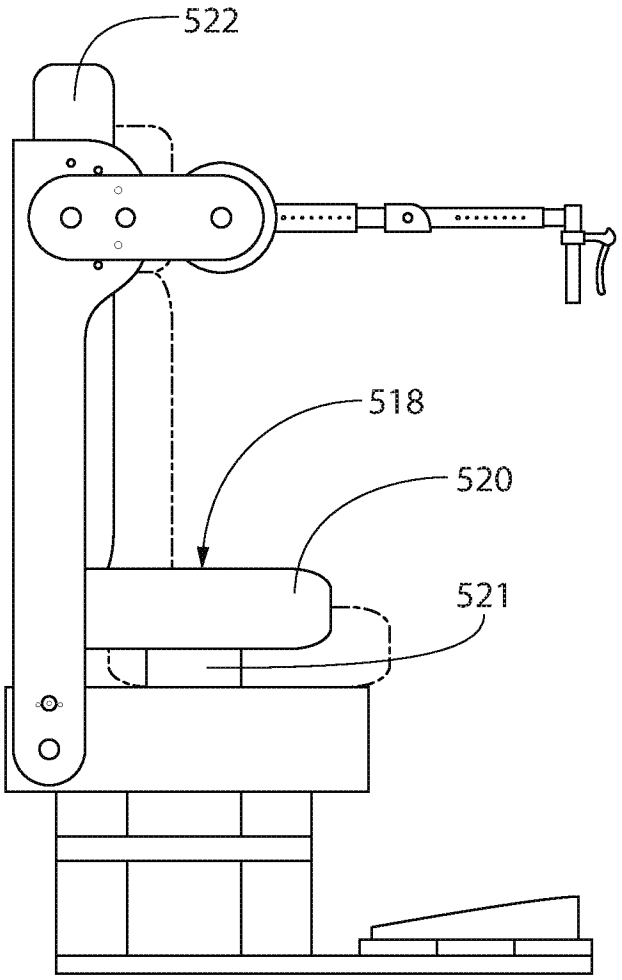
FIGS. 26A-26B are schematic side elevational views similar to FIGS. 22A and 22B showing the adjustability of the seat of the exerciser both vertically and transversely to accommodate exercisers of different heights/body dimensions.
Figure 26A:
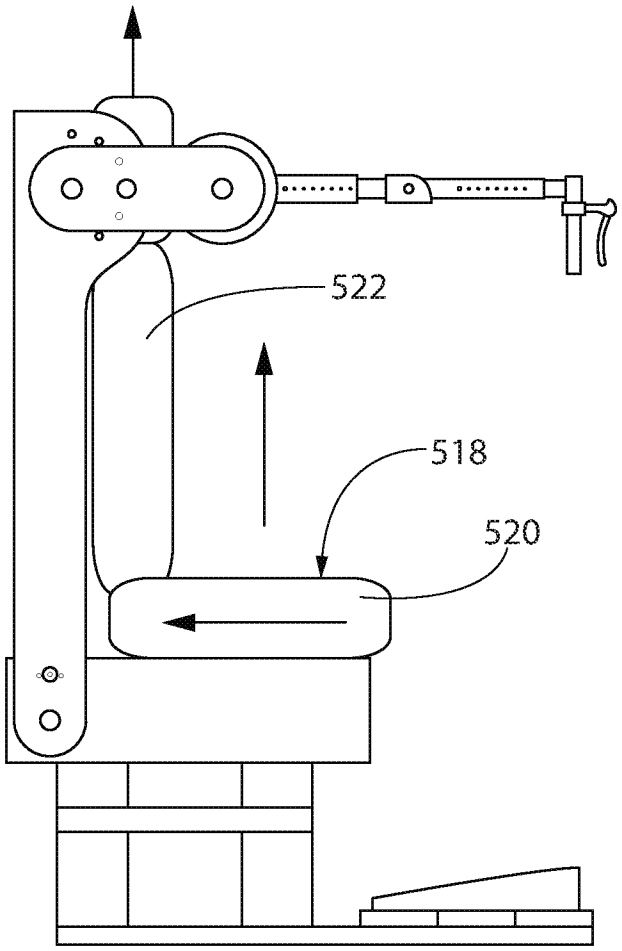

Referring to FIGS. 26A and B the adjustability of the seating piece 518 is schematically illustrated to accommodate exercisers of different heights, as is shown in FIGS. 28A and B. FIG. 26A shows a position of the seating piece 518 with the seat 520 and backrest 522 in a forward-most and lower-most position for accommodating an exerciser of small stature. FIG. 26 B shows the seating piece 518 adjusted to position the seat 520 and backrest in their most rearward and upward positions to accommodate an exerciser of a large stature. As is schematically illustrated, a piston rod 521 engages a mount for the seat 520, and that mount can include rails (not shown) for permitting the forward and rearward movement of the seating piece 518 in a manner similar to that employed in an automobile. The piston rod 521 is operated to either raise or lower the seating piece. It should be understood that the specific mechanism for permitting both transverse and vertical adjustments of the seating piece 518 on its support does not constitute a limitation on the broadest aspects of this invention. Numerous devices include adjustable features for permitting a seating piece to either be raised or lower, or slid forwardly or rearwardly. Although adjustability may be an important or desirable feature in this invention the manner of providing that adjustability can be achieved with the use of well known prior art systems.

FIGS. 28A and 28B show individuals of small and large stature, respectively sitting on the seating pieces positioned as illustrated in FIGS. 26A and B, respectively. As can be seen the drive member 530 is rotatably positioned so that its axis is aligned with the shoulder joint of the exerciser. This is a desirable orientation for a number of exercises to be carried out on the exercise device 500 of this invention.

Figure 24B:
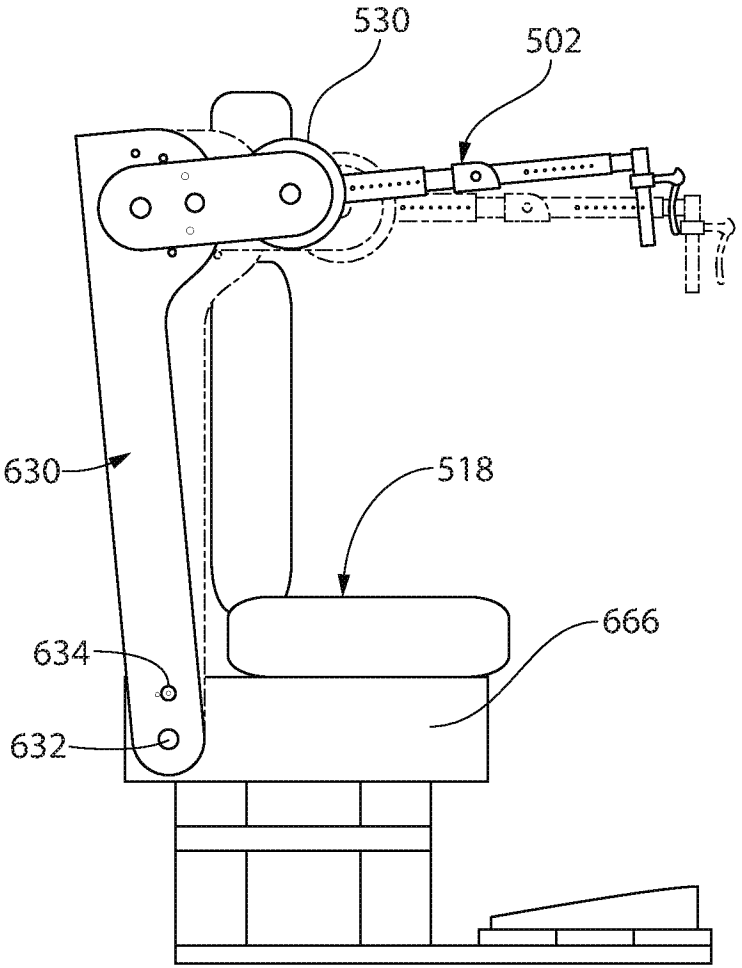
FIGS. 24A-24B are schematic side elevational views similar to FIGS. 22A and 22B but showing supports for exercise arms in different positions to demonstrate the ability to change the orientation of the arms relative to the exerciser.
Figure 24A:
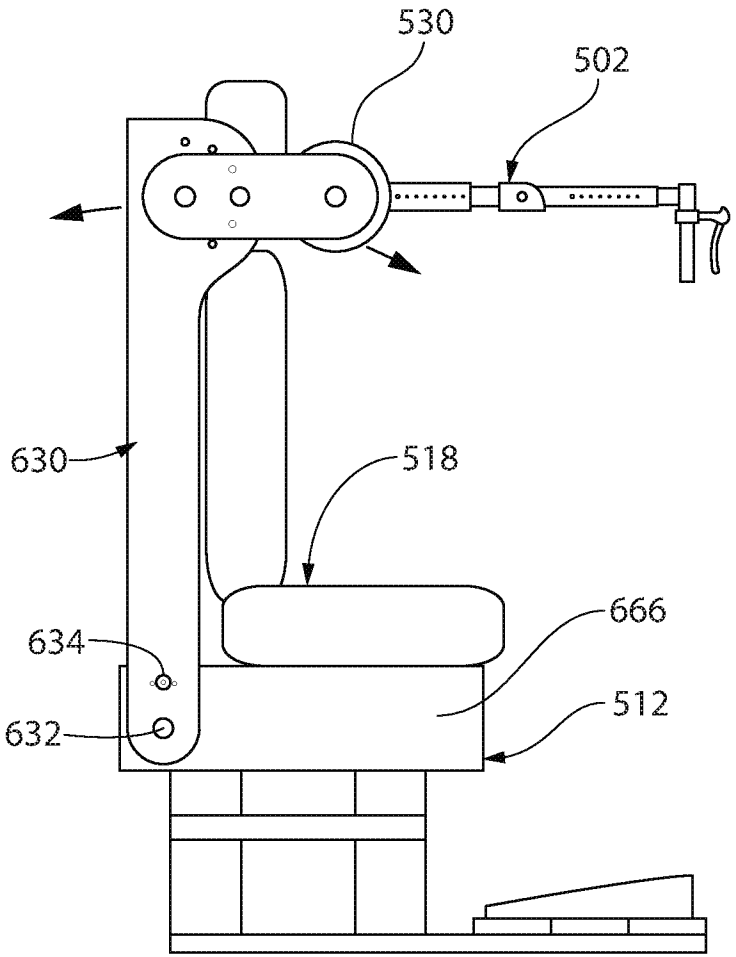

Referring to FIGS. 24A, 24B, the upstanding back support member 630 is shown in two different rotational orientations. Rotation takes place about rotational axle 632 and the desired rotational position is maintained by the engagement of a lock pin 634 within a corresponding passage (not shown) in a horizontal frame member 666 of the seat mounting section 512. As can be seen in FIGS. 24A, 24B adjustment of the angular position of the upstanding back support member 630 changes the orientation of the exercise arm members 532 relative to the exerciser to thereby permit different angular movement of the arm exercise members 502 to work different parts of the chest/back in the illustrated positions.

Referring to FIGS. 27A through 27C, the use of the clutch mechanism to change the fixed, rotational position of the arm exercise members 502 relative to the exerciser is illustrated. FIG. 27A illustrates clutch pin 536 engaged within one of the arcuately spaced passages in the drive member 530, with the arm exercise member 502 extending generally horizontally as illustrated.

Referring to FIG. 27B, the actuating lever 609 of the clutch mechanism is pulled inwardly, as illustrated by the arrow in FIG. 27A, to release the clutch pin 536 from the opening in the drive member 530 and permit rotational adjustment of the arm exercise member 502 relative to the position shown in FIG. 27A.

As shown in FIG. 27C, the arm exercise member 502 is rotated clockwise relative to its position in FIG. 27A into a downwardly inclined position and the actuating lever 609 of the clutch mechanism is released to permit the clutch pin 536 to enter an aligned passage in the drive member 530 to thereby lock that arm exercise member to the drive member in a downwardly inclined orientation, as illustrated.

It should be understood that the arm exercise members 502 can be oriented in a number of different rotational positions on the drive member 530 depending upon the number of arcuately spaced apart passages that are provided through the drive member concentric with its rotational axis.

Turning again to FIGS. 23A and B, an arm exercise member 502 is shown in a number of different fixed positions on the drive member 530 to provide for a number of different upper body exercises.

Figure 23A:
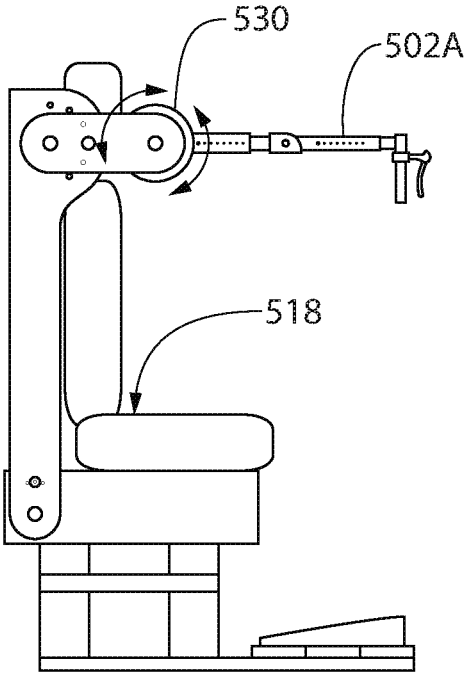
FIGS. 23A-23B are schematic side elevational views similar to FIGS. 22A and 22B showing different, preset rotational positions of the exercise arms of the exercise device and also different angular positions of arm segments that can be employed in the exercise device.

For example, four different fixed positions are illustrated in FIGS. 23A and B, as described earlier herein. In position A (502A), as shown in FIG. 23A, an exerciser can alternately do rows by rotating the arm exercise members 502 downwardly in a clockwise direct and pivoting the forearm section 600 to a 90 degree orientation relative to the arm section 602 and chest presses by moving the arm exercise members 502 in an opposite direction to the orientation shown in FIG. 23A.

Figure 23B:
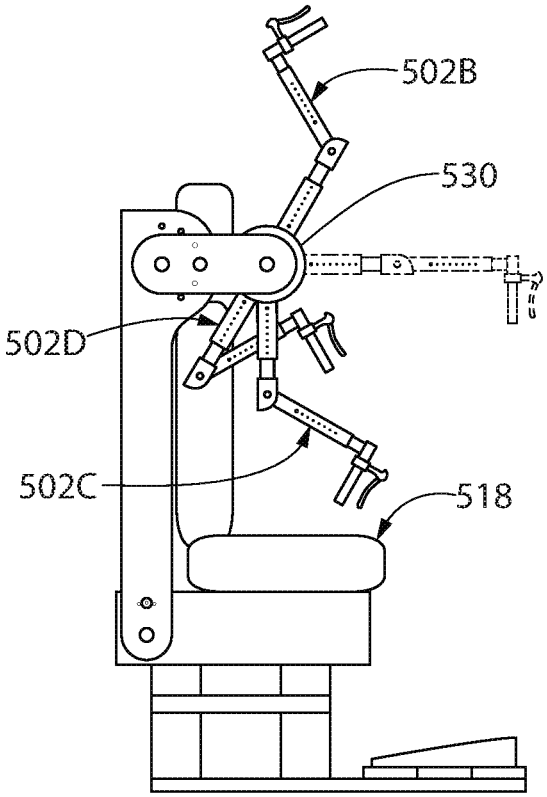

Again, by way of example, with the arm exercise members 502 in position B (502B), as shown in FIG. 23B, the arm exercise members can be moved in opposite direction to provide lat pull downs and shoulder presses, respectively.

In positions C and D (502C and 502D) in FIG. 23B the arm exercise members 502 can be employed to provide vertical dips and shoulder shrugs.

The above discussion of the upper body exercises that can be performed with the exercise device 500 is merely exemplary of a number of different exercises that can be performed, and is not intended as a limitation of the present invention. It also should be understood that these upper body exercises can be carried out with synchronized motion of the exerciser sliding on the sliding seating piece 518, as will be described in greater detail hereinafter.

All exercises movements of the arm exercise members 502 in opposite directions are carried out against a resistive force. This resistive force exists even when the platform supporting the device is not pivotally mounted. However, pivoting of the platform in opposite directions about the pivot connection causes the exerciser to move in an uphill direction during each of the directions of movement of the arm exercise members 502 to enhance the resistance to movement of the arm exercise members in each direction, relative to the resistance provided when the platform is not pivotally mounted or moved. This reciprocating manner of operation has been described in detail in connection with the earlier embodiments of this invention and will not be repeated herein.

Turning now to FIG. 27A and FIGS. 29 A-C, the manner of establishing synchronized movement of the arm exercise members 502 and the seating piece 518 will be described. It should be understood that movement of the arm exercise member 502 in one direction during an upper body exercise will function to provide a linear movement of the seating piece 518 in one direction when all elements of the drive system are engaged. Movement of the arm exercise members 502 in the opposite direction will cause linear movement of the seating piece 518 in the opposite direction. Thus movement of each of the arm exercise members 502 in opposed directions during an upper body exercise will impart a reciprocating, translating motion to the seating piece. This synchronized motion is similar to the synchronized motion provided in the previously disclosed embodiments of the invention.

The major differences between the exercise device 500 and the previously disclosed embodiments is that in the exercise device 500 the body support member is a seating piece and that the drive mechanism includes a gear box 650 capable of providing different types of synchronized motion. The use of the gear box 650 provides a mechanism that easily provides the ability to disengage movement of the arm exercise members 502 from the drive system for permitting movement of the seating piece 518, by itself, and providing the ability to engage movement of the arm exercise members 502 to the drive system.

Referring to FIG. 27A each of the drive members 530, in the form of a disk, is connected to an arm exercise member 502 through clutch pin 536. Rotational movement of the disk 530 through operation of the arm exercise members 502 will be communicated to sliding movement of the seating piece 518 through the drive system to be described hereinafter. Moreover, sliding movement of the seating piece 518 will cause rotation of the drive disks 530 and movement of the arm exercise members 502 connected to said disks through a drive system to be described. Suffice it to state that the drive system controls reciprocating movement of the seating piece 518 in opposite longitudinal directions during opposed movements of each of the arm exercise members 502.

Turning to FIGS. 29A-C, movement of each arm exercise member 502 in one direction causes rotational movement of the attached drive disk 530 in one rotational direction and movement of each of the arm exercised members 502 in an opposite direction causes rotational movement of the attached drive disk in a rotational direction opposite said one rotational direction. It should be noted that in the illustrated embodiment the one direction of movement of one arm exercise member is opposite to the one direction of movement of the other arm exercise member. With this arrangement, the arm exercise members 502 are connected to oppositely rotating input shafts 652, 654 of the gear box 650 that functions to impart rotation in a single direction to a vertical output shaft 656 of the gear box 650. The gear box 650 either is directly or indirectly connected to the underside of the seat mounting section 512 to move linearly with said seat mounting section, and the distal end of the output shaft 656 of the gear box is connected to a horizontally oriented pulley 658. A drive belt 659 is wrapped about the pulley 658 in driving engagement therewith, and opposed ends of the drive belt are secured to opposed ends of the platform 503 (not shown). This connection between the pulley 658 and drive belt 659 is the same as the connection provided in earlier disclosed embodiments, with the exception that the pulley 658 is oriented in a horizontal plane under the seating piece 518. As a result of this connection rotational movement of the horizontally oriented pulley 658 in one rotational direction, e.g., counterclockwise as viewed in FIG. 29B, will cause the seat mounting section 512 with the seat thereon to move in one direction along the rear platform section 510, and movement of the horizontally oriented pulley 658 in the other rotational direction, e.g., clockwise as viewed in FIG. 29C will cause the mounting section 512 to be moved in a direction opposite said one direction.

In the illustrated embodiment, it should be understood that movement of the pulley 658 in one rotational direction (e.g., clockwise) is established by the movement of one of the arm exercise members 502 in one direction and the simultaneous movement of the other arm exercise member 502 in an opposed direction. When these movements of the arm exercise members are reversed than the pulley 656 will be rotated in the opposite rotational direction (e.g. counterclockwise). Thus in the illustrated embodiment upper body exercises are carried out by simultaneously moving the two arm exercise members 502 in opposed directions. This is the result of providing a gear box 650 wherein the transmission of oppositely rotated inputs from input shafts 652, 654 is output as a rotation of the output shaft 656 in a single rotational direction. When the rotation of each of the rotated inputs is reversed than the output shaft still will be rotated in a single rotational direction but opposite to its direction of rotation prior to reversal of the inputs.

Still referring to FIGS. 29A-29C the upper drive member or disc 530 is rotationally connected to a driven pulley 680 by a drive belt 682. The driven pulley 680 is rotatably connected to a concentric pulley 682 that is connected by a vertically oriented drive belt 684 to a lower pulley 686 fixed to rotate with a rotatably mounted axle 688 that is spaced rearwardly from, but essentially in the same horizontal plane as one of the input shafts 652, 654 of the gear box 650. A second, lower pulley 690 also is connected to the rotatably mounted axle 688 for rotation therewith, and this axle is connected by a drive belt 692 to a pulley 694 fixed to one of the input shaft 652, 654. This same arrangement is duplicated, or provided for both of the arm exercise members 502 and therefore a driving connection is provided between each of the input shafts 652, 654; the rotatably mounted axles 688 and the drive members or disks 530 to which the arm exercise members 502 are connected.

It should be understood that in the disclosed embodiment of this invention rotation of the vertically oriented axle in one direction will cause two interconnected shafts 652, 654 to rotate in opposite directions. Therefore if the two interconnected shafts are positively rotated in opposite directions the output to the vertically oriented axle will be rotation in a single direction.

If desired, a gear box can be employed in which rotation of a vertically oriented axle in one direction will provide a rotational output in only single direction. When such a gear box is employed each of the arm exercise members 602 will simultaneously be moved in the same direction during an upper body exercise. For example, with both of the arm exercise members 602 being extended in a horizontal direction, as depicted in FIG. 24A, they can simultaneously be moved downwardly and rearwardly to provide a rowing action, and then simultaneously moved back to their extended horizontal position.

Also, when it is desired to exercise either the lower torso or upper torso separately from each other, the gear box can be adjusted to disengage the vertically oriented axle from the other axles of the gear box that may be connected to the arm exercise members 502 of the device. In this arrangement the arm exercise members can be maintained in driving engagement with the upper drive member 530 without transmitting the rotational motion of the upper drive member to the vertically oriented axle connected to the pulley 658 which would result in sliding movement of the seating piece support member on the rearward platform 410. Likewise, if the seating piece support member is being slid back and forth for the purpose of exercising the lower torso of the exerciser, rotational motion imparted to the vertically extending axle connected to the rotating, horizontally disposed pulley will not be transmitted to the output axles of the gear box, and therefore not to the arm exercise members 502.

Figure 30A:
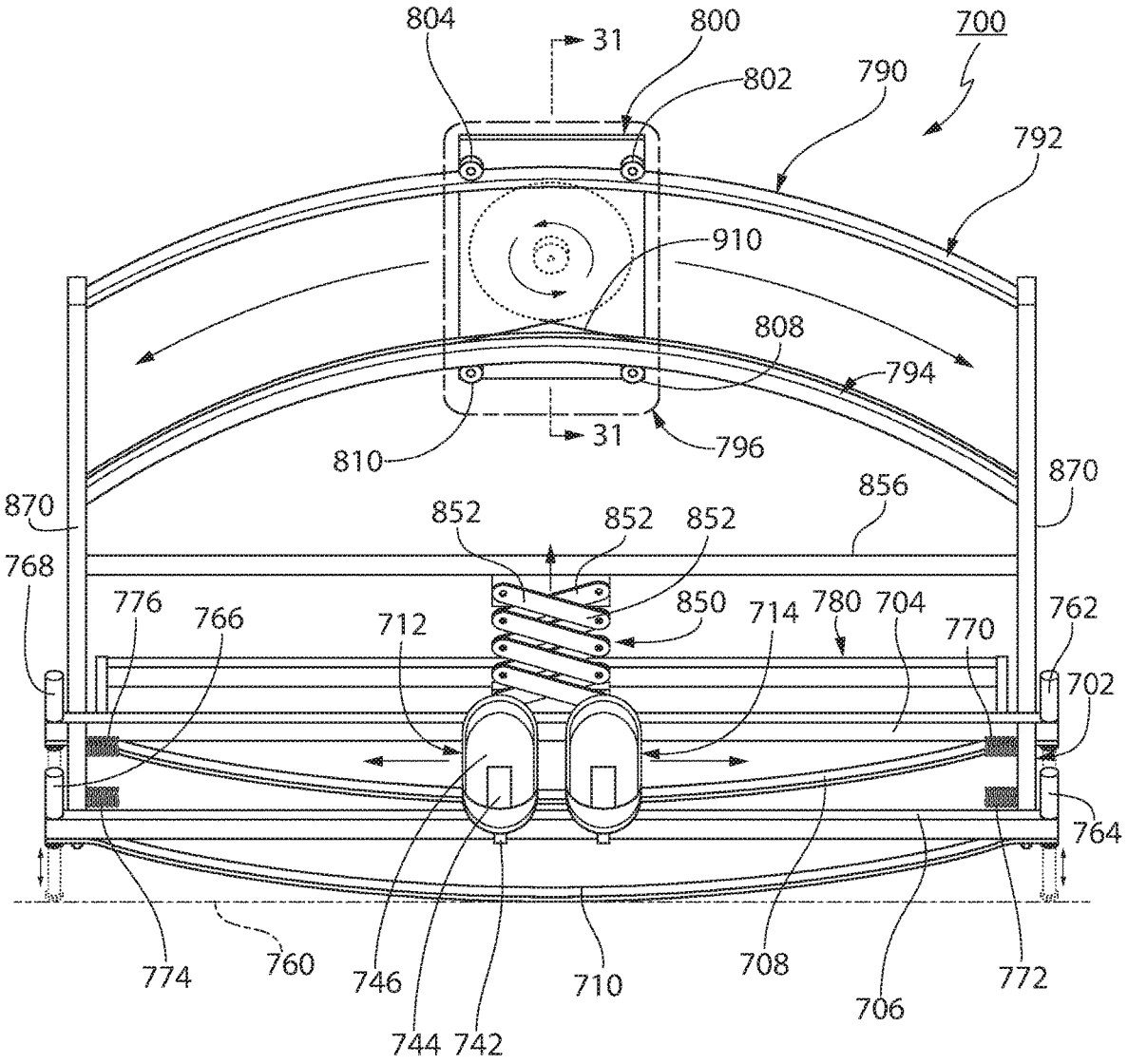
FIG. 30A is a tilted, front elevational view of the most preferred embodiment of this invention employed by an exerciser in the standing mode.
Figure 30B:
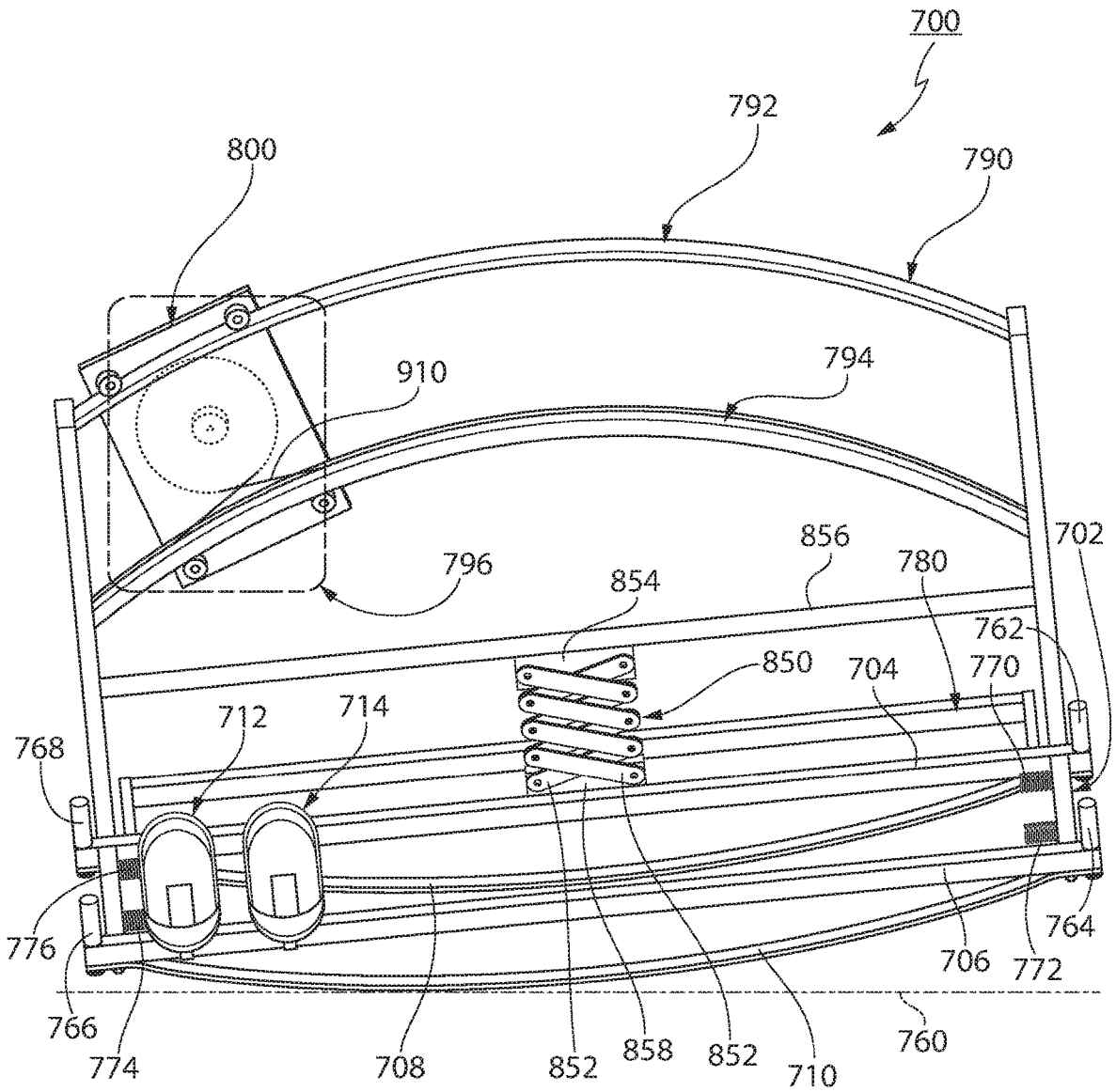
FIG. 30B is a tilted, front elevational view similar to FIG. 30A but showing the platform reciprocated, or rotated to one side.
Figure 30C:
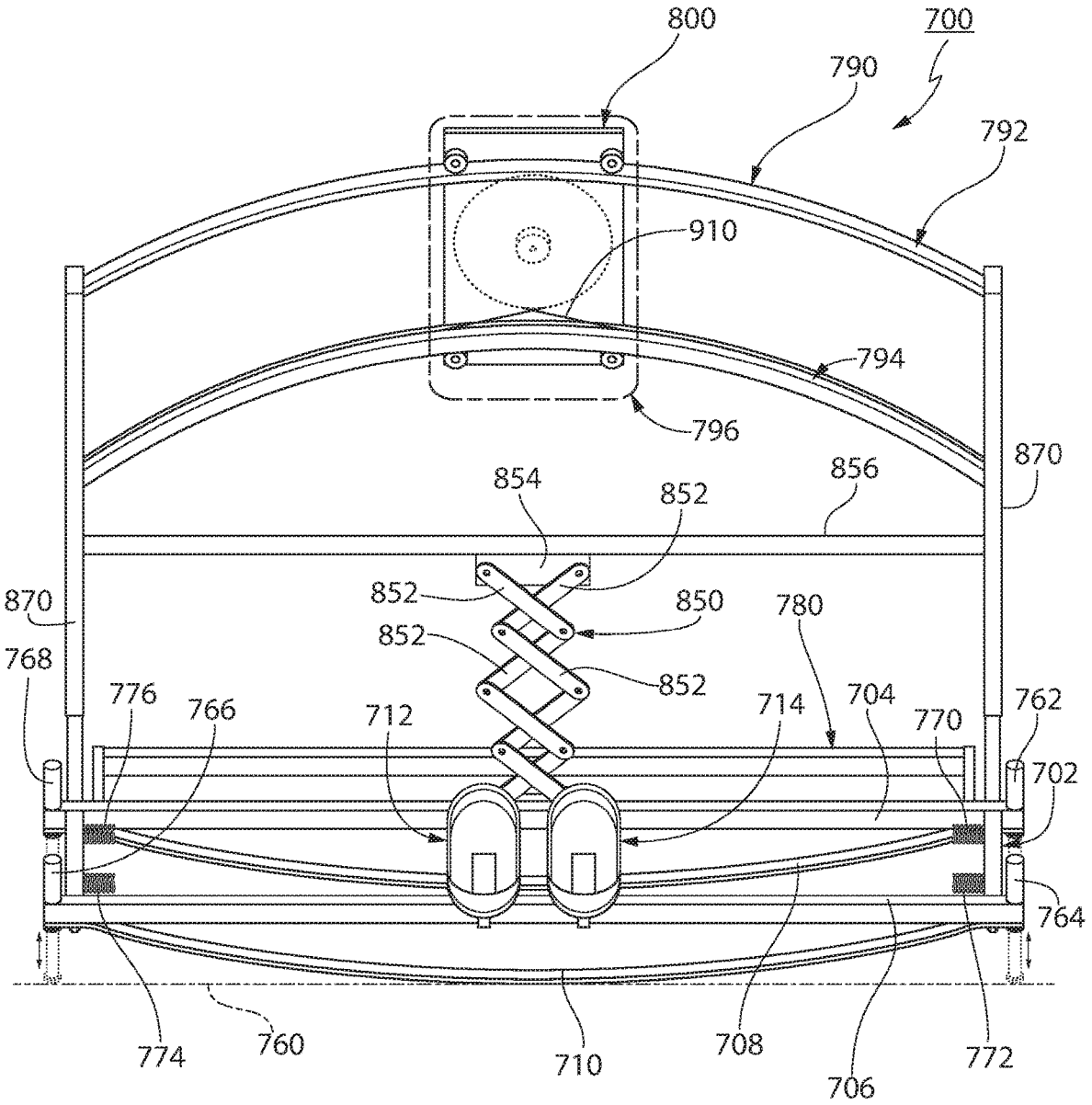
FIG. 30C is a tilted, front elevational view similar to FIG. 30A, but showing the body support member adjusted vertically upward relative to the position shown in FIG. 30A.
Figure 31:
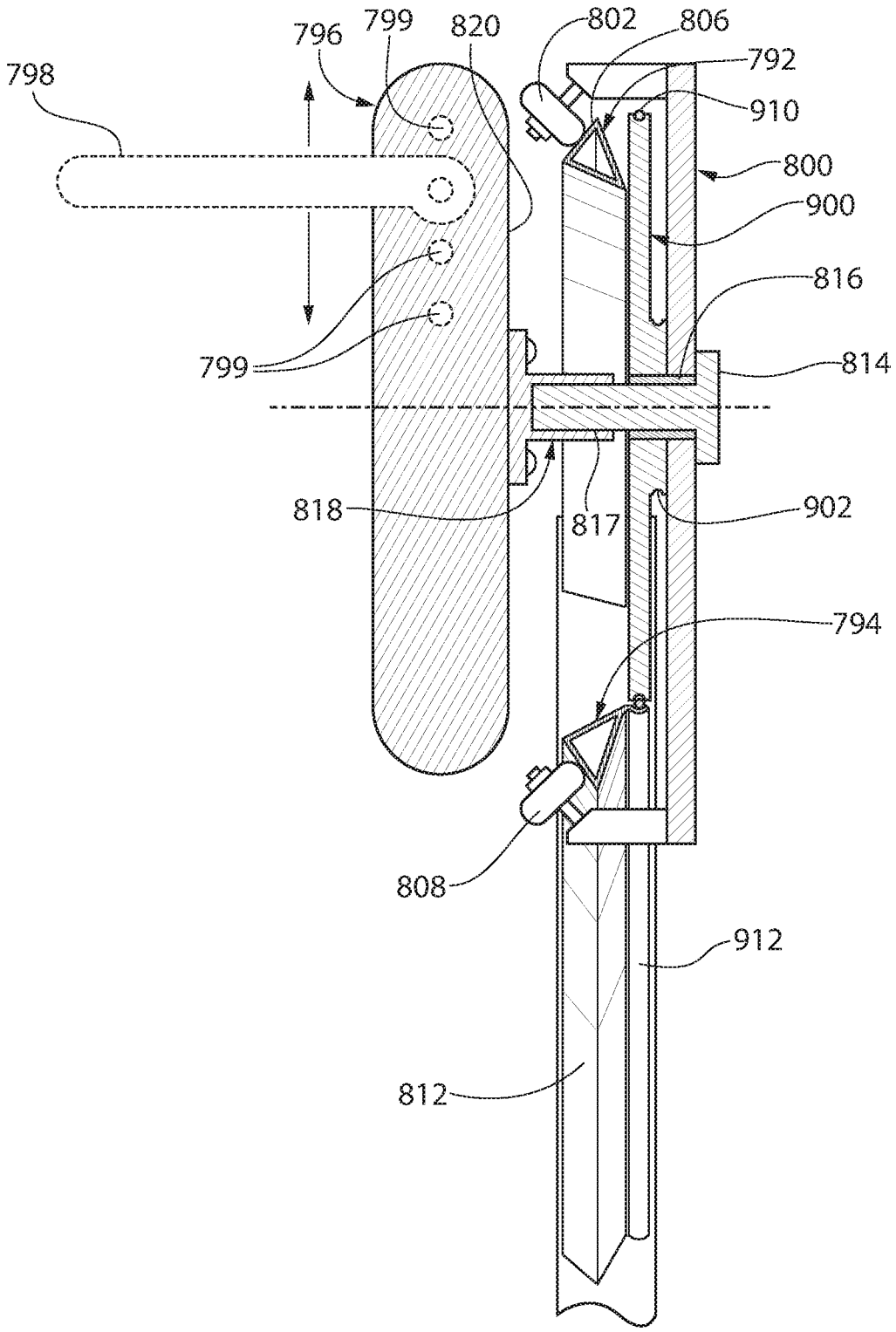
FIG. 31 is a sectional view along line 31-31 in FIG. 30A.

An exercise device in accordance with a preferred embodiment of this invention is illustrated at 700 in FIGS. 30 through 32. This device 700 includes features that can be employed in other embodiments of this invention, as will be self-evident.

The exercise device 700 is designed for use by an exerciser in a standing position. However, a number of features of exercise device 700 also can be employed in seated models of this invention, Referring to FIGS. 30A-C the exercise device 700 includes an elongate platform 702 provided by transversely spaced apart rails 704 and 706. The rails are mounted for rocking or reciprocating motion through arcuate members 708, 710, respectively, attached to and extending downwardly from the rails. These arcuate members replace the pivot arrangement employed in the embodiment illustrated in FIG. 1A, and also eliminate the need for using force transmitting devices of the type shown at 26 in FIG. 1A. It should be understood that the elongate platform 702 employing the arcuate members 708, 710 can be employed in the earlier disclosed embodiments of this invention, including the seating versions.

Referring to FIGS. 30A-C and 32A and B, a pair of foot support members 712, 714 are attached to the elongate platform 702 for sliding movement in a longitudinal direction. Each of the foot support members 712, 714 is attached to the rails 704, 706 of platform 702 in the same manner.

Figure 32A:
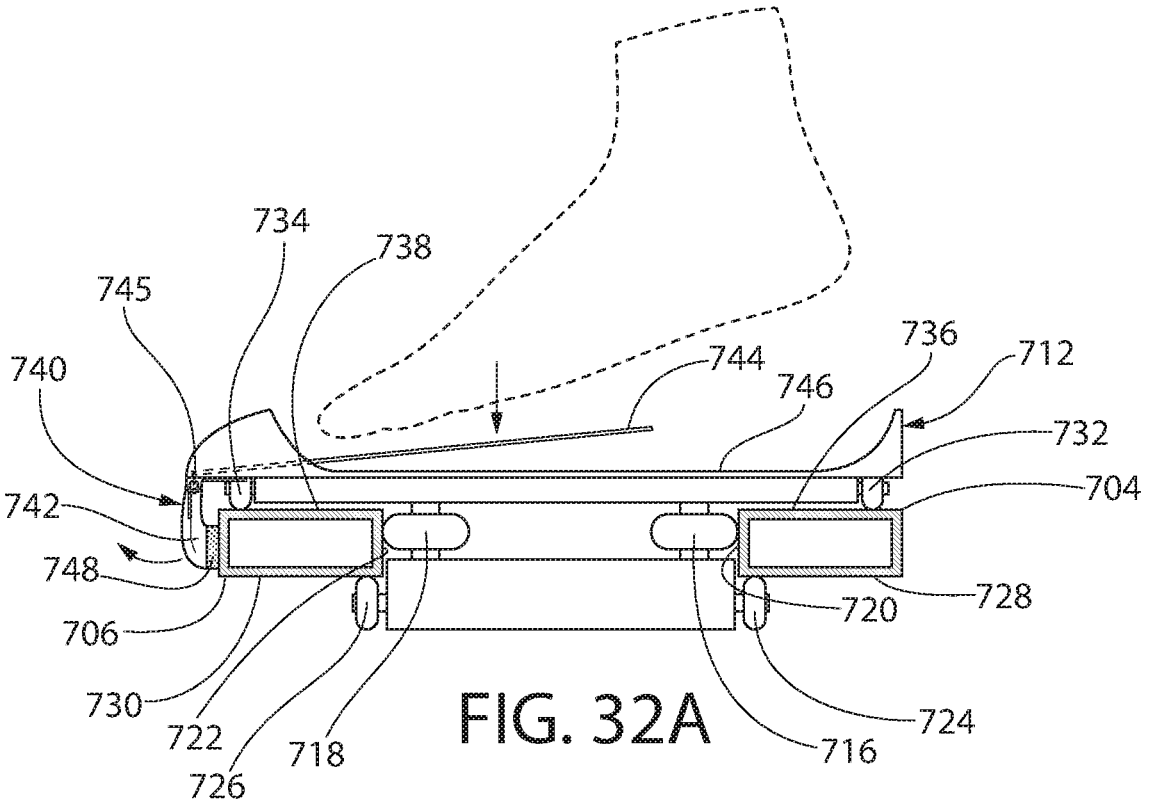
FIGS. 32A and 32B illustrate a foot support member employing an automatic lock and foot-actuated lock release employed to lock the foot support against movement relative to the elongate platform and to release the lock to permit relative movement of the foot support and elongate platform, respectively.

Referring to FIGS. 32A and B, the attachment of foot support member 712 is shown, it being understood that foot support member 714 is attached to the rails in the same manner. The foot support member 712 includes transversely spaced apart rollers 716, 718 engaging inner surfaces 720, 722 of rails 704, 706, respectively; spaced apart rollers 724, 726 engaging lower surfaces 728, 730 of the rails 704, 706, respectively, and spaced apart rollers 732, 734 engaging upper surfaces 736, 738 of the rails 704, 706, respectively. As a result of this construction, the foot support members 712, 714 are capable of sliding longitudinally along the rails 704, 706 of the elongate platform 702, in the same manner as in the earlier described embodiments of this invention. In accordance with the broadest aspects of this invention a number of different arrangements can be employed to slidably mount the foot support members 712, 714 on the platform 702; the particular arrangement employed not constituting a limitation on the broadest aspects of this invention.

Figure 32B:
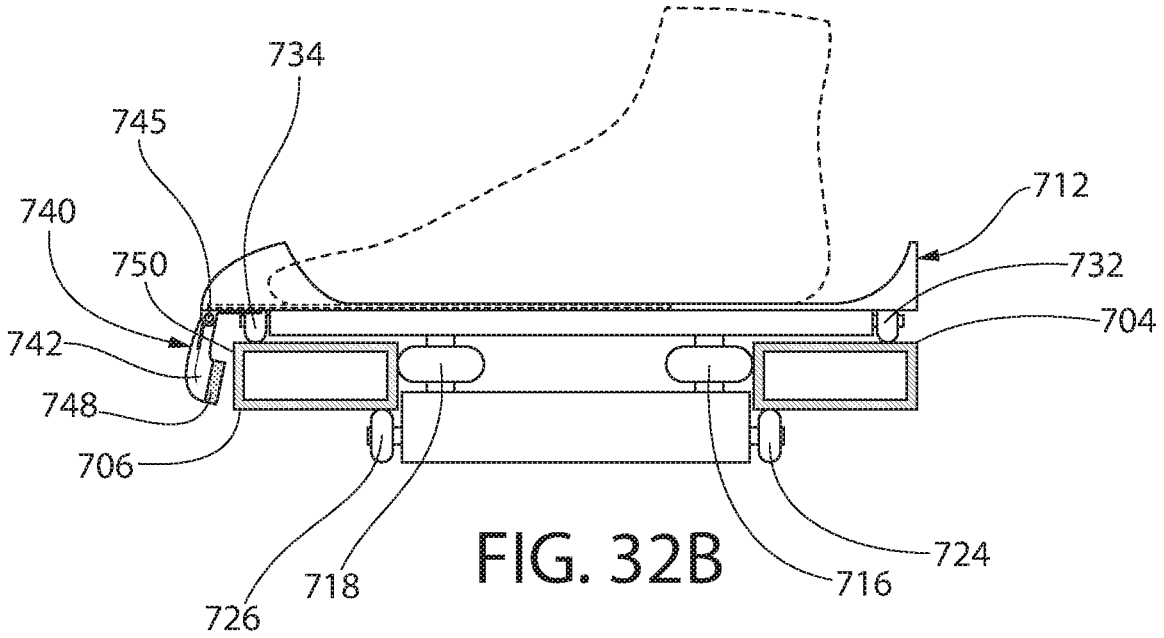

Referring specifically to FIGS. 32A and 32B stop members 740 are provided to immobilize or lock the foot support member 712, 714 against longitudinally movement along the elongate platform 702. The configuration of the stop member 740 is shown only with respect to foot support member 712; it being understood that the configuration of the stop member on foot support member 714 is of an identical construction. It also should be understood that these stop members can be employed on the earlier disclosed embodiments of this invention.

Specifically each of the stop members 740 includes a rail engaging member 742 attached to an actuating lever 744. The stop member is pivotally mounted to the underside of the shoe through a pivot mount 745. The actuating lever 744 overlies foot supporting surface 746 of the foot support member 712 to be engaged by an exerciser placing his/her into the foot support member.

The rail engaging members 742 includes a friction pad 748 for frictionally engaging outer surface 750 of the rail 704 to lock the foot support member 712 against reciprocating movement along the elongate platform 702, until an exerciser enters the foot support member 712 as illustrated in FIG. 32B. Upon entry into the foot support member 712 the foot engages and actuates lever 744 to release the rail engaging member 742 from engagement with the outer surface 750 of the rail 706. This permits longitudinal sliding movement of the foot support member 712 along the elongate platform 702. It should be understood that the stop member on the foot support member 714 is identical to the stop member on the foot support member 712 and operates in exactly the same manner.

Referring to FIG. 30A the platform 702 is shown in a horizontal position with the apex of each of the arcuate members 708, 710 engaging a lower support surface for the exercise device, as schematically depicted at 760 in FIG. 3A. In order to immobilize the platform 702 to prevent it from rocking or reciprocating relative to the support surface 760 a plurality of cyclic piston devices 762, 764, 766 and 768 are provided, each mounted adjacent a respective end of the rails 704, 706 of the elongate platform 702. In the fully extended position of the piston devices 762, 764, 766 and 768, as shown in phantom in FIG. 3A, the extended piston rod engages the support surface 760 to maintain the platform 702 in a horizontal position. This enables an exerciser to mount the exercise device 700 easily with the platform 702 and foot support members 712, 714 fixed against movement.

Once an exerciser is on the exercise device 700, the stop members 740 are automatically released to permit sliding movement of the foot support members 712, 714 along the transversely spaced apart rails 704, 706 of the elongate platform. However, unless the cyclic piston devices are actuated to retract the piston rods, either partially or fully, the elongate platform 72 will be maintained in a fixed horizontal position, against rocking or reciprocating motion.

In accordance with the preferred use of this device, once an exerciser is in proper position with his or her feet in the foot support members 712, 714 the piston devices 762, 764, 766 and 768 can either be fully or partially retracted to control or establish the desired degree or angle of rocking or reciprocation motion of the elongate platform 702.

It should be understood that the cyclic piston devices can be pneumatically operated, electrically operated, manually operated or can be of any desired configuration or form to provide the desired stabilization of the platform 702. Moreover, the piston devices can be actuated by any desired hard-wired or wireless system to permit easy control of these devices with the exerciser located on the exercise device 700.

As viewed in FIG. 3B the piston devices 762, 764, 766 and 768 are fully retracted and the platform 702 is in its lowest position on the left, established by the sliding movement of an exerciser to the far left of the platform 702.

As can be seen in FIGS. 30A and 30C the piston rods are fully extended to immobilize the platform 702 against rocking or reciprocating motion and to maintain the platform in a substantially horizontal orientation. An exerciser can easily mount the exercise device 700 when in this condition.

The piston devices 762, 764, 766 and 768 preferably are adjustable in preselected increments from a fully extended position to a fully retracted position to control the angular degree of rocking or reciprocation of the platform 702 relative to the support surface 760. Piston devices of this type are known in the art and do not require any further explanation.

It should be understood that any desired type of device can be employed to either immobilize the platform 702 or control the degree of rocking of the platform. Moreover, in accordance with the broadest aspects of this invention the exercise device 700 can omit the inclusion of piston devices or other types of devices for either immobilizing or controlling the rocking action of the platform 702.

As can be seen in FIGS. 30A through 30C, a plurality of compression springs 770, 772, 774 and 776 are mounted at opposed ends of the spaced apart rail 704, 706 to thereby cushion or absorb the force imparted to them by the foot support members 712, 714 as they reach the ends of one linear stroke and reverse directions for movement in an opposed linear direction. It should be understood that in accordance with the broadest aspects of this invention means other than springs may be employed, if desired, to cushion or absorb the force provided by the movement of the foot support members to each end of the platform; prior to the foot support members reversing their direction of movement on said platform 702. In accordance with the broadest aspects of the invention force-absorbing members can be eliminated; but they clearly provide a benefit in the most preferred embodiments of the invention.

Referring to FIGS. 30A-C a guide member 790 extends vertically upward from the platform 702 adjacent the rear thereof. The guide member 790 includes vertically spaced apart, upper and lower, longitudinally extending arcuate supports 792, 794 to slidably support a body support member 796 thereon; shown in phantom representation in FIGS. 30A-30C. The body support member 796 can be the same as employed in earlier embodiments of this invention, e.g. see FIG. 12. In particular, the seating piece can include shoulder harnesses and/or a waist belt, as desired, e.g., the same as the shoulder harnesses 74 and waist belt 76 shown in FIG. 1A.

Still referring to FIGS. 30A-C a stabilizing member 780 extends rearwardly of the guide member adjacent the lower end of the device to aid in stabilizing the exercise device, e.g., prevent it from tipping backwards, when an exerciser is on the device 700. Other stabilizing members can be used in this invention, if desired or necessary. The specific construction of the stabilizing member does not constitute a limitation on the broadest aspects of this invention.

As can be seen best in FIG. 31, the body support member 796 is in the form of a back support and includes adjustably mounted shoulder engaging members adjustably mounted to opposed sides of the body support member (only one such shoulder supporting member being illustrated in phantom at 798). The shoulder supporting members are vertically adjustable by being positioned in a desired mounting opening 799 to position them in a position comfortably resting on the shoulders of an exerciser during use of the exercise device 700. The shoulder supporting members can be placed and immobilized in any desired opening 799 in any conventional manner; the specific manner not constituting a limitation on this invention. The inclusion of the shoulder engaging members, e.g., 798 is an optional feature in accordance with the broadest aspects of this invention. However, when employed they do provide a supporting/stabilizing benefit for the exerciser.

Referring to FIGS. 30 and 31 the body support member 796 is rotatably attached to a mounting plate 800 that, in turn, is mounted on the arcuate supports 792, 794 for movement both longitudinally along the elongate dimension of the platform 702 and in a direction normal or vertical to that longitudinal movement. Specifically the mounting plate 800 includes spaced apart upper rollers 802, 804 that are maintained in engagement with upwardly inclined surface 806 of upper arcuate support 792 and spaced apart lower rollers 808, 810 in engagement with downwardly inclined surface 812 of the lower arcuate support member 794. As can be seen best in FIG. 31 this arrangement of the rollers 802, 804 engaging upwardly inclined surface 806 of the upper arcuate support 792 and spaced apart lower rollers 808, 810 engaging downwardly inclined surface 812 of the lower arcuate support provides a firm connection permitting the mounting plate 800 to reciprocate in opposite directions along the arcuate path provided by the surfaces 806, 812 of the upper and lower arcuate supports 792, 794, respectively.

Referring specifically to FIG. 31 the body support member 796 is freely rotatably mounted relative to the mounting plate 800 through rotatable mounting pin 814, to be described in greater detail below. This mounting arrangement permits or causes thereby the body support member 796 to be maintained in a substantially vertical orientation relative to support surface 760 during alternate, reciprocating movement of the exerciser along the device 700, regardless of the position of the body support member along the elongate extent of the arcuate supports 792, 794. This clearly is shown in phantom representation in FIGS. 30A and 30B. Specifically, in FIG. 30A the mounting plate 800 is at the apex of the arcuate supports 792, 794 and the body support member 796 is oriented in a vertical orientation. As can be seen in FIG. 30B the body support member 796 is maintained in this same vertical orientation even when the mounting plate 800 is located at the far left of the arcuate supports 792, 794, due to the pivotal movement of the body support member 796 on, and relative to the mounting plate.

As is shown best in FIG. 31, the body support member 796 is mounted for rotational movement through a pin 814 mounted for rotational motion within a bushing 816 and mounted against rotation relative to a mount 818 attached to the back 820 of the body support member 796. This non-rotational mount can be achieved by providing the distal end of pin 814 of a non-circular cross-section mating within a recess 817 having a non-circular cross-section corresponding in shape to the non-circular cross-section of the distal end of the pin 814.

Referring to FIGS. 30A and 30C an adjustment mechanism 850 is provided for vertically adjusting the vertically spaced-apart arcuate supports 792, 794, as a unit, relative to the platform 702. The adjustment mechanism 850 includes a plurality of articulating links 852 attached at one end to a mount 854 secured to a horizontal support rail 856 of the guide member 790, and secured at its lower end to a lower mount 858 secured to rear rail 704 of the platform 702. The articulating links 852 can be of the type commonly employed in jacks for cars. Such jacks are well known to those skilled in the art and do not require further explanation. Suffice it to state that the articulating links 852 can be actuated to move from the retracted position shown in FIG. 30A to a fully expanded position shown in FIG. 30C, or to any intermediate position by an actuating member (not shown) of a conventional design. The actuating mechanism for controlling movement of the articulating links 852 of the jack (not shown) can be mounted directly on the exercise device 700 by any suitable arrangement; the specific arrangement not constituting a limitation on the broadest aspects of this invention. The operating mechanism can be placed close to the exerciser to permit adjustment of the spacing between the platform and the spaced-apart supports, 792, 794 with the exerciser on the device 700, as desired. Alternatively, the operating mechanism can be placed close to the linkage, or remote from the linkage, as desired.

As can be seen best in FIG. 30C, the guide member 790 includes vertically extending hollow tubular members 870 at opposed ends thereof. These hollow tubular members receive vertically extending post 872 extending upwardly from and secured to the platform 702. As can be seen in FIG. 30A the hollow tubular member 870 is in its lowermost position with the articulating links 852 fully retracted. As can be seen best in FIG. 30C, the hollow tubular member 870 is in its uppermost position relative to the vertically extending post 872.

As can be seen most clearly in FIG. 31 an enlarged pulley 900 is rotatably mounted on the bushing 816. A driven pulley 902 is integrally formed with the enlarged pulley 900, whereby actuation of the driven pulley 902 rotates the enlarged pulley 900. The driven pulley can be integrally formed with the enlarged pulley 900, as shown, or can be a separate pulley mounted to the enlarged pulley. In either case, movement of the driven pulley 902 will rotate the enlarged pulley 900.

It should be understood that the enlarged pulley 900 corresponds to enlarged pulley 330 in the device schematically illustrated in FIG. 20, and the driven pulley 902 corresponds to the driven pulley 328 in the device schematically illustrated in FIG. 20. Thus the exercise device 700 can employ with the same driven system 310, as illustrated in FIG. 20, with the belt drive 327 engaging the driven pulley 902.

The driven pulley 902 is driven by the movement of actuating members by appendages of the exerciser, such as movement of hand actuated exercising members employed with both standing and seated versions of the exercise devices disclosed earlier, e.g., hand actuated exercising members 204, 502.

For example, hand engaging exercise members illustrated at 204 in FIGS. 16 through 18 and 20, and employing the clutch mechanism 302 illustrated in FIG. 19, can be employed in connection with the embodiment of the invention illustrated in FIG. 30A. Specifically, referring to FIG. 20, the driven pulley 328 corresponds to driven pulley 902 illustrated in FIG. 31, and enlarged pulley 330 corresponds to enlarged pulley 900 illustrated in FIG. 31.

Thus, use of the hand engaging exercise members, e.g., 204, 502 provides the same reciprocating movement of body support member 796 as in earlier embodiments of this invention, with the exception that the body support member 796 is caused to move through an arcuate path as it reciprocates from one longitudinal end to the opposed longitudinal end of the exercise device 700.

As can be seen in FIGS. 30 and 31 a drive belt 910 is wrapped about the large pulley 900 similar to the manner in which drive belt 332 is wrapped about the periphery of the pulley 330 in the FIG. 20 embodiment. However, unlike the drive belt 332, the drive belt 910 wrapped around the pulley 900 is supported for movement along an arcuate path. To achieve this desired motion the drive belt 900 is supported in a supporting guide 912 included as part of the construction of the lower arcuate support 794 to thereby guide the ends of drive belt 910 to move in an arcuate path. The ends of the drive belt 910 are secured to the tubular vertical members 870 of the guide member 790, in the same manner that the drive belt 332 is attached to the legs 48 of the guide member 40 illustrated in FIG. 20.

Since the supports 792, 794 are arcuate the drive belt 910 is moved along this same arcuate path as the body support member 796 is caused to move in a linear direction by actuation of the manual exercise members, e.g., 204, 502 in the same manner as movement of the manual exercise members 204, 502 causes the body support member attached to rotatable pulley 330 to reciprocate back and forth along the longitudinal dimension of the exercise device.

The reciprocating motion of the body support member 796 in the longitudinal direction results in the body support member being moved both longitudinally and vertically as a result of the arcuate mounting of the body support member to the upper and lower arcuate supports 792, 794. This is a highly desirable mount, which permits the exerciser to maintain non-movable engagement with the body support member 796 while bending and extending his/her legs to provide the desired pushing action to establish reciprocating sliding movement of the exerciser on the platform 702. This non-movable engagement is achieved by the body support member 796 being moveable both vertically and linearly as the exerciser bends and extends his/her legs as he/she traverses the platform in opposed, linear directions during an exercise.

While the invention has been described in detail and with reference to specific examples thereof, it will be apparent to one skilled in the art that various changes and modifications can be made therein without departing from the spirit and scope thereof.

For example, coordination or synchronization of upper body exercise movement and sliding movement can be provided with an exerciser both in a standing or seated position on a body support member.

In addition, although not as preferred, upper body and lower body exercise movement can be synchronized in a device that employs a non-reciprocating platform. Although in such a device there will be a limited force created to oppose the movement of the upper body exercise device in opposite directions, movement of the upper body exercise devices in opposite directions in all embodiments still will be against a resistive force.

Moreover, although the preferred embodiment has be described in connection with employing upper body exercise members in conjunction with synchronized sliding movement of a body support member, it is within the scope of this invention to provide a similar drive system for coordinating or synchronizing movement of a lower body exercise device (e.g., leg exercise device) whereby movement of the legs in opposed directions creates synchronized sliding movement of a body support member.

What is claimed is:

1. An exercise device comprising: spaced-apart exercise members configured to be engageable by appendages of a user and moveable in opposed directions; a body support member for supporting the user; an elongate platform below said body support member, said elongate platform extending along a longitudinal axis between spaced-apart first and second opposed ends of said elongate platform; and a synchronizing drive system connecting the spaced-apart exercise members with the body support member, the synchronizing drive system adapted for moving the body support member in a first longitudinal direction away from the first opposed end toward the second opposed end of the elongate platform when the spaced-apart exercise members are moved in one of said opposed directions and in a second longitudinal direction away from the second opposed end toward the first opposed end of the elongate platform when the spaced-apart exercise members are moved in a direction opposed to said one of said opposed directions.

2. The exercise device of claim 1, further including a pair of foot support members slidably mounted on and relative to the elongate platform for movement along said longitudinal axis, and a mount for the elongate platform to permit reciprocating or rocking movement of the elongate platform for alternately permitting each of the spaced-apart first and second opposed ends to move upwardly and downwardly relative to a horizontal support surface for the exercise device, wherein one of said spaced-apart first and second opposed ends being moveable from a lower position to an upper position during the movement of said spaced-apart exercise members in said one of said opposed directions and moveable from said upper position to said lower position during the movement of said spaced-apart exercise members in said direction opposed to said one of said opposed directions.

3. The exercise device of claim 2, wherein the spaced-apart exercise members are configured to be moved against a resistive force opposing the movement of the spaced-apart exercise members in the opposed directions, respectively, as said user is moving, in a synchronized manner relative to the reciprocating or rocking movement of the elongate platform, from the one of said spaced-apart first and second opposed ends of the elongate platform toward the other of said spaced-apart first and second opposed ends of said elongate platform during the movement of the spaced-apart exercise members in the one of said opposed directions and from the other of said spaced-apart first and second opposed ends of said elongate platform toward said one of said spaced-apart first and second opposed ends of the elongate platform during the movement of the spaced-apart exercise members in said direction opposed to said one of said opposed directions.

4. The exercise device of claim 1, wherein the spaced-apart exercise members include members engageable by hands of the user.

5. The exercise device of claim 1 wherein said body support member comprises a seat.

6. An exercise device comprising: spaced-apart exercise members configured for engagement by appendages of a user; a body support member; an elongate platform below said body support member, said elongate platform having opposed ends and being elongate in a longitudinal direction between said opposed ends; and a drive system connecting the body support member and the spaced-apart exercise members; whereby the exercise device is configured such that movement in opposed directions of the appendages of the user engaging the spaced-apart exercise members transmits that movement to reciprocating sliding movement of the body support member relative to the longitudinal direction of said elongate platform.

7. The exercise device of claim 6, further including a mount for the elongate platform to permit reciprocating or rocking movement of the elongate platform for alternately permitting each of the opposed ends to move upwardly and downwardly relative to a horizontal support surface for the exercise device, wherein said body support member is configured to move from a first position adjacent to a first of the opposed ends of said elongate platform to a second position adjacent to a second of the opposed ends of said elongate platform during movement of the appendages of the user in a first of the opposed directions, and from the second position adjacent to the second of the opposed ends of said elongate platform to the first position adjacent to the first of the opposed ends of said elongate platform during movement of the appendages of the user in a second of the opposed directions.

8. The exercise device of claim 7, wherein the spaced-apart exercise members include members engageable by the hands of the user.

9. The exercise device of claim 8 wherein said body support member comprises a seat.

10. The exercise device of claim 7 wherein said body support member comprises a seat.

11. The exercise device of claim 6, wherein the drive system includes a gear box for transmitting rotational movement of a pulley moveable with the body support member to rotational movement transferred to at least one of the spaced-apart exercise members.

12. The exercise device of claim 11, wherein the gear box transmits the rotational movement of the pulley in a single rotational direction to a pair of output shafts from the gear box that are simultaneously rotated in opposite directions.

13. The exercise device of claim 12 wherein said body support member comprises a seat.

14. The exercise device of claim 12, wherein the gear box transmits the rotational movement of the pulley in a single rotational direction to a pair of output shafts from the gear box that are simultaneously rotated in the same direction.

15. The exercise device of claim 14 wherein said body support member comprises a seat.

16. The exercise device of claim 11 wherein said body support member comprises a seat.

17. The exercise device of claim 6 wherein the drive system includes a gear box for transmitting rotational movement of a pulley moveable with the body support member to rotational movement transferred to at least one of the spaced-apart exercise members, and including means for disengaging a transmitting means whereby the rotational movement of the pulley is not transmitted to the rotational movement of any of said spaced-apart exercise members, and the rotational movement of any of said spaced-apart exercise members is not transmitted to the rotational movement of the pulley moveable with the body support member.

18. The exercise device of claim 17 wherein said body support member comprises a seat.

19. The exercise device of claim 6 wherein said body support member comprises a seat.

* * * * *